US011172722B2

(12) United States Patent
Sumelius

(10) Patent No.: US 11,172,722 B2
(45) Date of Patent: Nov. 16, 2021

(54) SPORT FACE MASK MADE OF BENDED METAL WIRES INCLUDING AT LEAST ONE WIRE

(71) Applicant: JAMIDON LTD., Tampere (FI)

(72) Inventor: Jan Sumelius, Tampere (FI)

(73) Assignee: JAMIDON LTD., Tampere (FI)

( * ) Notice: Subject to any disclaimer, the term of this patent is extended or adjusted under 35 U.S.C. 154(b) by 46 days.

(21) Appl. No.: 16/226,978

(22) Filed: Dec. 20, 2018

(65) Prior Publication Data

US 2019/0380420 A1 Dec. 19, 2019

Related U.S. Application Data

(63) Continuation-in-part of application No. 14/579,106, filed on Dec. 22, 2014, now abandoned.

(60) Provisional application No. 62/608,158, filed on Dec. 20, 2017.

(51) Int. Cl.
*A42B 3/20* (2006.01)

(52) U.S. Cl.
CPC ..... *A42B 3/20* (2013.01)

(58) Field of Classification Search
CPC .... A42B 3/18; A42B 3/20; A42B 3/22; A42B 3/04; A42B 3/00; A42B 3/042; A63B 71/08; A63B 2071/105; A41D 13/1184
See application file for complete search history.

(56) References Cited

U.S. PATENT DOCUMENTS

| | | | | |
|---|---|---|---|---|
| 4,631,758 | A | 12/1986 | Newman | |
| 5,129,108 | A * | 7/1992 | Copeland | A42B 3/14 2/424 |
| 5,184,354 | A * | 2/1993 | Alfaro | A61F 9/02 2/425 |
| 5,806,088 | A * | 9/1998 | Zide | A42B 3/20 2/424 |
| D463,885 | S * | 10/2002 | Burns | D29/111 |
| 2007/0044193 | A1* | 3/2007 | Durocher | A42B 3/20 2/9 |
| 2007/0214537 | A1* | 9/2007 | Durocher | A42B 3/20 2/9 |

(Continued)

OTHER PUBLICATIONS

International Search Report, Application No. PCT/IB2018/00604555, dated May 29, 2019, 22 pages.

*Primary Examiner* — Khoa D Huynh
*Assistant Examiner* — Erick I Lopez
(74) *Attorney, Agent, or Firm* — Ziegler IP Law Group, LLC

(57) ABSTRACT

A sports face guard for a sports headgear includes a plurality of interconnected wires, wherein a wire of the plurality of interconnected wires has a cross section has a wedge surface with a first longest dimension, the first longest dimension of the wedge surface being in a direction of a major axis of the wire; a base surface with a second longest dimension, the second longest dimension of base surface being in a direction that is perpendicular to the major axis of the wire, the second longest dimension being less than the first longest dimension; wherein the first longest dimension of the wedge surface is longer than the second longest dimension of the second base surface; and wherein the second base surface of the wire comprises a substantially flat or concave surface portion.

17 Claims, 88 Drawing Sheets

(56) References Cited

U.S. PATENT DOCUMENTS

| | | | |
|---|---|---|---|
| 2007/0266471 | A1 | 11/2007 | Lin |
| 2016/0175684 | A1 | 6/2016 | Sumelius |

* cited by examiner

SPORT FACE MASK MADE OF BENDED METAL WIRES INCLUDING AT LEAST ONE WIRE

CROSS-REFERENCE TO RELATED APPLICATIONS

This application is a continuation-in-part application of U.S. patent application Ser. No. 14/579,106, filed on 22 Dec. 2014, status pending, and claims priority to and the benefit of U.S. Provisional Patent Application No. 62/608,158, filed on 20 Dec. 2017, the disclosures of which are incorporated herein by reference in their entireties.

BACKGROUND

Field

The present aspects of the disclosed embodiments relates to a sports face guard or eye protector made of bended metal wires or bars which are attached to each others to form a protective grid. The face mask is used in sports such as ice-hockey, field hockey, street hockey, floor ball, cricket, baseball, softball, football, lacrosse, and hurling. The face guard can be closely attached either to the users head by means of paddings and straps or to a helmet. Wires which are part of the guard may be extended to provide reinforcement elements for parts of the helmet such as brims.

Description of Related Developments

The types of face masks applicable for the aspects of the disclosed embodiments may be grouped according to functional features as follows:

1. Face masks (cages) comprising part of a headgear together with a helmet. The cage is mounted in front of a face opening in the helmet by means of clips and screws and covers the whole face. Examples: goalies (ice-hockey, field hockey, street hockey, floor ball), baseball catcher, men's lacrosse . . . .

2. Face masks (guards) comprising part of a headgear together with a helmet having a strong brim. The face guard is mounted stationary to the helmet with brackets and screws and covers the lower part of the face. An opening for viewing is provided proximate to the eyes between the brim and the face guard. Examples: Baseball batter, cricket batsman . . . .

3. Face masks comprising part of a headgear together with a helmet. The face guard covers the whole face and is mounted to the helmet with hinged clips and screws on top and straps integrated with a chin cup on the sides. It may be lifted off the face by unlocking the straps. Examples include, but are not limited to Ice-hockey skaters, box lacrosse, hurling, baseball, lacrosse, field hockey.

4. Face masks comprising part of a headgear together with a helmet. The face guard is mounted stationary to the helmet with clips and screws, covers the whole face and includes a chin cup. An opening for viewing is provided proximate to the eyes. Examples include but are not limited to Football, baseball.

5. Face masks comprising part of a headgear together with a helmet. The face guard is mounted to the helmet with clips and screws and it covers the eyes and the upper part of the face. The jaw portion is not covered by the face mask. An example includes, but is not limited to Women's lacrosse.

6. Face masks (guards) attached to the head of the user. The face guard covers the whole face and comprises straps and paddings against the forehead and chin. An opening for viewing is provided proximate to the eyes. Examples include, but are not limited to softball, baseball umpire.

7. Eye ware (goggles) attached to the head. The goggles cover the eye portion of the face and comprise straps and paddings against the forehead and the cheekbones. Examples include but are not limited to women's lacrosse, field hockey.

DESCRIPTION OF RELATED ART

The main features of a good face mask are:

In the first place to give the necessary protection for the specific sport in question.

Distract the vision of the user as little as possible.

Have low weight for good comfort.

Provide comfortable fitting to the head of the user.

Provide low transfer of impact energy to the head of the user or to a helmet.

Provide firm connection to a helmet without impact strain.

Provide reliability and long life.

Provide good ventilation.

Provide little need for maintenance.

Provide attractive appearance.

Provide low manufacturing costs.

Metal wire masks

Metal wire face masks are the most widely used face masks because of their high strength, reliability and low need of maintenance. They are used in many sports such as ice-hockey, field hockey, street hockey, floor ball, cricket, baseball, softball, football, lacrosse, and hurling. The type of face mask used in each sport is a result of a long time evolution taking in account the required regulations, certifications or demands of the sport, and comprise part of headgear closely attached to a helmet or to the head of the user by straps. The headgear must be sized, used and maintained in accordance with provided safety regulations. The metal wire mask consists of a series of horizontal, vertical or diagonal wires fixed together forming a protective grid extending in the front of the user's face, eyes, jaw, throat or other nearby areas. The wires of the grid are fixed to a contour wire or a frame which gives rigidity to the mask and provides a boundary surface for helmets, pads, cushions, chin guards and attachment hard ware. Some wires of the mask can extend to a brim or visor of a helmet.

The material of the wires is typically some suitable grade of steel or titanium. The wires are normally manufactured by drawing or rolling feedstock to a desired cross-sectional shape in consecutive steps. In some special cases especially for thicker bars the bar can be milled or cut e.g. starting from a square solid bar to provide a more suitable cross-section. The shaped wires are bended to the desired longitudinal shape and after that joined to each other to form the protective grid and the frame. The joining method of the wires is normally resistance welding or TIG welding. The strength of a face mask depends on the strength of individual wires against direct blows by objects, on the strength of individual wires against impacts transferred from other wires and on the strength of the joints.

Masks With Elements Cut From Sheet Metal

Some rare attempts have been made to make whole face masks or elements for the grid portion of a face mask from sheet metal e.g. by laser cutting and die shaping. A more common way to use sheet metal elements is in combination with round wires as parts of the frame. The use of such elements may in some cases generate big losses of cut-off material and require extensive finishing of cut edges and eventual consecutive die shaping. A thin metal sheet is more vulnerable to breakage and other damage by impacts than wire is.

One example of a sheet metal element in the grid portion of the mask is the eye protector provided by U.S. Pat. No. 8,220,069 B2. Here sheet metal is used to create an element with the wider dimension in a direction of impacts to give strength in that direction, in combination with a small obstruction of vision. The difference between the thickness and width of the element is very big. Thus, the strength of the element drops and the obstruction of vision increases considerably even by a small deviations from the ideal orientation. Furthermore ideal orientations concerning vision and strength deviate, which is why these types of elements can be used only in positions very close to the eyes, which results in the viewing and impact directions being close to each other.

Cast Metal Masks

Metal masks can also be manufactured by one-piece casting as provided in U.S. Pat. No. 7,540,034 B2. Casting enables specific shapes in each part of the mask to give better lines of sight and low weight. However the production method has some limitations and downsides. The length of the casting channels is limited, which is why the mask must in most cases be cast from two or more pieces that must be welded together. The initial investment for molds etc. is high and extensive post treatment is required for a good finish after the casting process. There are also some limitations concerning the metal grades that can be used for casting. Because of these reasons cast metal masks have not become an actual option for wire face masks and are rarely or never used in any sports today.

Plastic and Rubber Masks

Other non-metal materials such as plastics, laminate composites or rubbers are suggested or used in some masks whenever it is convenient. Such masks are manufactured by means of molds and the masks consist of larger protective surfaces which are shaped according to the demands of the sport, the shape of the face and material properties. Attention must be paid to production and design requirements that are essentially different by the manufacturing of metal wire masks.

Because of the limited strength of plastics as compared to metals, these plastic materials can be used either in applications where the impact on the mask is low or where larger areas of the face can be covered by the mask without affecting the visibility or ventilation too much. Though modern plastics provide very high strength they lack the toughness and ductility of metals. A small fracture in a plastic mask caused e.g. by a sharp object can lead to a comprehensive breakdown of the mask with significant consequences and potential injury to the wearer. A metal mask on the other hand may dent or buckle but does not break down as easily by hard impact, which is why the risk of injury is much smaller.

Because of different manufacturing methods, design parameters and the limited applications, plastic and rubber masks belong to a group of products that is different from metal wire face masks. The production methods, wire shapes and other design considerations for plastic and metal masks are not comparable.

An example of a plastic mask is a softball fielder's mask. Here the speeds of the ball are lower compared to baseball, the ball is softer and bigger, allowing for bigger openings in the mask. Plastic full face shields are also used in field hockey by penalty corner situations, however not throughout the game because of impaired vision downwards and poor comfortability.

Another type of plastic mask has a transparent shield in parts where vision is important. An example is an ice-hockey skater's mask provided in U.S. Pat. No. 5,129,108. Here a plastic grid with high material thickness and small openings is used in the mouth region. The transparent shield is not suitable for protection against direct puck shots but rather is more suited against deflections, sticks or body contact. The mask has also some downsides concerning decreased visibility due to fogging, scratches and more maintenance which leads to shorter operating life.

Yet another example is a rubber face mask for football provided in U.S. Pat. No. 4,631,758. This mask is hardly suited for any other sport and provides a theoretical elastic protection against impacts caused primary by body contact. In this case vision is less important for the user, which is why thicker materials can be used without problems. Due to the elastic material, contacts against the face when there is an impact on the mask, are not fully excluded.

Properties of Metal Wires.

The wires of each face mask have specific demands concerning strength, thickness, weight, shape and formability to provide the features of a good face mask mentioned above.

The required strength of each individual wire depends on many things such as the intensity of possible impacts in each sport, the direction of impact, deflection angles of balls and pucks from the mask, the position of the wire in the mask, and the free length between the attachment points. The thickness of a wire influences the strength, weight, vision in the field of view and the appearance of the mask. A thick wire impairs the vision more than a thin or a flat wire. A low weight provides comfort and is an advantage for every mask.

The bending and forming properties of a wire depend partly on the thickness and material of the wire and moreover on the shape of the cross-section. Bending is a manufacturing process by which metal can be deformed by plastically deforming the material and changing its shape. The material is stressed beyond its yield strength but below its ultimate tensile strength to cause a permanent change of shape.

Metal wires are generally bended around one axis with methods such as die bending, rotary draw bending, three roll bending and stretch bending. The machines used for the bending range from simple hand operated machines to sophisticated bending robots. The desired wire shape is formed by applying force on the surface of the wire and taking in account proper confining, applicable minimum bending radius, spring-back compensation and metal properties such as ductility and micro-structure.

The cross-sectional shape of a wire has thus a big influence on the manufacturing procedures and on the face mask itself in relation to strength, weight, visibility, appearance, design of attachment hardware etc.

Round Wires

Round wires are by far the most commonly used metal wires in face masks because of the cheap raw material and the simplicity of the bending operations. Round wires are normally manufactured by drawing feed stock through a series of round drawing dies to produce the wanted diameter. Because of the symmetry of the cross-section the strength and the bending properties are the same in all directions. Round wires are a good solution when weight, visibility and some strength features are not fully optimized and aesthetics have lower priority.

The thickness of round wires in face masks is in the range of 2-7 mm. The dimensioning is made for an assumed maximum impact from the direction of the blow to protect the face. Therefore the thickness of the wire becomes bigger than necessary in other directions where the impacts are weaker, e.g. in vertical directions. This leads to an increased weight of the mask and in many cases a bigger obstruction of vision in the field of view.

When round wires are attached to each other or lean against the surface of a helmet the rounded cross-section provides only a narrow contact point or area in place of a flat contact surface which would be more advantageous in many ways as disclosed.

Aesthetically the wire has a conservative appearance because of its very common use.

Flattened Wires

Flattened or flat wires comprise an attempt to improve the vision or the strength in the direction of the blow compared with round wires. The cross-sections of prior art flat wires are close to rectangular or oval and always have a longer maximum dimension in one direction called the major axis and a shorter maximum dimension in a substantially perpendicular direction called the minor axis. Flat wires are normally manufactured by rolling round feed stock through a set of rolls having parallel axes. The shapes of the rolls are either flat or shaped to produce the wanted cross-section.

The strength of flat wires decreases gradually from its maximum in the direction of the major axis to a minimum in the direction of the minor axis. Because of this it is necessary to take in account these directions in relation to the direction of impacts on one hand, and the lines of vision on the other hand.

For a prior art flat wire the obstruction of vision is at its smallest when the major axis is diverging against the eyes of the user and comprises the maximum dimension in direction of the minor axis. If such a wire would be for example located horizontally some centimeters below eye level the optimal orientations of the major axis in relation to visibility would in this case be diagonally downwards. On the other hand the maximum impact strength is achieved when the major axis is diverging against the direction of impact, in most cases in the horizontal plane of the face mask. Because of this, the optimum orientations of vision and impact strength respectively deviate, which is why a compromise must be made normally in favor of the strength. If vision would be favored the wire should be bended in an off-axis position. The off-axis position means that the bending does not take place in the plane of the major axis, but in some other plane such as the horizontal plane of the face mask in this example. Off-axis bending of flat wires is a demanding and complex operation which may be accomplished only by specialist requiring expensive machinery and several process steps.

The cross-sectional shape of the prior art flat wires all include rounded surfaces, which is why they cannot be supported and confined against the bending tools properly in an off-axis position by conventional bending operations. Even if such bending operations could be accomplished the strength of the wire in the direction of the blow would become lower. There is therefore a need for flat wires that can be bended off-axis and furthermore have high strength in directions deviating from the direction of the maximum dimension.

If any symmetric prior art flat wire is viewed from a direction deviating from the direction of the major axis the obstruction of vision will gradually increase the bigger the deviation is. Practically, the ideal viewing angle in relation to the wire's major axis cannot be sustained because individuals have different eye positions in relation to the wires, and the position of the headgear and face mask can change from the ideal during the game. This means that the actual obstruction of vision is in many cases bigger than the ideal minimum obstruction. There is thus a need for flat wires that can be viewed from different angles without causing an increased obstruction of vision.

One example of this problematic prior art flat wires is shown for an ice hockey mask provided by patent Pub. no. US20070214537A1. According to the specifications and the figures the major axis of the wires is positioned differently in respect to best vision and best impact strength. As shown in FIG. 5 for instance the oval wire $\mathbf{16}_{11}$ is mounted with the major axis oriented horizontally, which position causes an increased obstruction of vision compared with the wires $\mathbf{16}_{9}$ and $\mathbf{16}_{10}$. The text (0031) points out that the major axis of a wire may be aligned with the line of sight of the wearer, though it is not always achievable because different wearers may have different lines of sight. Therefore according to the patent the wires are oriented such that their major axes generally converge against the approximate location of the eyes of the wearer. However in FIG. 5 the wire $\mathbf{16}_{11}$ has a horizontal orientation. In case the orientation would be modified to diverge against the eyes of the wearer the rigidity of the wire in the horizontal direction would decrease and the required bending operation would be off-axis. The optional wire cross-section of FIG. 8A would provide better sight lines compared with an oval within certain viewing angles but again off-line bending would be required. This would be even more challenging because the wire cannot be confined properly due to the rounded surfaces, and the asymmetry of the cross-section induces stresses causing the wire to twist. Therefore a compromise on cost of vision has been made for the orientation of the wires of the face mask of this patent.

Patent application US 20070266471A1 shows a face mask where the major axis of the oval or flat tubes are oriented perpendicular to the curved surface of the mask in order to minimize the obstruction of vision. As seen in the figures only the wires close to the eyes are flat tubes which are to be bended off-axis for best vision. In other parts of the mask such flat wires would cause the same strength, vision and extensive bending problems as described above.

In some cases it would be useful to bend a flat wire in the plane of the major axis with a very small radius to produce a sharp bend e.g. in the temple region of a contour wire. This would give a nice appearance without any welding joints between a horizontal and vertical contour wire to produce the sharp bend. The minimum bending radius of sharp bends highly depends on the maximum dimension of the major axis, the ductility of the metal and on the shape of the cross-section. For symmetric prior art wires the radius is normally at least twice the dimension of the major axis. If the radius is too small the wire will get fractured due to the tension on the outside of the bend. Because of the high required bending pressure in direction of the major axis it is necessary to confine and back up properly at least one of the contact areas between the wire and bending tool in order to avoid distortion. The prior art wires lack flat areas in these places, which is why there is a high risk for distortion.

Other Wire Shapes

Other shapes of wire cross-sections which are commonly used for larger steel constructions in other contexts may provide high strength/weight ratio and other constructional benefits for face masks as well. Such shapes are for example L-bars, U-bars and V-bars. However the bending of these shapes presents big problems in that stresses and strains are often set up within the material causing it to twist out of shape after the bending operation. Also the flanges of such profiles may fold in by the bending. This has highly limited the use of such profiles in the bended constructions of face masks.

Wide and flat contour wires would provide good aesthetics and good fit against helmets or paddings. However the bending of such wires in direction of the major axis is very difficult as described above and the minimum bending radius is very big. A thin wire also lacks strength in direction of the minor axis and is therefore subject to dents by impact.

Aesthetics

The cross-sectional shape of the face mask wires has a big influence on the appearance of the mask. For instance a round wire cage sticks out from the surface of a helmet and does not provide a uniform style of headgear. Wire surfaces can be colored monochromatic or patterned to create visual effects. However such effects are weak and become vague for round wires because they provide smaller surfaces than flat wires. A flat wire on the other hand has its limitations regarding strength and shaping. There is therefore a need for flat wires which are strong and can be bended to provide stylish headgear. With the prior art flat wires this may be possible only at the expense of reduced visibility and more weight on the mask.

Attaching Wires of a Face Guard.

When a face mask is manufactured to form the protective grid the wires are attached to each other either in intersecting or longitudinal positions. The normal methods for the attachment are resistance welding and TIG welding. The bended wires are assembled and locked on their places in a jig or form where-after the attachment points are welded either individually or at the same time with multiple welding electrodes. The process is time consuming and comprehensive engineering work and investments in materials are required for the production of jigs or forms.

When the wires of a face mask are welded in intersecting positions the cross joint will have a thickness close to the combined thickness of each wire which will influence the appearance of the grid. The strength of the joint is solely dependent on the weld because the welded surfaces or points are not backed up by each other. By notching the intersecting points it would be possible to create strong and clean-cut joints having a thickness close to the individual wires. However for prior art wires this is not possible without a considerable reduction of the cross-sectional area due to the notch, which can lead to a weak point of the wire grid. There is a need for wires which can be notched by removing only a small portion of the cross-sectional area.

If wires are attached to each other longitudinally they form stronger double bars or double bar lengths which can branch to form two single wires. The prior art wires have cross-sections with roundings on at least two opposite sides. The parallel attachment of two rounded sides or a rounded side to a flat side requires comprehensive and visible TIG weldings which normally demands the use of filler material. This is because the surfaces to be welded provide only a thin connection strip which must be backed up by welds to get a strong joint. The contact area between the wires is thus much smaller compared to an area between two flat surfaces. A comprehensive welding has a negative influence on the aesthetics of double wires and it increases the heat input to the metal. Excessive heat input decreases the strength and hardness of most used metal grades, such as stainless steels and titanium, which are work hardened by the manufacturing of the wire. There is a need for wires with longitudinal flat surfaces to provide contact area and backing of the joint, and to make the welding area more accessible resulting in less comprehensive and unnoticeable weldings.

Because wires with rounded surfaces lack contact area other bonding methods such as chemical bonding, laser welding or brazing are not applicable. For wires with flat surfaces this is not a problem and is therefore an option for welding for instance in cases when the wire cannot be heated (chemical bonding) or due to aesthetic reasons.

In some prior art face masks two round or flattened wires have been attached to each other longitudinally to form a double bar that provides more strength in critical points of the mask. Such examples are the vertical double center bar of a hockey goalie mask and the horizontal double bars of baseball catcher's mask. Though a double bar provides higher strength in vulnerable places of the mask the field of view is normally obstructed by the combined width of the bars.

Because of the cross-sectional shape of the prior art wires the only way to reduce the obstruction of a double wire is to install the wires fully or partly behind each other in the line of sight. This can be done either by attaching the wires to each other directly or indirectly with a small distance between as provided in US Patent 20130312165A1. However this solution requires additional crossing support wires and more welding work. Also the supporting wires give more weight to the mask. Furthermore the obstruction of vision increases considerably if the viewing angle deviates from the ideal viewing direction, which is very often the case as mentioned earlier. There is therefore a need for double bars that cause a smaller obstruction of vision.

In some examples of prior art face masks for ice-hockey goalies a vertical double bar in the middle of the mask branches in its upper part to form two single wires whereupon the branches extend to the contour wire where they are welded. The reason is to distribute an impact from the double bar to the contour wire on two adjacent points in place of one point. It would be advantageous, in certain conditions to avoid the welds between the branches and the contour wire by extending the branched wires to form the contour wire of the mask. However the prior art wires are not well suited for this purpose because they cannot provide a combination of properties required for the double bar, the frame and the overall strength of the mask.

Contour Wires and Attachment to Helmets

Contour wires provide rigidity to the mask and attachment points for the wires of the grid portion that protects the face of the user. The contour wire is shaped to ensure a tight fit against a helmet or a comfortable fit against the face of the user. Paddings, mounting hardware for helmets, straps and chin guards are attached to the contour wire directly, or to elements which are welded to the contour wire. Round wires are mostly used as contour wires because of the straight forward bending operations which can be automatized, and the cheap raw material.

A very important feature of a contour wire is to provide strength, not only against direct impact but also against indirect impact from wires of the grid portion which are welded to the contour wire. It is a well known fact that a great number of dents and break downs of ice-hockey masks occur in the lateral and upper parts of the round contour wires and joints where wires from the grid portion have been welded. Disconnected joints and dents on the contour wire from the direction of the wires of the grid portion have been the result. There is therefore a need for contour wires with higher strength against impacts from the direction of the grid wires in combination with sufficient strength against direct horizontal impact by objects.

Round contour wires provide poor backing surfaces for a stationary fit of the face mask to the flat surface of a helmet. The contact area is narrow, which is why high impacts are concentrated on small areas of the helmet. Some attempts have been made to shape the surface of helmets after the round shape of the wire which may not bring any big advantages in relation to higher manufacturing costs. When the face mask is not backed up by the helmet the mounting elements of the face guard will be subject to high strain due to the powerful movements of the face guard. It is common to get cracks and other damages on helmets on the points where the face guard touches the helmet, around the screw holes of the mountings or on places with high tension.

The edges of a helmet are more vulnerable than other parts, which is why the prior art face masks of headgear are dimensioned to overlap the edges with a few centimeters in order to avoid impacts on the edges. Another reason is the risk for the mask to slip over the edge and against the face by impact, for example due to loose or broken attachment hardware or deformations of the mask. On the other hand if the mask could be attached in a reliable stationary way along the edge of the helmet the situation could be helped and furthermore overall size and weight of the face mask could be reduced as disclosed.

Sometimes holes are drilled by the user afterwards in helmets by replacement of the face mask which is not permissible because the mechanical properties of the plastic helmet material get weaker. This can happen also due to impacts, high temperatures or general aging. Therefore there is a need for attachment systems of face masks to helmets where as few drilled holes as possible are required and the face guard is backed up by the helmet causing less strains on weak points of the helmet by impact.

Another headgear problem is the transfer of impact energy from the face mask to a helmet and further to the head of the user. In some sports high impacts can cause so called ringing in the ears, other unpleasant sensations and in the worst case injuries for the user. There is thus a need for improved engagement of the face guard to the helmet, for larger distribution of impact on the surface of the helmet, and for efficient and simple impact absorption systems between the face mask and helmet.

In some prior art face masks attempts have been made to transfer less impact energy from the contour wire of the face guard to the helmet (and further to the head of the user). One example is the Bauer Concept C2 Certified Cat Eye Goalie Mask™ where the round contour wire has been overlaid by elastic tubing in order to absorb some of the impact energy and to create more friction for a stationary fit between the mask and helmet. The system is simple and cost efficient but not very efficient because the impact energy will be concentrated on a narrow area of the tubing. The wall of the relatively thin tubing is easily compressed to its minimum thickness in the contact point, and the excessive impact energy transfers to the helmet. The absorption of impact energy is incomplete.

In other solutions to absorb impact energy from the face guard to a helmet the clips for the attachment of the mask to the helmet have been modified. Rubber washers are commonly used around screw holes for instance. More efficient developments of energy absorbing mountings and clips are provided in US Patents 20080163410 A1 and U.S. Pat. No. 4,633,531 A. These solutions require specially manufactured complex parts and components which may lead to higher manufacturing costs, more maintenance and higher risks for malfunctioning.

Round wires are also commonly used in face guards in combination with helmets having a brim or a visor integrated to the helmet. Such examples are helmets for baseball batters (brim), cricket batsmen (peak) and lacrosse players (visor). For instance in cricket the face guard does not extend to the peak of the helmet, which has caused severe facial injuries when the ball has penetrated the gap between the peak and the face guard. A study made by the Loughborough University in 2013, ISSN: 2235-3151 makes the conclusion that current cricket helmets may require a design change to eliminate such injuries.

As a result of these problems the gap between the peak and the horizontal bar below eye level is normally kept far below the diameter of the ball. However the field of vision is restricted by a smaller gap. A good vision is essential for a good performance both in cricket and baseball.

For helmets where the brim is reinforced by wires of the face mask there is a risk for cracks on the brim or helmet caused by poor engagement of the mask to the brim and helmet. To solve these problems a close coupled mutual attachment of the face mask to the brim is provided in U.S. Pat. No. 4,933,993. The attachment to the brim is done with two clips with screws and screw holes in the brim. By impact, high shear forces will be concentrated to these attachment points, which is not ideal for the durability of the brim. The bars directly under the brim above eye level obstruct the view of the user considerably. The clips and screws are located on a very distinguishable place on the brim affecting the appearance negatively.

U.S. Pat. No. 5,477,565 A provides a face guard with a protective bar along the edge of the brim. The bar and the brim are engaged with a clip without screws. For a firm fastening of the clip the edge of the brim is bulged which is not always the case if the face guard is mounted onto an existing helmet for instance. By impact high shear forces will be concentrated to the location of the clip and to the screw holes of the other attachment clips.

Yet another solution to strengthen the brim without obstructing the vision is provided in US patent 20070250990 A1. This is done by means of two reinforcement members on both sides of the brim. This construction reinforces the center of the brim and prevents deflection in that part only. However other parts such as the sides of the brim and the area where the face mask is attached to the helmet are not reinforced and subject to weakening of the helmet material due to temperature, impacts or aging.

US Patent application 20130312166 A1 provides a cricket helmet with a peak portion capable of being deflected and blocking balls which are deflected from two horizontal bars towards the peak and having a secure attachment of the face guard. It is always a downside to have moving parts in any equipment because of maintenance, wear, unreliability and costs. All parts of the mechanism must be dimensioned for high impact, which is why the size cannot be very small and indistinguishable. The gap between the peak and the face guard must be small enough for the ball to cause the distal peak portion to deflect why it is not obvious that a larger gap can be used.

There is thus a need for a reliable, strong and aesthetically appealing way to provide reinforcement of a brim of a sports type helmet to prevent the penetration of ball between the brim and the face guard and to provide a viewing opening that is as wide as possible and also proximate to the eyes.

Face Guards Attached to the Head.

Face masks which are worn directly against the face of the user have paddings of some elastic material in the areas which are in contact with the face of the user. If the padding is fixed to a prior art round contour wire the fixation is poor or not stable due to rotational immobility. For round wires the transfer of impact through the padding to the face is concentrated on a narrow area, thus demanding thicker paddings in order not to cause pain or injuries to the user. To overcome these problems specially formed elements of sheet metal providing more impact surface and better attachment of paddings are commonly welded to the round wires. However the use of such elements requires additional parts, more welding work, increases the weight of the mask and has in many cases a negative influence on the appearance of the mask. There is therefore a need for simple, comfortable, detachable and aesthetically appealing face mask and padding systems providing good energy absorption.

In the baseball mask of U.S. Pat. No. 6,499,139 B1 brow and chin pads are fixed to round contour bars. The brow pad is coupled to the bar with an adhesive. The chin pad is attached and backed up by a chin guard which consists of sheet metal and is attached to two round bars with several welding points for a rigid and strong construction. This mask shows most of the downsides mentioned earlier.

A slightly improved example with sheet metal parts in the brow area is the softball mask of US Patent Publication No. 20120210482 A1. The padding is attached with an adhesive or by a loop and hook type fastening means to the sheet metal plate which has been welded to the contour wire over the whole brow area.

In other sports such as women's lacrosse and field hockey, goggles with paddings are commonly used to protect the eyes and part of the face. An example of such a brand is Cascade™ Mini Pro. In these eye protectors, the round contour wires are embedded in a soft elastomer padding. The padding surrounds the eyes and provides a comfortable fit and an impact absorbing buffer between the protector and the face. Because of the round cross-section of the contour wire, adhesives are used for a safe attachment of the padding, and the thickness of the padding is extensive to absorb shocks over the narrow impact area of the round wire.

Some eye protectors provide a way for the separation of the metal parts and the padding in order to provide replacement of the parts. An example is shown in U.S. Pat. No. 7,987,517 B2 where a flat extension has been welded to the round wire to provide engagement to a grooved opening in the padding and to enable a detachable system.

Yet another example where paddings are attached to multiple contour wires and wires of the grid portion is the traditional baseball umpire mask, such as Wilson Dyna Lite Titanium™. Because the wires are rounded and the possible impacts are high the thickness of the paddings is extensive. This has a negative influence on the comfort of the mask because the center of mass is a distance away from the face. Hollow tubes and lightweight metals are used to reduce the weight of the mask. The outside diameter of the tubes is bigger compared to solid wires and the number of protective tubes is big which has a negative influence on vision.

The Terminology

The term "face mask" of the disclosed embodiments may also be referred to as a "face protection grill", "face guard", "cage", "grill", "mask" or "goggles".

The terms "wire" and "bar" mean lengthy face protection grill elements, members or organs that are used to form a generally lattice type face protection grill. The term "bar" is generally used for thicker elements, members or organs. In the figures the cross-sections are drawn as solid members, however they can be hollow as well.

The term "wedge wire" is a descriptive term used to describe all wires having a cross-sectional shape according to the aspects of the disclosed embodiments.

The term "contour wire" is a term for a wire which comprises the outer rim or parts of the outer rim of the face mask.

The "grid", "grid portion" or "grill portion" are terms for the part of the face mask which comprises the part of the face mask that protects the face or parts of the face of the user, in contrast to contour wires.

The terms "padding", "pad" and elastomer profile are terms for synthetic shock absorbing materials used in conjunction with face masks to provide cushioning and shock absorption on the boundary surfaces between face masks and user faces and helmets.

The terms "impact strength", "strength", "rigidity" and "stiffness" of a wire means the ability to withstand impact without permanent deformation.

The terms "wire surface", "part of wire surface" or "wire surface portion" refer to longitudinal surface sections of the wires which are presented in the FIGS of the cross-sections as two dimensional shaped lines, for instance between defined points.

The terms "flat" or "substantially flat" wire portion refer to flat or almost flat longitudinal surface portions or sections which have taken shape as a result of a direct contact with forming tools such as rolls, dies, cutters, grinders or cutting medium. This is in contrast to surfaces such as naturally rounded edges which have no direct contact with tools when taken shape.

SUMMARY

The aspects of the disclosed embodiments provides face guards designed for multiple sports made of bended metal wires which are joined together, where at least one of the wires or part of a wire of the mask is a so called wedge wire, characterized by certain features of the cross-sectional shape in relation to its flatness, tapered surface portion and flat surface portions. All these features are present in combination in order to achieve all the benefits of the wedge wire. The interior of the wedge wire can be solid or hollow.

The aspects of the disclosed embodiments also provide face guards configured for multiple sports and is made of bended metal wires which are joined together where at least one of the wires of the mask is a wedge wire incorporating aspects as described herein. The wedge wire of the disclosed embodiments provides larger surfaces to provide new aesthetics and to enable snazzier coloring of the wire.

The aspects of the disclosed embodiments also provides face guards configured for a helmet and is made of bended metal wires which are joined together, where at least one of the wires of the mask is a wedge wire as described herein with a fixed or disposable padding attached to it and leaning against the helmet when the mask is attached to the helmet in usage position. The mask of this embodiment provides a good impact absorption from the mask to the helmet.

The aspects of the disclosed embodiments also provides face guards, also referred to as face masks, configured for multiple sports and is made of bended metal wires which are joined together where at least two crossing wires of the mask are wedge wires and joined to form a joint. The wedge wires are notched at the crossing joint before joining to provide a firm and aesthetically appealing joint.

The aspects of the disclosed embodiments also provides face guards configured for multiple sports and is made of bended metal wires which are joined together where at least two of the wires of the mask are wedge wires that are attached to each other longitudinally to form a substantially rectangular double bar, providing high impact strength and a small obstruction of vision.

The aspects of the disclosed embodiments also provides face guards configured for multiple sports and is made of bended metal wires which are joined together where at least two of the wires of the face guards are wedge wires and form a vertical double wire in the center of the mask. The double wire may be branched in one or both ends. The double wire has a substantially triangular or V-shaped cross-section and may include an additional support wire. The face guards provides high impact strength, a small obstruction of vision and new aesthetics.

The aspects of the disclosed embodiments also provides face guards configured for multiple sports and is made of bended metal wires which are joined together where at least one of the wires of the face guards is a wedge wire which comprises a contour wire or part of a contour wire and an integrated vertical double wire in the center of the mask. The double wire has a substantially triangular or V-shaped cross-section and may be backed up by an additional support wire. The face guards provides less welding works, high impact strength, a small obstruction of vision and new aesthetics.

The aspects of the disclosed embodiments also provides face guards configured for multiple sports and is made of bended metal wires which are joined together where at least one of the wires of the face guards is a wedge wire and is fully or partly attached longitudinally to another wedge wire or a flat plate profile to form a double wire portion with an L-shaped or T-shaped cross-section. The double wire portion provides very high strength/weight ratio.

The aspects of the disclosed embodiments also provides face guards configured for a helmet including a face opening and is made of bended metal wires which are joined together where at least one of the wires of the face guards is a wedge wire and is fully or partly attached to another wedge wire, a plate or an L-profile to form a double wire portion with L-shaped or U-shaped cross-section. The double wire portion provides a firm and confined connection of the face guards to a face opening of the helmet. Elastomer profiles can be installed between the face guards and the helmet as well as reinforcement profiles to strengthen the edge of the helmet. The face guard provides considerably smaller size and weight, better fixation of the face guards to the helmet, improved impact absorption and new aesthetics.

The aspects of the disclosed embodiments also provides face guards configured to be attached to a baseball or cricket helmet having a brim and is made of bended metal wires which are joined together where at least one of the wires of the face guards is a wedge wire and is fully or partly attached to another wedge wire or plate to form a double wire portion with L-shaped cross-section. The L-shaped double wire portion is attached to the brim. Further in one embodiment of the aspects of the disclosed embodiments the brim has a shaped groove to fit the L-bar. The face guards provides a strong, confined and aesthetic protection of the brim and prevents a ball from penetrating the opening between the brim and the face guard.

The aspects of the disclosed embodiments also provides a two step manufacturing method for the production of strong L-, U- or T-shaped profiles for face guards of multiple sports from two individual wires of any cross-section. The first step comprises the bending of the individual wires and the second step comprises the attachment of the wires or parts of the wires longitudinally to form the sought cross-sectional shape.

The aspects of the disclosed embodiments also provides face guards or goggles configured with paddings for sports such as baseball, softball, lacrosse, field hockey or cricket and are made of bended metal wires which are joined together, where at least one of the wires is a wedge wire with a fixed or disposable padding attached to it. The padding is leaning against some parts of the user's face, such as the forehead or the chin, when the face guard is in a usage position. The face guard provides simple and firm attachment of the padding to the face guard and good absorption and distribution of impacts.

The aspects of the disclosed embodiments also provides face guards or goggles configured with paddings for sports such as baseball, softball, lacrosse, field hockey and cricket and is made of metal wires which are joined together where at least one of the wires of the face guard is a wedge wire and its base is fully or partly attached to the base of another wedge wire or plate to form a wide double wire. A fixed or disposable padding is attached to the wide double wire. The padding is leaning against the face, such as the forehead or the chin, when the face guard is in usage position. The face guard provides simple and firm attachment of the padding to the face guard, good absorption and distribution of impacts and new aesthetics.

BRIEF DESCRIPTION OF THE DRAWINGS

The figures are not drawn in scale and some details of a drawing may be drawn in different scales than other parts in order to better illustrate the aspects of the disclosed embodiments.

FIG. 1*a* is a cross-sectional view of a prior art round wire and a wire drawing die.

FIG. 1*b* is a cross-sectional view of a prior art oval wire and a pair of profiling rolls.

FIG. 1*c* is a cross-sectional view of a prior art flattened rectangular wire with naturally-rounded edges and a pair of profiling rolls.

FIG. 1*d* is a cross-sectional view of a prior art I-shaped wire with naturally rounded edges and a pair of profiling rolls.

FIG. 2*a* is a cross-sectional view of a one axis symmetric tapered wire and a pair of profiling rolls.

FIG. 2*b* is a cross-sectional view of an asymmetric tapered wire and 3 profiling rolls.

FIG. 2*c* is a cross-sectional view of a one axis symmetric wire with a naturally-rounded edge and 3 profiling rolls.

FIG. 2*d* is a cross-sectional view of a one axis symmetric wire and 4 profiling rolls.

DETAILED DESCRIPTION

Figure 1A:
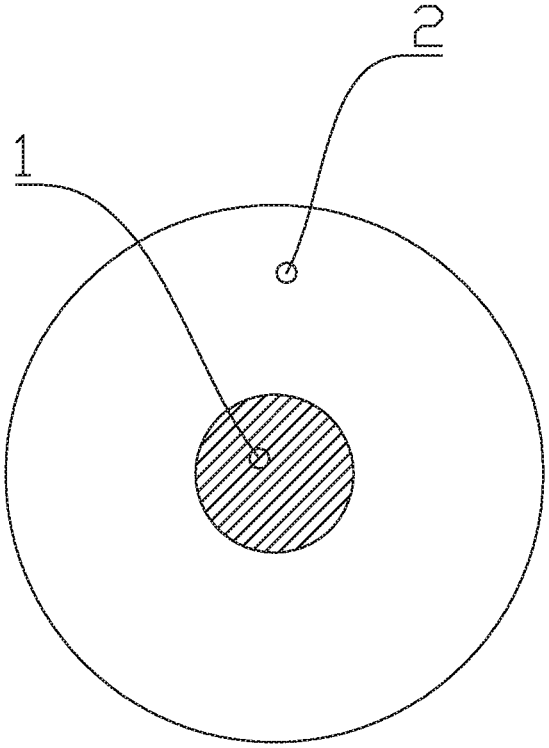
FIG 1a PRIOR ART
FIGS. 1*a*-1*d* are cross-sectional views of different applied prior art wires with examples of tools used for profiling the cross-section.

The aspects of the disclosed embodiments are directed to a wedge wire or wires that are used to form the face guard or face mask for a sports headgear or eye protection gear.

Referring to FIGS. 3*a*-3*e*, one embodiment of a cross-section of a wire 100 incorporating aspects of the disclosed embodiments is illustrated. The wire 100 of the disclosed embodiments may also be referred to as a "wedge wire." In this example, the cross-section of the wire 100 has its maximum dimension L1 in a direction x, which is called the major axis. In this embodiment, L1 has a dimension of approximately 2 to and including 15 mm. The cross-section has a second maximum dimension L2 in a direction y perpendicular to the direction x, which is called the minor axis, having a dimension of approximately 1.5 to an including 5 mm. The dimension L1 is bigger than the dimension L2. A ratio L1/L2 of approximately 1.2-1.4 has been found advantageous in certain embodiments of the aspects of the disclosed embodiments, for example when the wedge wire is subject to very high impact from several directions. A ratio L1/L2 of approximately 1.5-2.1 has been found particularly advantageous for most embodiments of the aspects of the disclosed embodiments. A ratio L1/L2 of more than 2.1 has been found advantageous for certain embodiments of the aspects of the disclosed embodiments, for example when the dimension L2 is smaller than 2 mm.

The second feature of the wedge wire 100 of the disclosed embodiments is the one-axis symmetric or asymmetric tapered shape. This shape provides the benefits of a constant or only slightly increased obstruction of vision within certain viewing angles deviating from the major axis, constant strength within broader impact angles, bending of the wire with a small radius and less bending force in direction of the major axis, customized strength in different directions to provide improved strength/weight ratios, the making of double wires with smaller obstruction of vision, notched crossing joints, and new aesthetics. The tapered shape can be specified as follows:

Referring to FIGS. 3*a*-3*e*, a surface of the wedge wire 100 can be divided into two surface portions, generally shown as surface portion S1 and surface portion S2. The surface portions S1 and S2 border at the measuring points a and b of the second maximum dimension L2. The surface portion S1 comprises the wedge and is longer in the direction of the y axis than the surface portion S2 which comprises the base. For cross-sections with partly parallel side portions in direction of the major axis there are multiple points a and b and hereby the surface portion S1 comprises the surface having the largest width in direction of the y axis. The surface portion or wedge S1 comprises two long sides which are united to form a tip, and the overall shape consists of straight, rounded and bevelled shapes in any combination. The base S2 comprises straight, rounded and bevelled shapes in any combination.

To further stipulate and also referring to FIGS. 3*f*-3*k*, the tapered shape of the cross-sectional area can be split in two part areas A1 and A2 by an imaginary straight line in the direction as the y axis which is crossing the center point of the major dimension L1. Thus both part areas have a width equal to L1/2 and the cross-sectional area A1 is smaller than A2 because of the tapered shape of the wedge. Since L2 comprises the maximum dimension in the direction of the y axis, any other dimensions in direction of the y axis will be smaller than L2 thus providing the tapered shape of the cross-section.

The third feature of the wedge wire is the presence of one or more substantially flat surface portions. The flat portions provide the benefits of backing and confining the wire by demanding bending operations in the direction of the major axis, large and flat contact surfaces for the attachment of wires to each other and other elements in a strong and aesthetically appealing manner, more contact surface against paddings, helmets or brims for better impact distribution and immobility of the interface area.

The presence of substantially flat surfaces can be specified as follows: A substantially flat surface has a width or straightened width of at least 1.5 mm. A concave surface (indicated in dot lines in FIG. 3*a*) of the same straightened width can provide some of the benefits of a flat surface, such as the ease of bending and the improved attachment of the wires. When applicable, larger widths, such as 2 mm or 3 mm can be used to strengthen the wire and improve the benefits. To accomplish demanding bending operations in directions proximate to the major axis there must be a flat surface portion in the base surface S2. Such bendings are to variable extent required for every wire of a face mask, which is why at least one flat surface portion must be present in the base.

The manufacturing of metal face mask wires normally takes place by forwarding the feedstock through a single or series of drawing dies or rolls to produce the desired cross-sectional shape. The number of drawing or rolling steps is set by the required deformation which is limited for each step and depends on the material, temperature, type of tooling etc. Sometimes the manufacturing can involve additional manufacturing steps such as cutting or milling to produce the wanted cross-sectional shape. Wires with hollow interior may be manufactured for some special applications from metal tubes or plates for instance by die pressing.

Figure 1B:
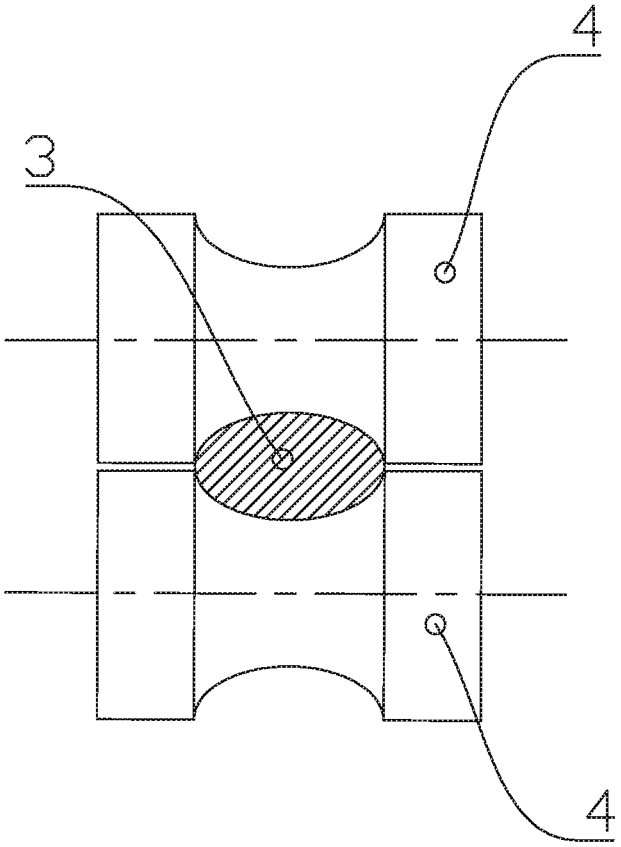
FIG 1b PRIOR ART
Figure 1C:
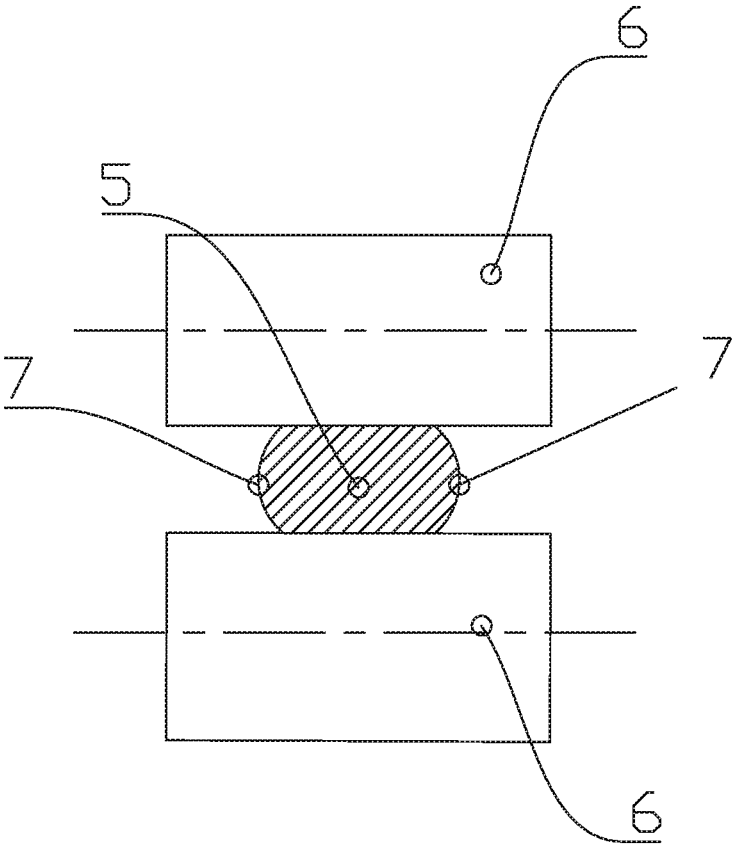
FIG 1c PRIOR ART
Figure 1D:
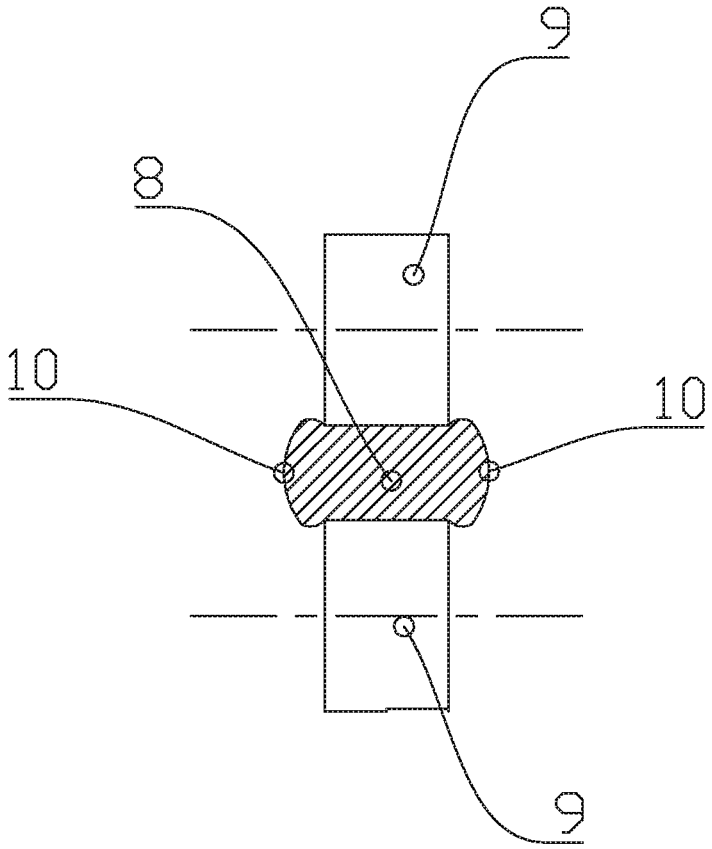
FIG 1d PRIOR ART

FIGS. 1*a*-1*d* show prior art metal wires which are used for face masks today, including examples of suitable manufacturing tools. The tools provide cross-sections with one or two axis symmetry. FIGS. 1*a* and 1*b* show cross-sections with shaped roundings and FIGS. 1*c*-1*d* show naturally rounded edges, by contrast to rolled crown or square edges.

FIG. 1*a* shows a wire 1 with a round cross-section manufactured by pulling feed stock through a drawing die 2.

FIG. 1*b* shows a wire 3 with an oval cross-section manufactured by forwarding feed stock through a pair of identical grooved rolls 4. All sides of the oval wire are rounded.

FIG. 1*c* shows a wire 5 with a rectangular flattened cross-section manufactured by forwarding feed stock through a pair of cylindrical rolls 6 which are wider than the wire. The produced edges 7 have a natural rounding having an approximated radius greater than half the thickness of the wire which is known for a person skilled in the art.

FIG. 1*d* shows a wire 8 with a flattened cross-section resembling an I-bar, manufactured by forwarding feed stock through a pair of identical cylindrical rolls 9 which are narrower than the wire. The produced edges 10 have a natural rounding comprising an arc with a width which is greater than the thickness of the wire portion which is pressed by the rolls. The approximated radius of the arc is greater than half the thickness of the wire.

Figure 1E:
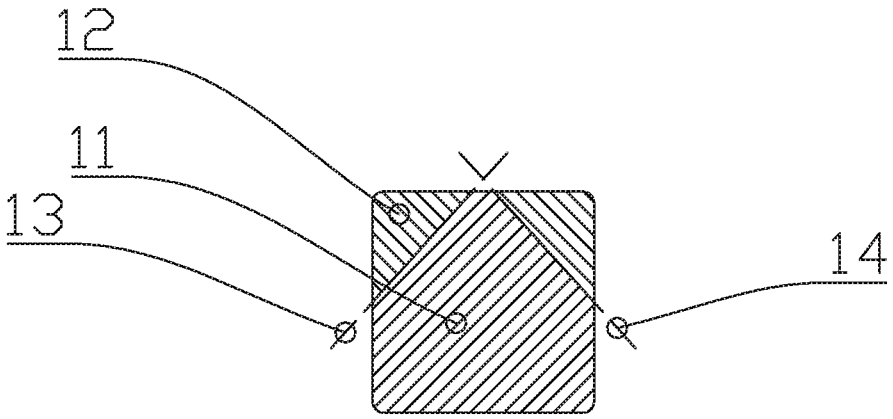
FIG 1e PRIOR ART
FIG. 1*e* is a cross-sectional view of a prior art wire machined from a square profile.

FIG. 1*e* shows a prior art wire 11 which is manufactured from a standard solid square bar by cutting or grinding off material 12 along the lines 13 and 14 to produce a one axis symmetric bar for special purposes, such as ice-hockey goalie masks as disclosed.

FIGS. 2*a*-2*e* are examples of wires according to the aspects of the disclosed embodiments, so called wedge wires, showing examples of suitable manufacturing tools or methods. To achieve the required structural features of the wedge wire in relation to flatness, tapered portion and flat base portion, the manufacturing tools must be different compared to the prior art wires. The corners and edges of the cross-sectional shape may be rounded or sharp depending on how many consecutive rolling steps are provided.

Figure 2A:
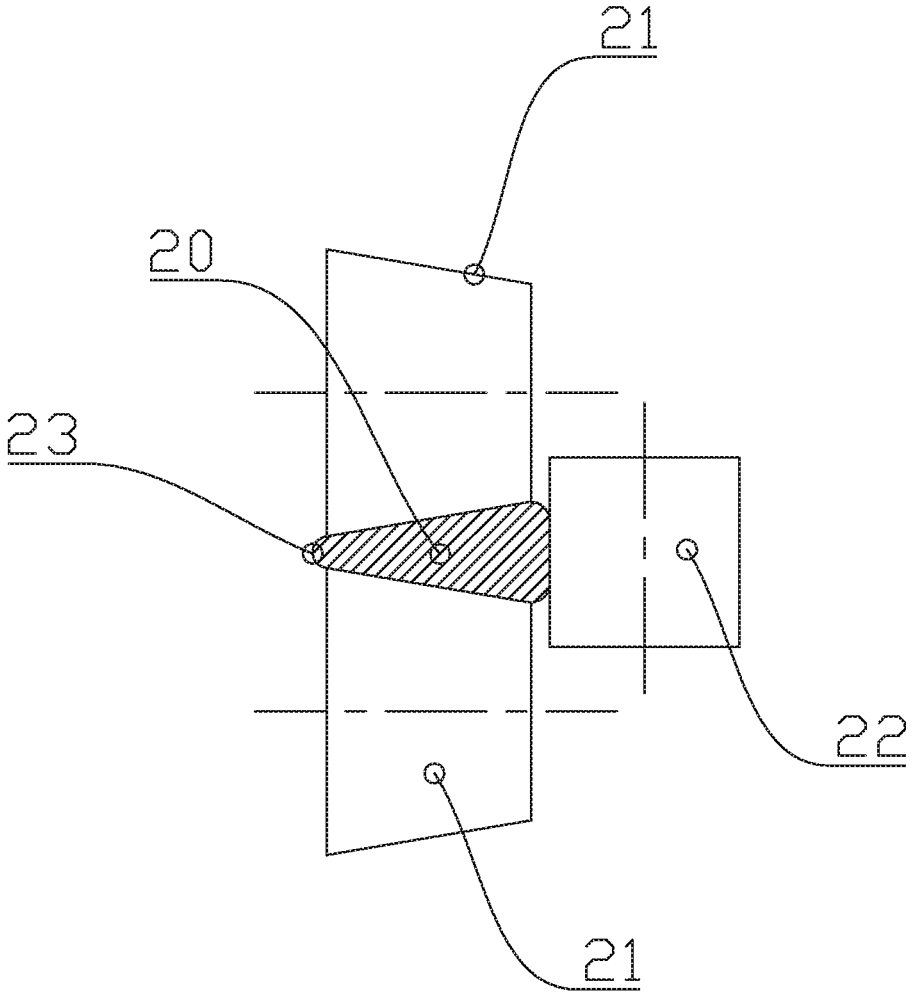
FIG. 2*a*-2*d* are cross-sectional views of wires shaped according to the aspects of the disclosed embodiments (=wedge wires) with examples of tools used for profiling the cross-section.

FIG. 2*a* shows an exemplary wedge wire 20 incorporating aspects of the disclosed embodiments. In this example, the wedge wire 20 has a one axis symmetric cross-section, which is manufactured by forwarding feed stock through a pair of identical tapered rolls 21 of a suitable machine. A third roll 22 produces the flat portion of the base. The produced edge 23 has a natural rounding.

Figure 2B:
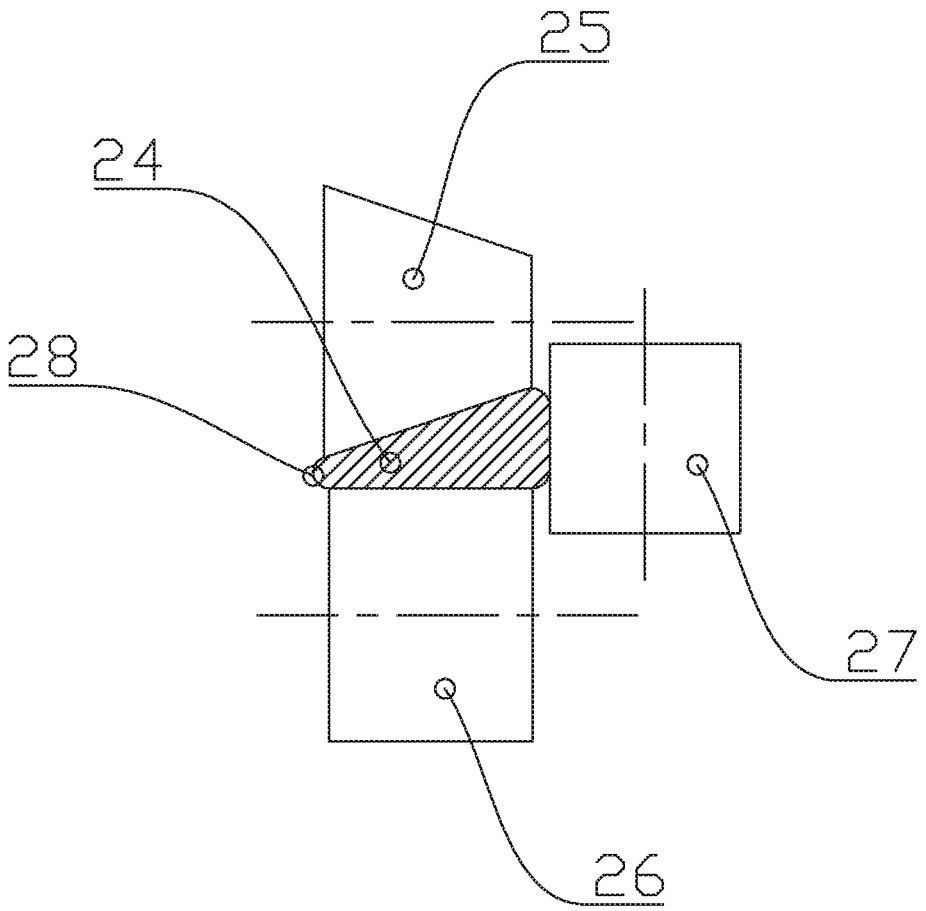

FIG. 2*b* shows an exemplary wedge wire 24 incorporating aspects of the disclosed embodiments with an asymmetric cross-section manufactured by forwarding feed stock through a pair of different tapered rolls 25 and 26. A third roll 27 produces the flat portion of the base. The produced edge 28 has a natural rounding.

Figure 2C:
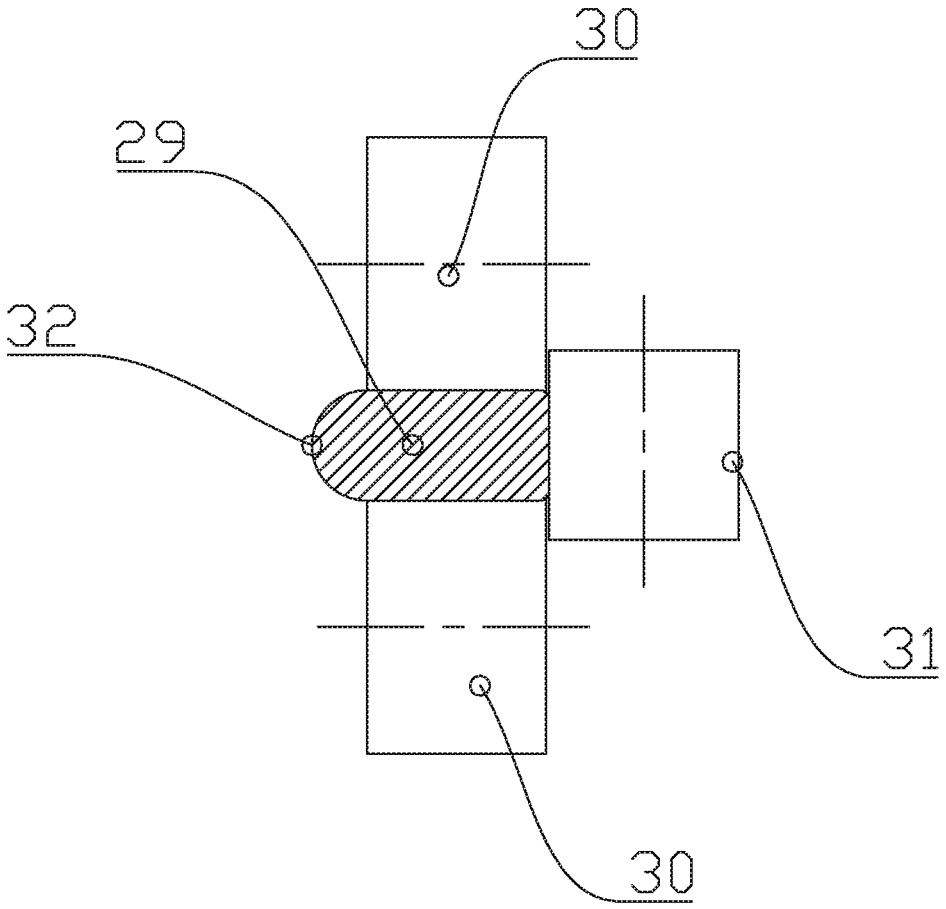

FIG. 2*c* shows an example of a wedge wire 29 incorporating aspects of the disclosed embodiments with a one axis asymmetric cross-section manufactured by forwarding feed stock through a pair of identical cylindrical rolls 30. A third roll 31 produces the flat portion of the base. The produced wide edge 32 has a natural rounding providing the tapered portion.

Figure 2D:
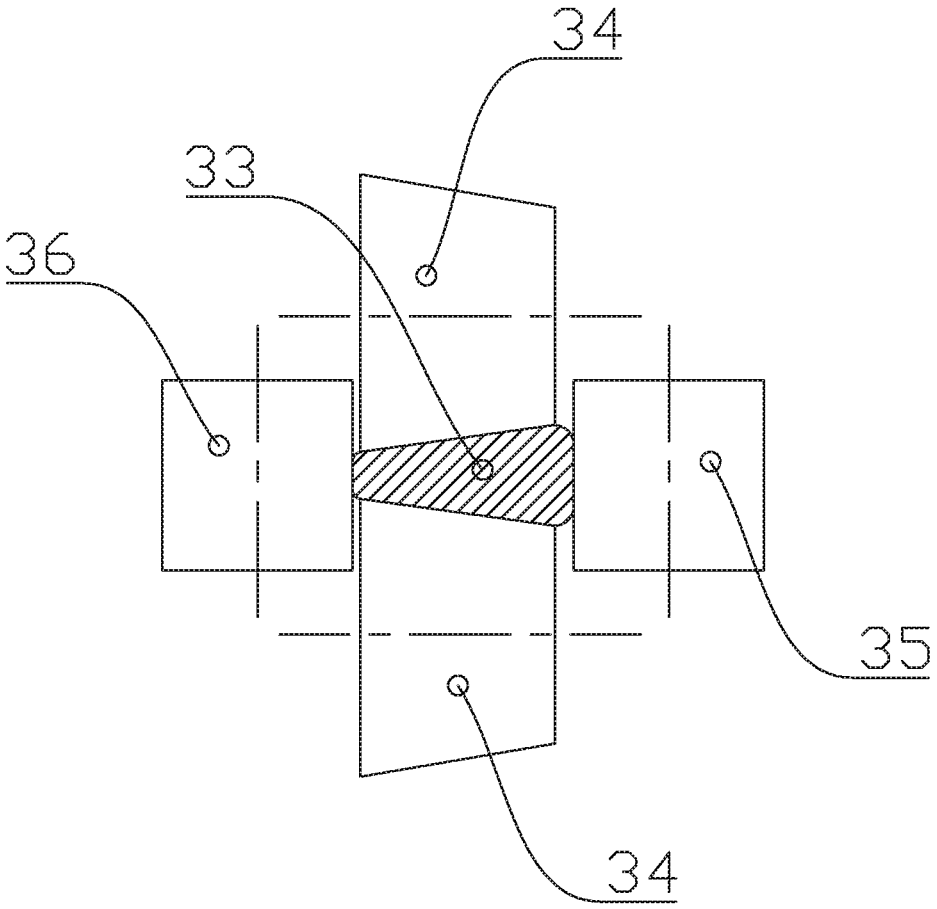

FIG. 2*d* shows an example of a wedge wire 33 incorporating aspects of the disclosed embodiments with a one axis symmetric cross-section manufactured by forwarding feed stock through a pair of identical tapered rolls 34. A third roll 35 produces the flat portion of the base and a fourth roll 36 on the opposite side provides a flat tip portion.

Figure 2E:
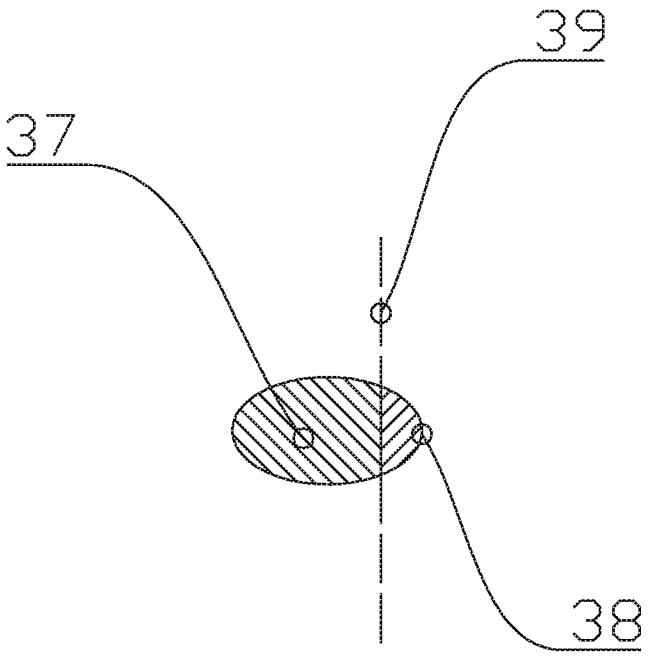
FIG. 2*e* is a cross-sectional view of a one axis symmetric wire machined from an oval wire.

FIG. 2*e* shows an optional way of providing a flat base. An oval wire 38 is machined or cut along the line 39 whereby the material 38 is removed producing the flat base.

Figure 3A:
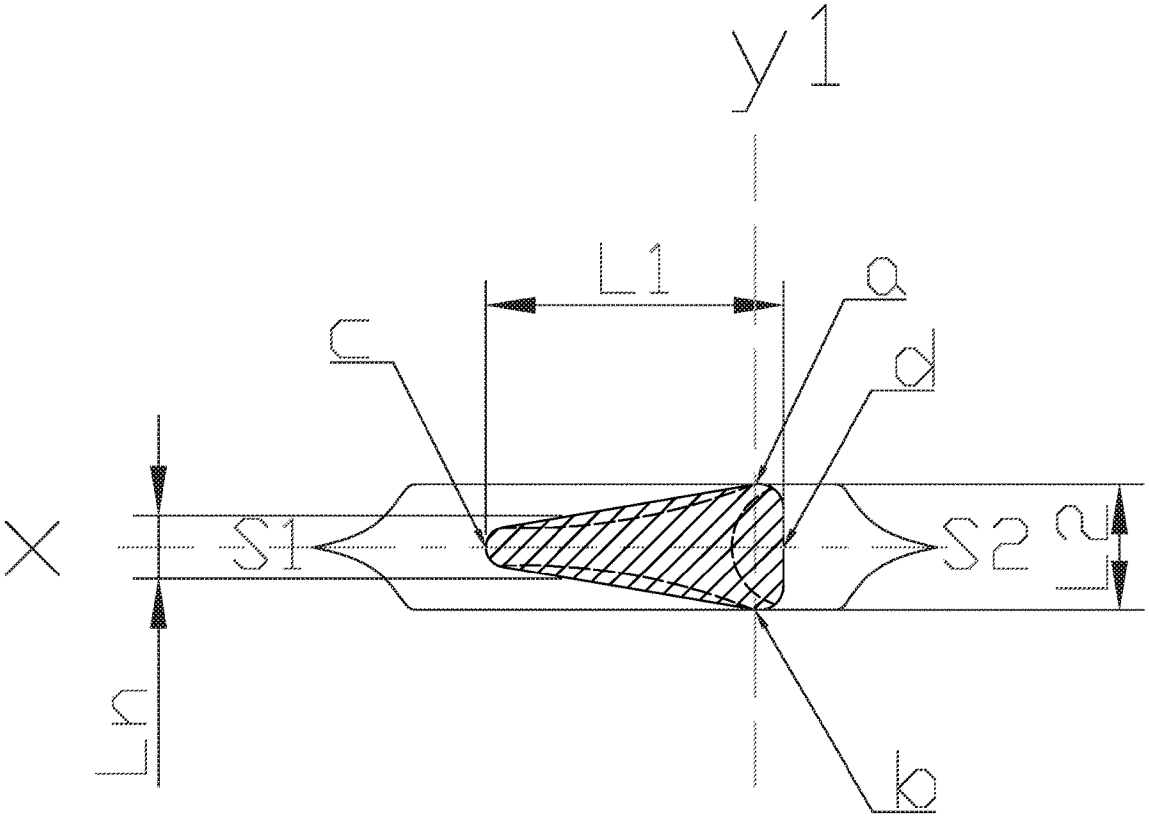
FIGS. 3*a*-3*e* are cross-sectional views of typical wedge wires according to the aspects of the disclosed embodiments showing dimensional characteristics of the cross-sectional shape.
Figure 3B:
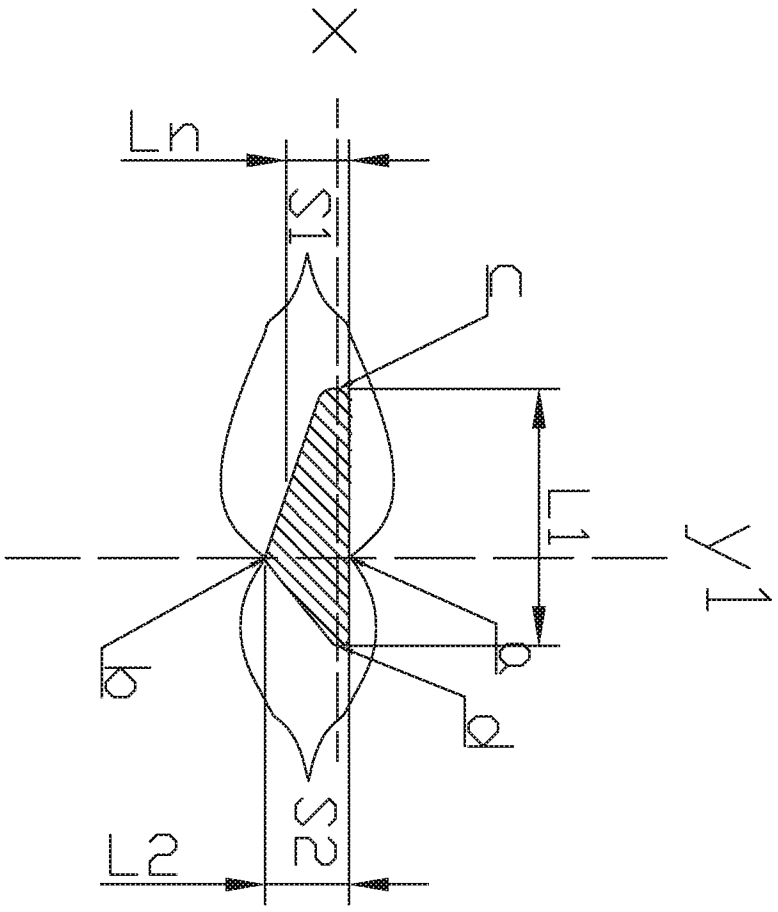
Figure 3C:
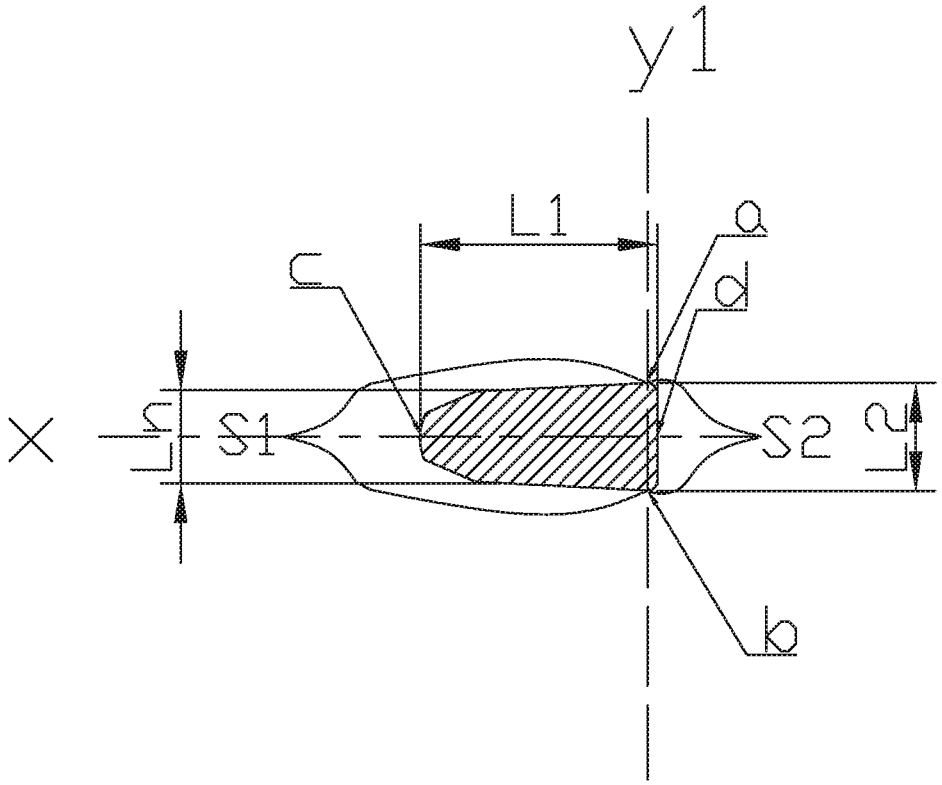
Figure 3D:
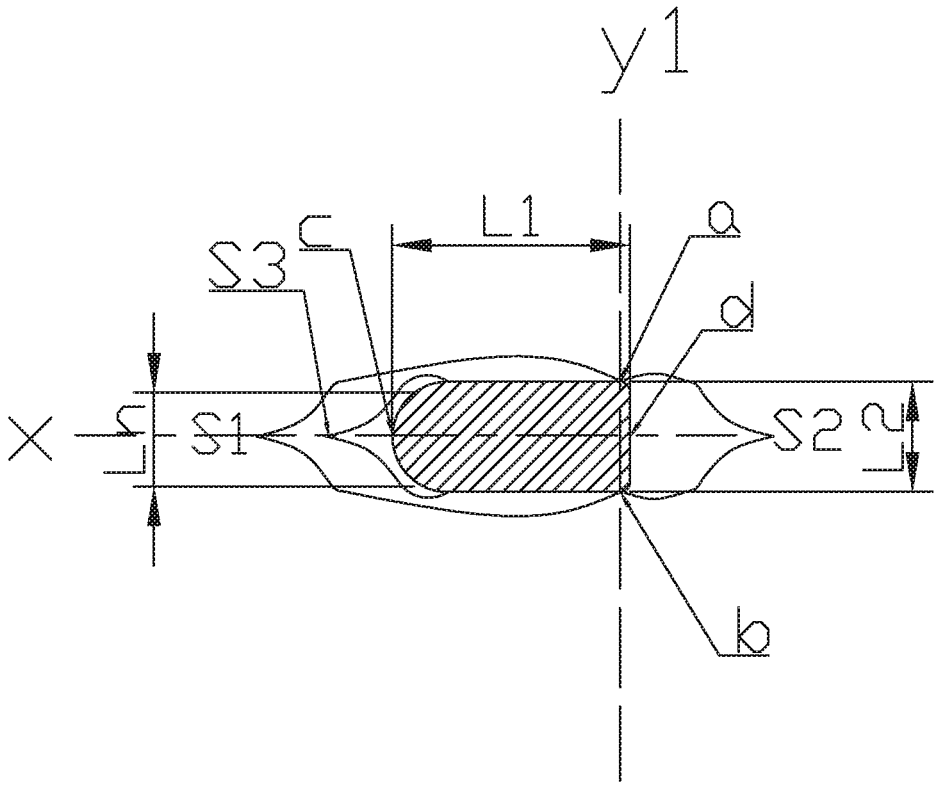
Figure 3E:
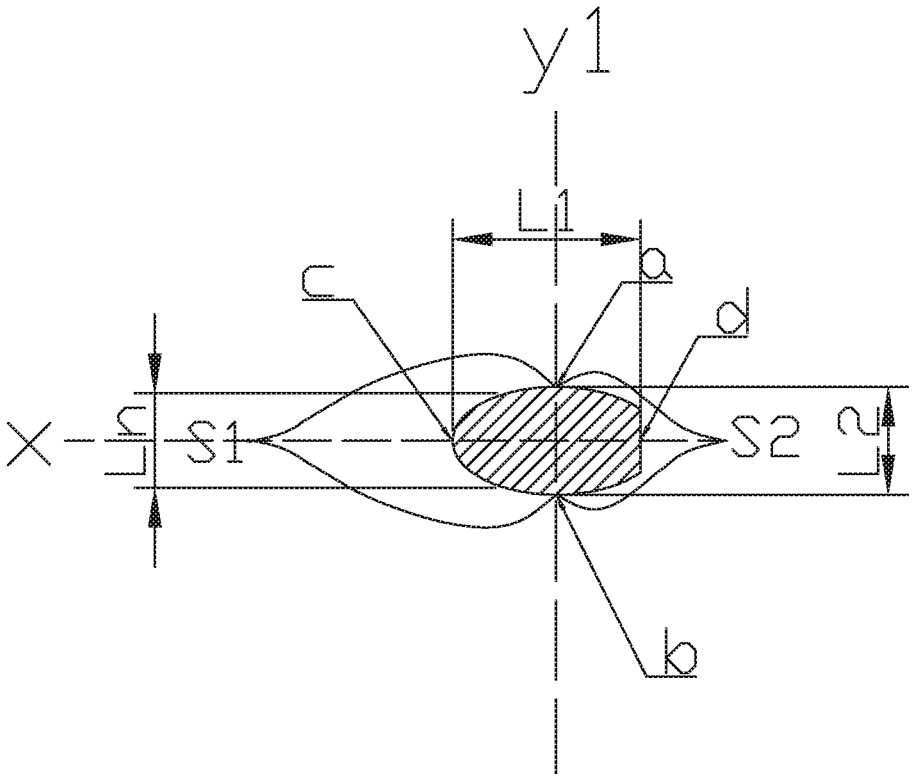
Figure 3F:
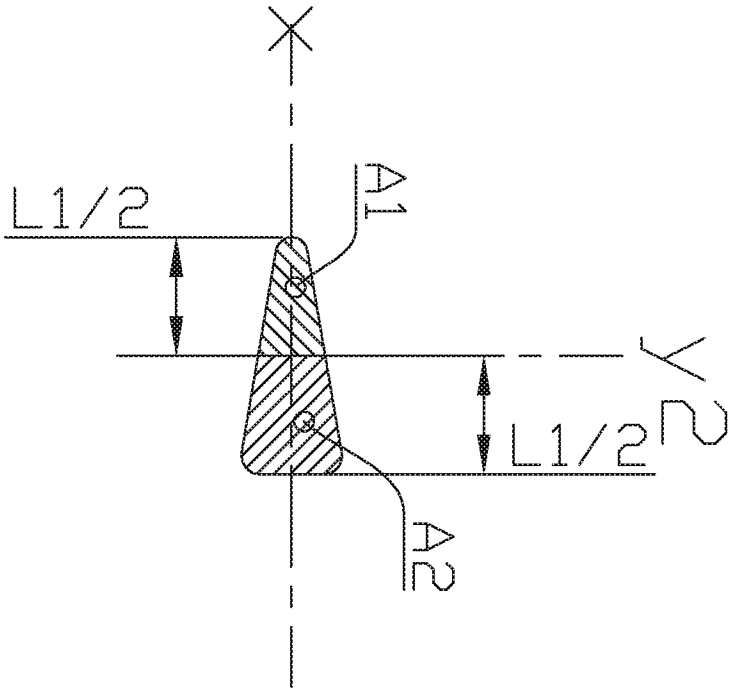
FIGS. 3*f*-3*h*, 3*j* and 3*k* are cross-sectional views of the wires of FIGS. 3*a*-3*e* showing the asymmetric distribution of material over the cross-sectional area.
Figure 3G:
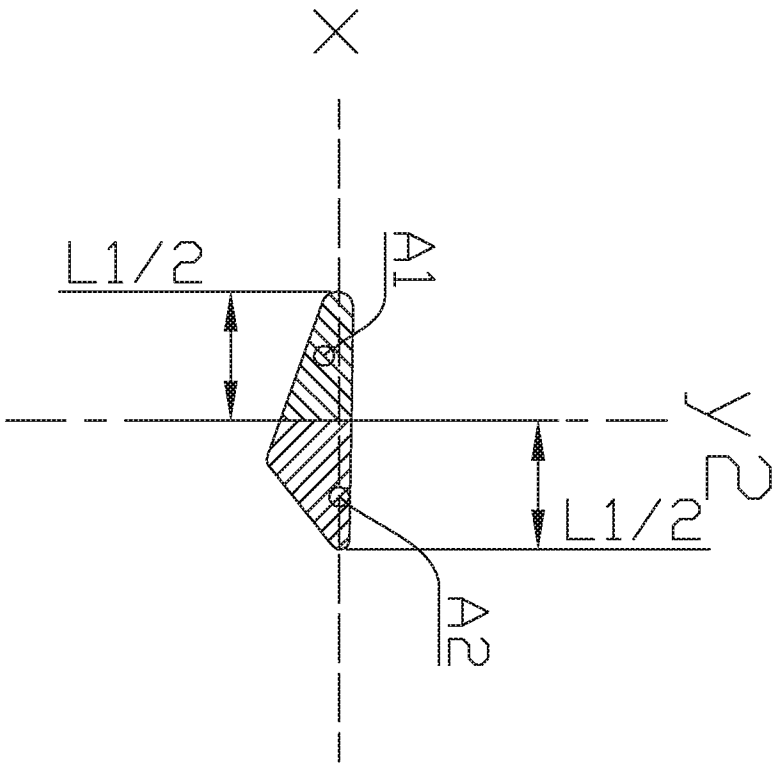
Figure 3H:
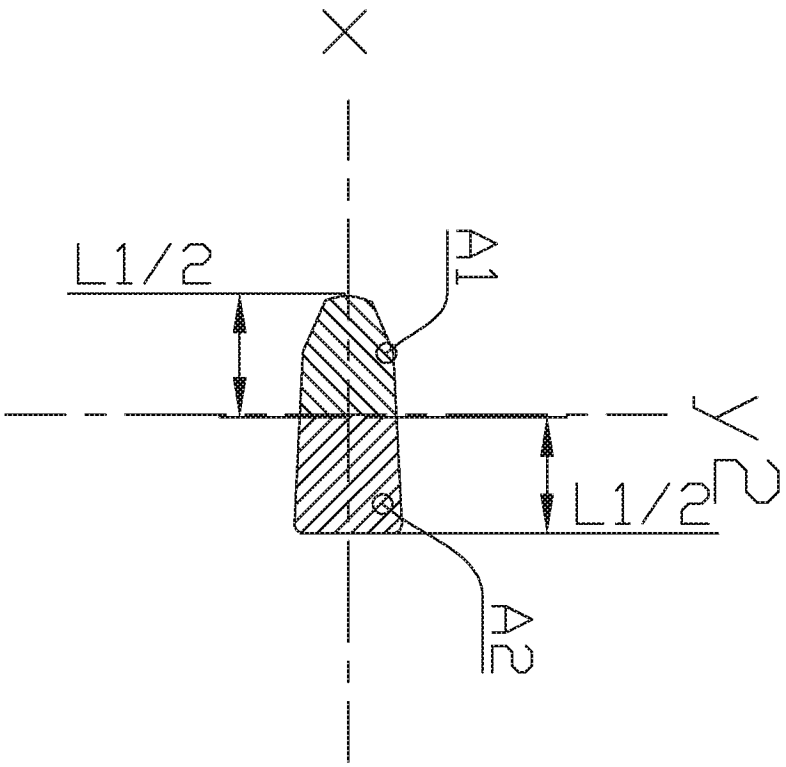
Figure 3J:
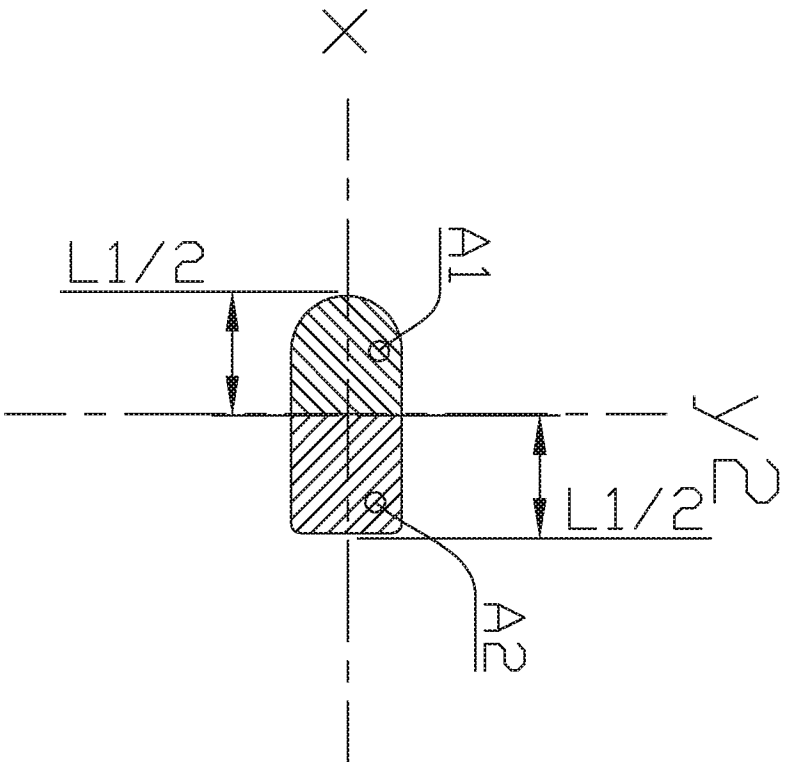
Figure 3K:
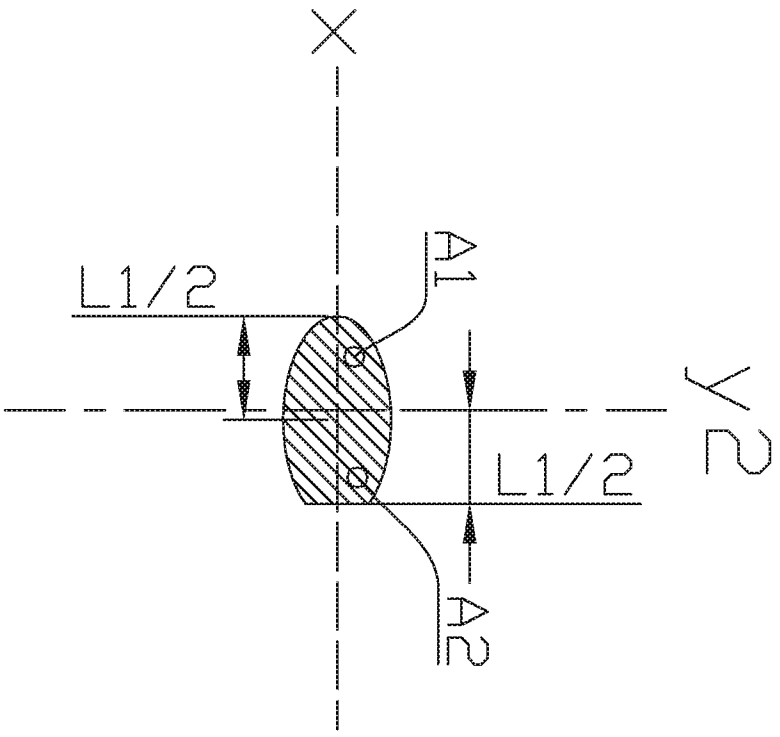
Figure 3I:
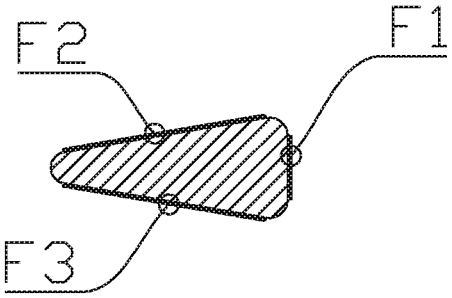
FIGS. 3*l*-3*p* are cross-sectional views of the wires of FIGS. 3*a*-3*e* showing flat surface portions.
Figure 3M:
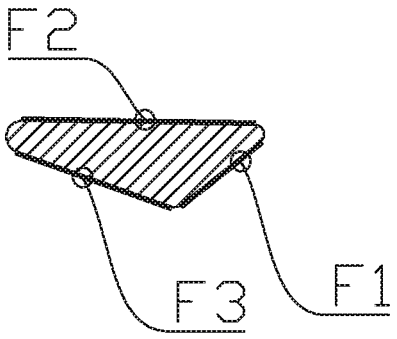
Figure 3N:
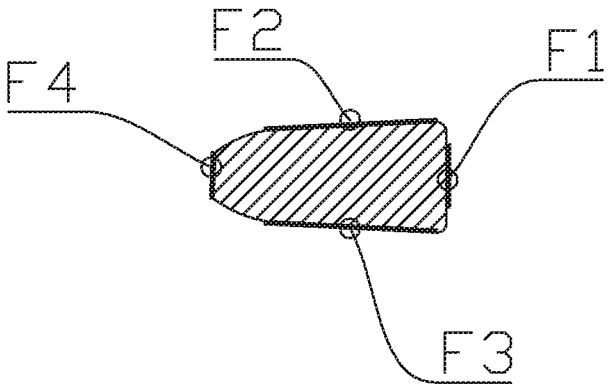
Figure 3O:
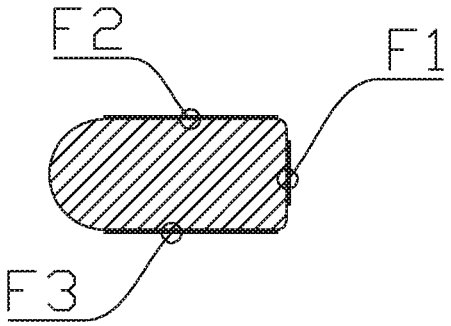
Figure 3P:
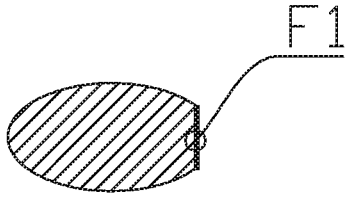

The FIGS. 3*a*-3*p* show examples of 6 different typical cross-sections of metal wedge wires according to the aspects of the disclosed embodiments. Each of the 6 cross-sections is shown in 3 drawings to show the features in relation to:

1. overall flatness as shown in FIGS. 3*a*-3*e*.
2. tapered surface portions as shown in FIGS. 3*a*-3*e*, FIGS. 3*f*-3*k*.
3. flat surface portions as shown in FIGS. 3*l*-3*p*.

The features are present in combination which provides a number of unique benefits for the making of highly improved face masks.

The wedge wire of FIGS. 3*b*, 3*g* and 3*m* is asymmetric having a longest dimension in an axis x. By adjusting the orientation of the base alternative shapes of double bars are provided as disclosed.

The wedge wire of FIGS. 3*c*, 3*h* and 3*n* is symmetric in relation to an axis x and has multiple flat surface portions which may provide alternative ways of shaping double bars for instance.

The wedge wire of FIGS. 3*d*, 3*j* and 3*o* is symmetric in relation to an axis x and has parallel surface portions in the direction of the x axis. This provides more strength in the direction of the y axis. The flat base can be produced either by rolling or by cutting or milling a naturally rounded base.

The wedge wire of FIGS. 3*e*, 3*k* and 3*p* is symmetric in relation an axis x and has rounded surface portions in all parts except the base. This provides a rounded appearance. The flat base can be produced either by rolling or by cutting or milling a rounded base.

It must be understood that the cross-sectional shape according to the aspects of the disclosed embodiments is not limited to the shown figures. It may comprise any variation, combination or configuration of the shown FIGS. 3*a*-3*p*, and adapted for the requirements of each application, as long as the main characteristics shown in the FIGS. 3*a*-3*p*.

The wedge wire cross-section can be applied for one or more wires of a face mask, or in some cases only for a part of a wire. For example, in one embodiment, a wire for a face mask as is generally described herein can have a combination of the wedge wire disclosed herein, as well as other types of wires.

The interior of the wedge wire section can be solid or hollow. Hollow interiors may be used to achieve less weight per length unit. The interior has no relevance for the aspects of the disclosed embodiments and all cross-sections of the drawings have been drawn solid.

Overall Flatness:

The flatness of the wedge wires as shown in FIGS. 3*a*-3*e* can be specified as follows: The cross-section has a dimension L1 in direction of the x axis and measured between points c and d on the outline of the cross-section. For one axis symmetric cross-sections the x axis is the symmetry axis. For asymmetric cross-sections the x axis is the direction of the longest dimension.

The outline points a, b, c and d may comprise one of: point of arcs with a tangent perpendicular to the axes x or y1, point of straights, or blend point between arcs and straights. Corners that appear sharp with the naked eye comprise arcs when magnified.

The x axis is here called the major axis and L1 may have a dimension of approximately 3 to an including 15 mm. The cross-section has a second maximum dimension L2 in a direction y1 perpendicular to the x axis and measured between points a and b on the outline of the cross-section. The direction y1 is here called the minor axis and L2 may have a dimension of approximately 1.5 to and including 5 mm.

The wire may be considered flat if the dimension L1 is bigger than the dimension L2. A ratio L1/L2 of approximately 1.2-1.4 has been found advantageous in certain embodiments, e.g. when the wedge wire is subject to high impact from several directions and located in the mouth region in a horizontal position. A ratio L1/L2 of approximately 1.5-2.1 has been found advantageous for certain embodiments. Hereby the obstruction of vision may be reduced by 20-40% and the weight by 10%-30% compared to round wire face masks without compromising the strength of the mask. A ratio L1/L2 of more than 2.1 has been found advantageous for certain embodiments, especially for small wire cross-sections with a dimension L2 smaller than 2 mm, or when the wire is used as part of a double bar, such as an L-shaped bar.

Figure 4A:
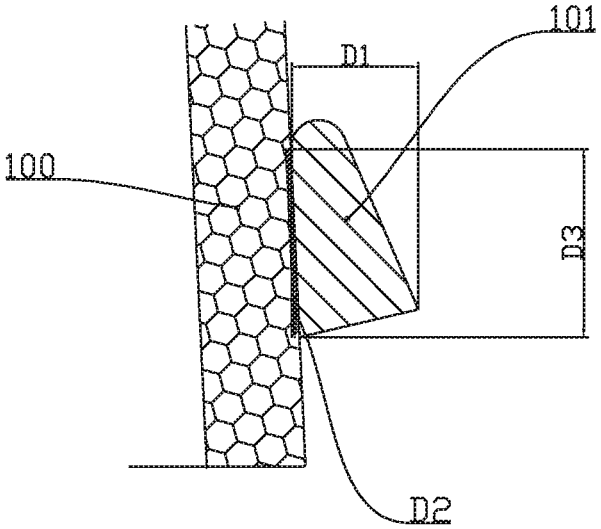
FIG. 4*a* is a cross-sectional view showing a wedge wire in contact with the surface of a helmet.

The flatness of a wedge wire of the disclosed embodiments provides improved impact distribution to helmets as shown in FIGS. 4*a*-4*d*. FIG. 4*a* shows a contour wedge wire 101 having a ratio D3/D1 of 1.8, and being in contact with a helmet 100. A contour wire is one that comprises the outer rim or parts of the outer rim of the face mask. The contact surface D2 has a dimension D3. The distribution of a horizontal impact from the contour wire to the helmet will be distributed over an area having the width D2 when the wire and helmet surfaces are flat and have parallel orientations. The bigger the dimension D2 the better the impact distribution and also the steadiness of the face mask attachment to the helmet due to increased friction between the surfaces.

Figure 4B:
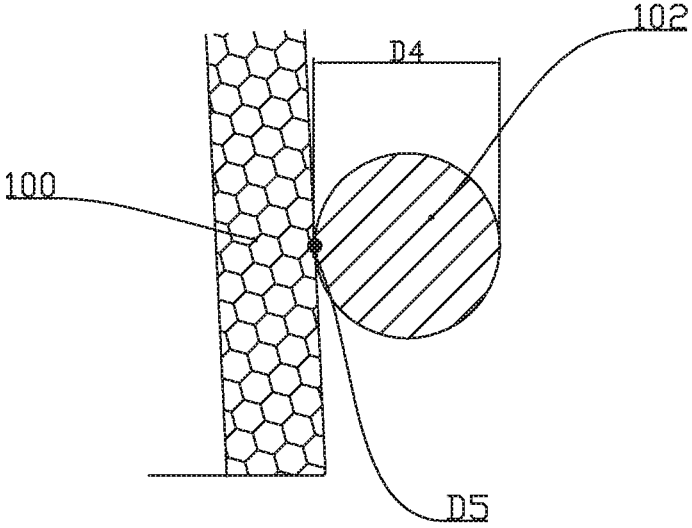
FIG 4b PRIOR ART
FIG. 4*b* is a cross-sectional view showing a prior art round wire in contact with the surface of a helmet.

FIG. 4*b* shows the same situation for a prior art round contour wire 102 having similar strength properties as the wedge wire 101. The diameter is D4 and a very narrow contact area D5 between the wire and a helmet 100 is provided due to the round cross-section. A horizontal impact force will be concentrated to this area which will increase the risk for damages and wear of helmets and the steadiness of the face mask is poor compared to FIG. 4*a*.

Figure 4C:
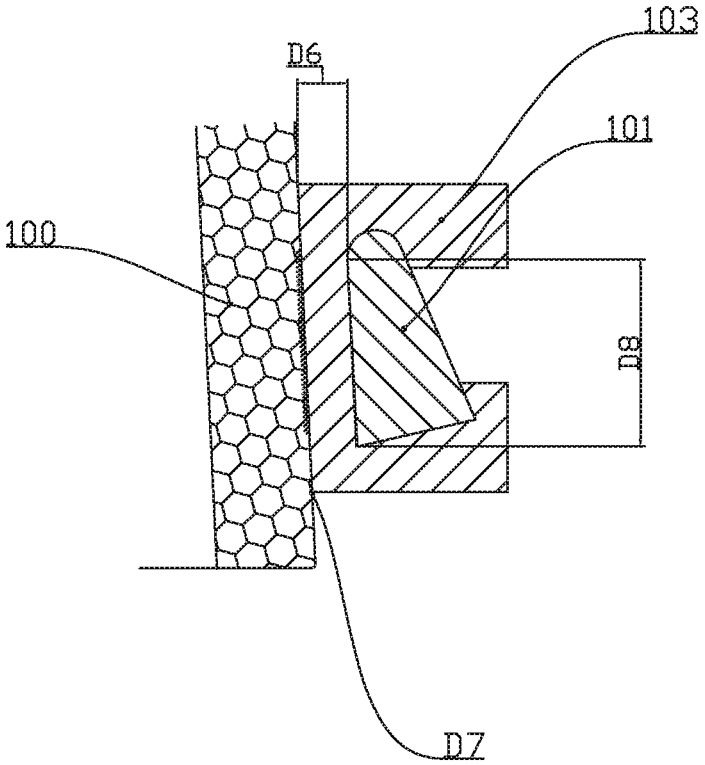
FIG. 4*c* is a cross-sectional view showing a wedge wire with a detachable elastomer profile in contact with the surface of a helmet.
Figure 4D:
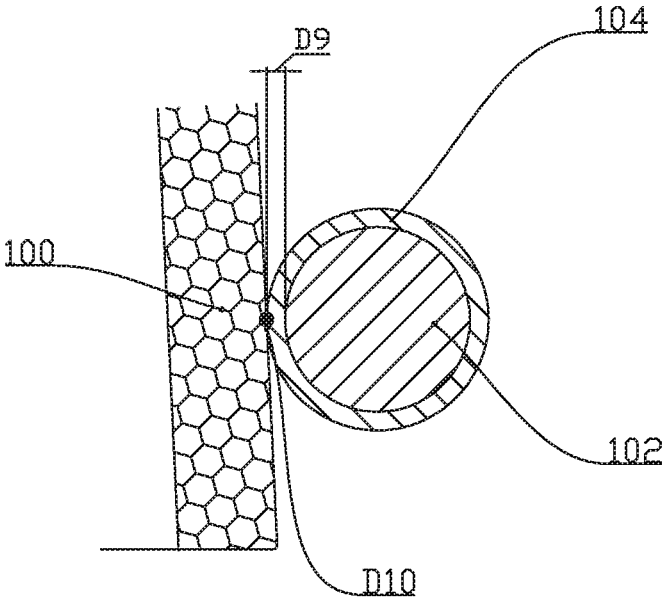
FIG 4d PRIOR ART
FIG. 4*d* is a cross-sectional view showing a prior art round wire overlaid by an elastic tubing in contact with the surface of a helmet.

In some face guard and helmet headgear subject to very high impact forces, attempts have been made to provide maximal absorption of impact energy between the face mask and the helmet. Such face masks are for instance used by baseball catchers and ice-hockey goalies. As shown in FIG. 4*c* a detachable elastomer profile 103 with good energy absorbing properties has been attached to the wedge wire 101. The impact absorption between the mask and the helmet is very efficient because the impact force is distributed on a width D8 to the elastomer profile and the damped force is transferred to the helmet 100 over the contact area D7. The elastomer material can be chosen to give more friction in the contact area D7 in order to provide additional steadiness for the face mask. FIG. 4*d* shows a prior art solution mentioned above where the round wire 102 has been overlaid by elastic tubing 104 in order to absorb some of the impact energy and to create more friction between the mask and helmet 100. The efficiency of the impact absorption of the wire shown in FIG. 4*d* is only a fraction of the wire shown in FIG. 4*c* because of the thinner (D9) tubing and smaller contact area D10.

Figure 4E:
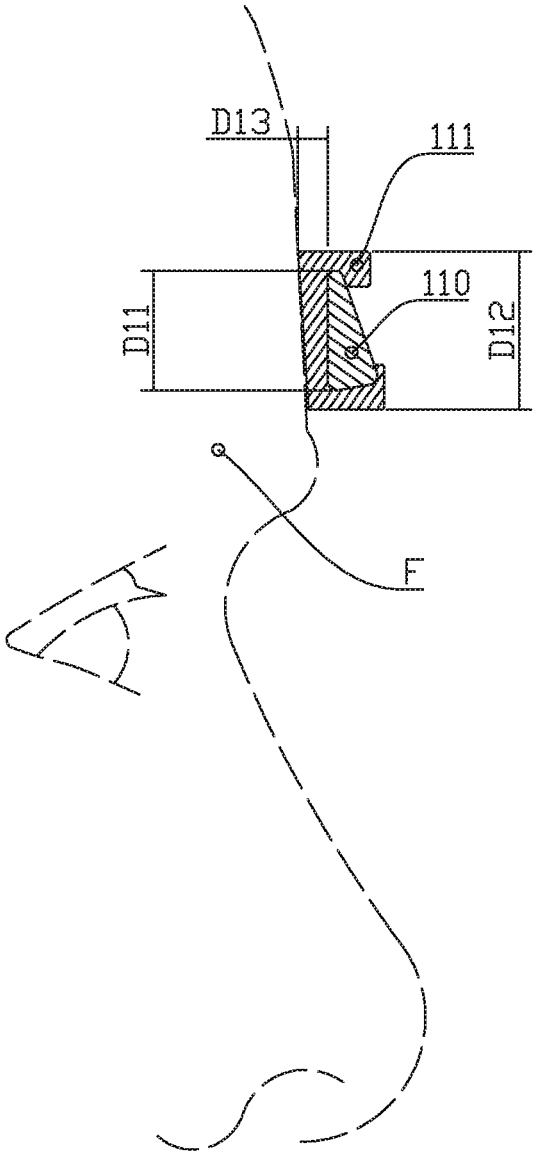
FIG. 4*e* is a cross-sectional view showing a wedge wire with a detachable elastomer profile in contact with the forehead of a wearer of a face guard or goggles.
Figure 4F:
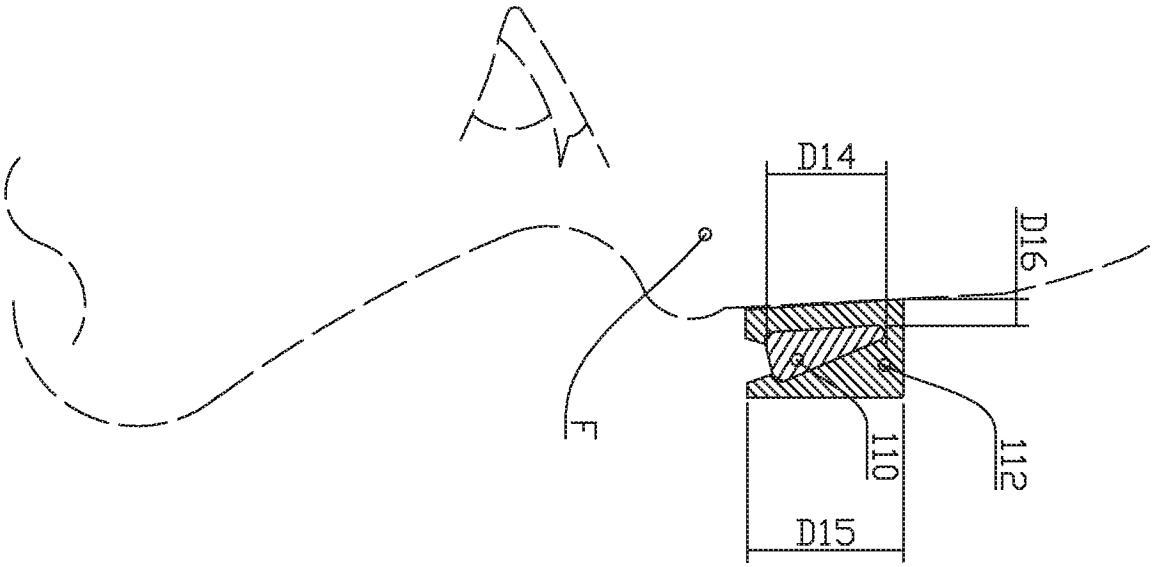
FIG. 4*f* is a cross-sectional view showing a wedge wire with another type of detachable elastomer profile in contact with the forehead of a wearer of a face guard or goggles.

The flatness of a wedge wire of the disclosed embodiments also provides improved impact distribution between a face guard and the head F of the wearer as shown in FIGS. 4*e*-4*f*. Also a simplified solution is hereby provided. FIG. 4*a* shows a sectional detail of a padding system for a face guard which is worn directly against the face in sports like softball or women's lacrosse. A contour wire 110 according to the aspects of the disclosed embodiments with an elastic detachable padding 111 mounted firmly around the wire and leaning against the forehead of the wearer F is shown. The face guard is pressed against the forehead and attached to the head by means of straps which are not shown in the figure. By impact for instance by a ball to the face guard the wire 111 gives an impact in direction of the forehead. The padding 111 with a thickness D13 in the impact area absorbs a part of the impact energy transferred along the width D11 and the damped shock is transferred to the forehead along the area D12.

FIG. 4*f* shows an optional solution where the elastic detachable padding 112 is spanned around and over the edges of the contour wire 110. The thickness of the impact area is D16 and the widths of the impact transfer areas are D14 and D15 respectively.

Figure 4G:
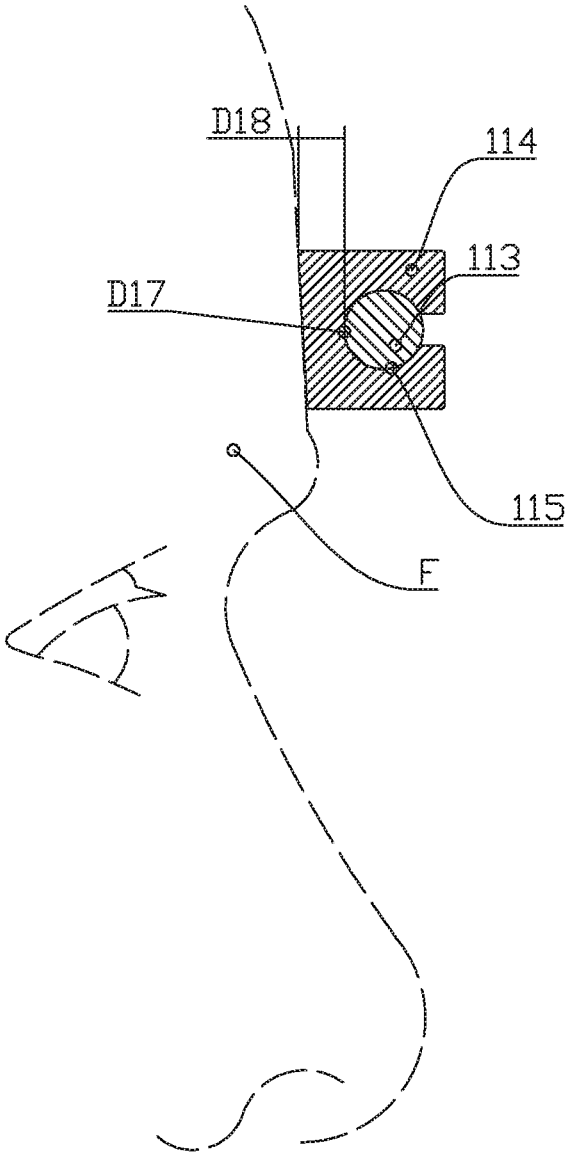
FIG 4g PRIOR ART
FIG. 4*g* is a cross-sectional view showing a prior art round wire with a bonded elastomer profile in contact with the forehead of a wearer of a face guard or goggles.

FIG. 4*g* shows a corresponding prior art solution with a round wire 113 which is bonded with glue 115 inside a profiled elastic padding 114. The glue is necessary to prevent rotational movement of the wire in the groove of the padding. The impact energy is concentrated to the narrow area D17 why a thicker energy absorbing padding D18 is required compared to D13 and D16. A thicker padding may cause unsteadiness of the face mask.

Figure 4H:
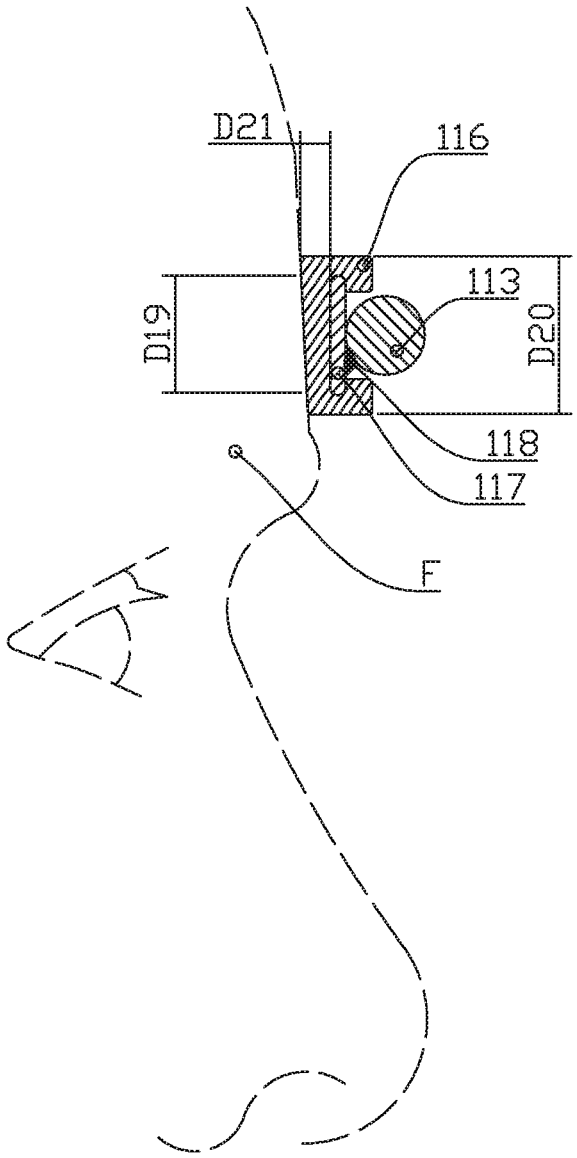
FIG 4h PRIOR ART
FIG. 4*h* is a cross-sectional view showing a prior art round wire and plate with a detachable elastomer profile in contact with the forehead of a wearer of a face guard or goggles.

FIG. 4*h* shows another prior art solution for the same application. Here the round wire 113 is attached to a strip of sheet metal 117 by welding 118. This construction enables similar impact distribution widths (D19 and D20) and padding thickness (D21) as shown in FIGS. 4*e* and 4*f*. However more welding work and manufacturing steps are required because of the increased number of components and the appearance of the construction is different.

Any flat wire has a smaller dimension in the direction of the minor axis, which is why a bending it that direction can be performed with a smaller radius and ease as compared with a round wire of the same cross-section area. As shown in the figures, the disclosed wedge wires can be used with ease in any place of a face mask, which is why it is possible to create numbers of new wire lay-outs in places where it is useful to have a small bending radius. The possibility to use prior art flat wires in different places of a mask is much more limited.

A flat wire with a large, visible surface provides novel aesthetics in all parts of a mask compared with the prior art round wires which have narrow visible surfaces or flat wires with limited use. A broad wire provides new aesthetics as such. However it also provides a surface for painting ornaments or colors on the wires. The face masks can thus be customized to give special effects or demands. For instance painted wires can be made to match the helmet or team colors, or to provide some ornamental effects. Paintings on helmets are in these days common in certain sports such as ice-hockey but so far the painting of the wires or bars has been mostly limited to monochrome colors. The wires of the disclosed embodiments provides a new level for the painting and other ornamentation of face masks.

Tapered Wire Portion:

As shown in FIGS. 3*a*-3*e* the points a and b divide the surface of the wedge wire into two portions. A larger portion S1 called the wedge and a smaller portion S2 called the base. The wedge S1 comprises two long sides, one between points a and c, and another between points b and c respectively. The long sides are united to form a tip portion with the outermost point c. The overall shape of the wedge may comprise straight, rounded and beveled shapes in any combination.

The base S2 between points a and b comprise straight, rounded and beveled shapes in any combination. L2 is the maximum dimension perpendicular to the x axis why any other perpendicular dimension Ln of the cross-section is smaller or equal to L2 measured at through any point of the x axis. FIGS. 3*a*, 3*b*, 3*c* and 3*e* show cross-sections with the dimensions Ln smaller than L2 and having a fully tapered wedge S1. FIG. 3*d* shows a wedge S1 with most dimensions Ln equal to L2 and thus having partly parallel sides, and a smaller tapered portion S3 in the tip.

A tapered shape in general gives a better weight/strength ratio for a wire compared with a round shape. This is the case not only in situations where the expected impacts are different in different directions and the tapered shape can be adapted to this, but also in situations when equal strength is provided in all directions. It is known that a solid equilateral triangle, which can be considered as one extreme of a wedge wire, provides 21% more stiffness in all directions as compared to a solid round wire with the same cross-sectional area. Hence a wedge wire incorporating aspects of the disclosed embodiments can always be dimensioned to give the same stiffness in one direction, and higher stiffness in all other directions than a round wire with the same cross-sectional area. This provides the possibility to customize the strength in different impact directions by adjusting the dimensions L1, L2 and Ln according to the specific demands. This gives flexibility to customize a wire for its specific task.

The wedge wire of the disclosed embodiment provides superior qualities over wires used for face masks. For instance by identical cross-sectional areas (weight per length unit) and dimensions in direction of the minor axis, the strength of the wedge wire of the disclosed embodiments is approximately double in direction of the major axis compared to the prior art wires. By identical cross-sectional areas and strength in direction of the major axis the strength of the wedge wire is approximately three times bigger in direction of the minor axis. Consequently a wedge wire of the disclosed embodiments, when properly dimensioned, can provide better weight/strength/vision relationships for a face mask than other prior art wires.

Any flat wire provides a smaller obstruction of vision in the field of view and higher strength against impacts compared to round wires with the same cross-sectional area. This is the case when the major axis x is directed in the line of vision of the user which is simultaneously also the direction of the impact. For a horizontal prior art flat wire it is impossible to achieve a single position of the wire giving the best result in relation to both vision and strength, unless the wire is on eye level which is not a realistic position because of poor visibility. A compromise is therefore necessary on cost of either strength or visibility. For a wedge wire on the other hand it is possible to get a unique combination of good vision and strength as demonstrated in FIGS. 5*a*-5*c*.

Figure 5A:
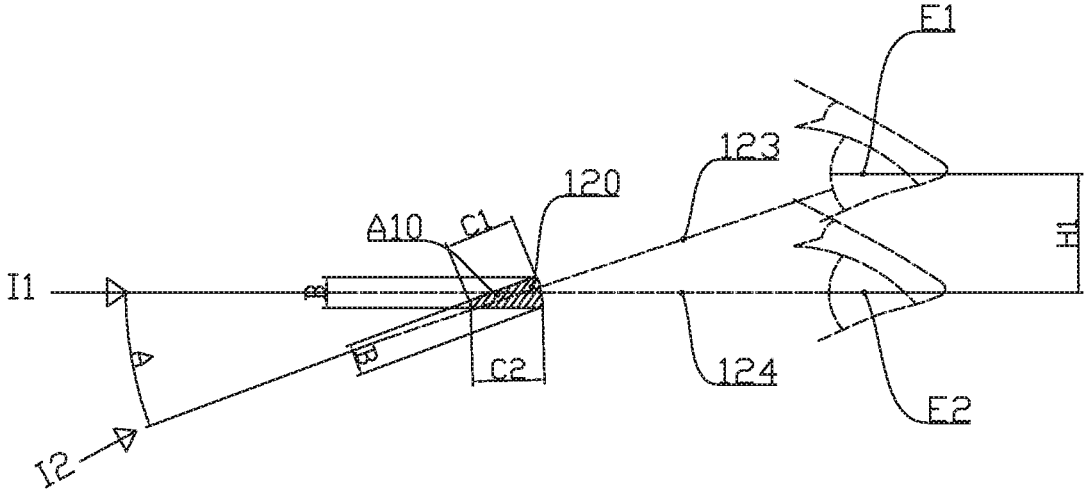
FIG. 5*a* is a cross-sectional view showing characteristics of a wedge wire in relation to vision and impact strength.

FIG. 5*a* shows a wedge wire 120 in the visual field of view of the wearer a helmet or cage with such wires, and where the wire is subject to impacts from variable directions between the directions I1 and I2. The cross-sectional area of the wire has a value A10. The expected maximum impact caused e.g. by balls or pucks is directed towards the face of the user from any direction between the directions I1 and I2 within the angle A. The impact strength of a wire is mainly influenced and nearly proportional to the dimensions C1 and C2 in direction of the impacts. The other dimensions of the wire cross-section have minor influence here. For simplicity and demonstration it is sufficient and practical to use the dimensions of the wire in direction of impact as a direct indication of the strength. As seen in FIG. 5*a* the dimensions C1 and C2 and any dimension within the impact angle A are approximately constant. Consequently the strength of the wire is almost the same in all directions within the impact angle.

FIG. 5*a* further shows the wedge wire 120 viewed from two different eye positions E1 and E2 of the user having the viewing lines 123 and 124. The height difference of the eye positions is H1. The eyes of the user for any face mask or headgear can be on slightly different height positions in relation to the wire due to physical differences between individuals or other unfavorable circumstances as disclosed. It can be seen that the wedge wire 120 causes an obstruction in the field of view of which the width is B. Because of the tapered shape the width B is constant for all height positions of the eyes within H1, which means that the obstruction does not increase when the eyes are not in the ideal position in relation to the wire.

Figure 5B:
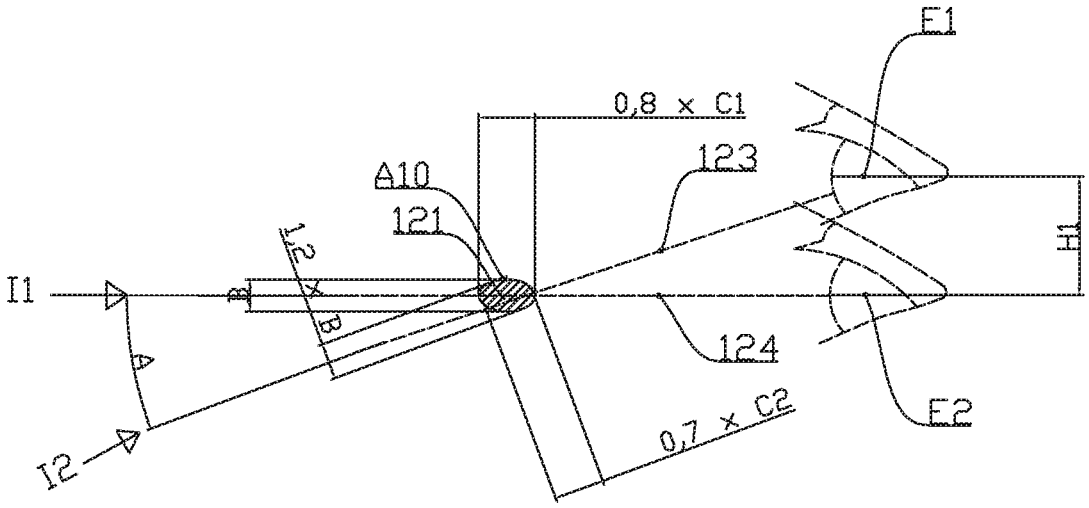
FIG 5b PRIOR ART
FIG. 5*b* is a cross-sectional view showing characteristics of a prior art oval wire in relation to vision and impact strength.
Figure 5C:
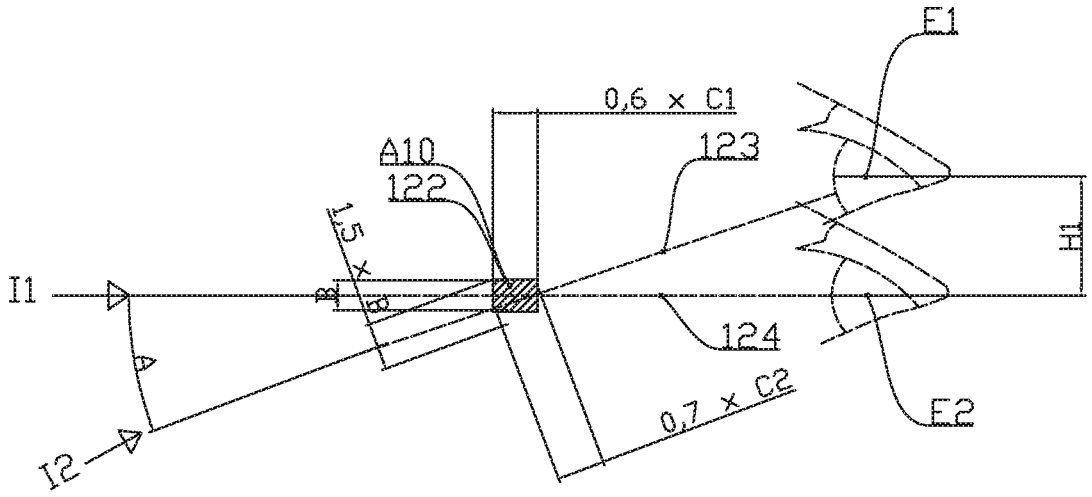
FIG 5c PRIOR ART
FIG. 5*c* is a cross-sectional view showing characteristics of a prior art flattened rectangular wire in relation to vision and impact strength.

The same situation is shown for a prior art oval wire 121 in FIG. 5*b* and a flattened rectangular wire 122 in FIG. 5*c*. The same impact directions I1 and I2 and eye positions E1 and E2 are shown as in FIG. 5*a*. The dimensions of the wires are equivalent to the wedge wire of FIG. 5*a* in that the size of the cross-sectional areas A10 and the maximum dimension of the minor axis B are the same.

FIG. 5*b* shows that the dimension of the oval wire 121 in direction of impact I1 is approximately 0.8×C1. The strength of the wire is nearly half in this direction compared with the wedge wire 120. The dimension of wire 121 in the impact direction I2 is approximately 0.7×C2 (or C1) which means that the strength of the oval wire will be reduced by more than 10% compared with the direction I1. FIG. 5*b* also shows that the obstruction of vision increases to 1.2×B by the eye position E1 which is clearly noticeable for the user of the mask.

FIG. 5*c* shows that the dimension of the rectangular wire 122 in direction of impact I1 is approximately 0.6×C1. The strength of the wire is still lower in this direction compared with the oval wire 121. The dimension of the rectangular wire 122 in the impact direction I2 is approximately 0.7×C2 which means that the strength in this direction is higher compared to direction I1, however substantially lower than the corresponding strength of the wedge wire. FIG. 5*c* also shows that the obstruction of vision is 1.5×B by the eye position E1 which causes a clearly noticeable increase of the obstruction of vision.

The strength and the obstruction of vision of prior art flat wires can be modified by changing the dimensions of the cross-sections or by adjusting the angular position of the major axis. By increasing the dimension in horizontally in direction of the major axis will increase the obstruction of vision for the eye positions E1. Also the weight of the wire will increase. By modifying the direction of the major axis, for instance to be in line with the viewing line from eye position E1, the obstruction of vision is small but the strength in the impact direction I1 will be reduced, and further a technically difficult off axis bending is required as disclosed. Thus a compromise must always be made between vision, strength and weight for the prior art wires and a better result in this respect can always be obtained by properly dimensioned wedge wires.

Figure 6A:
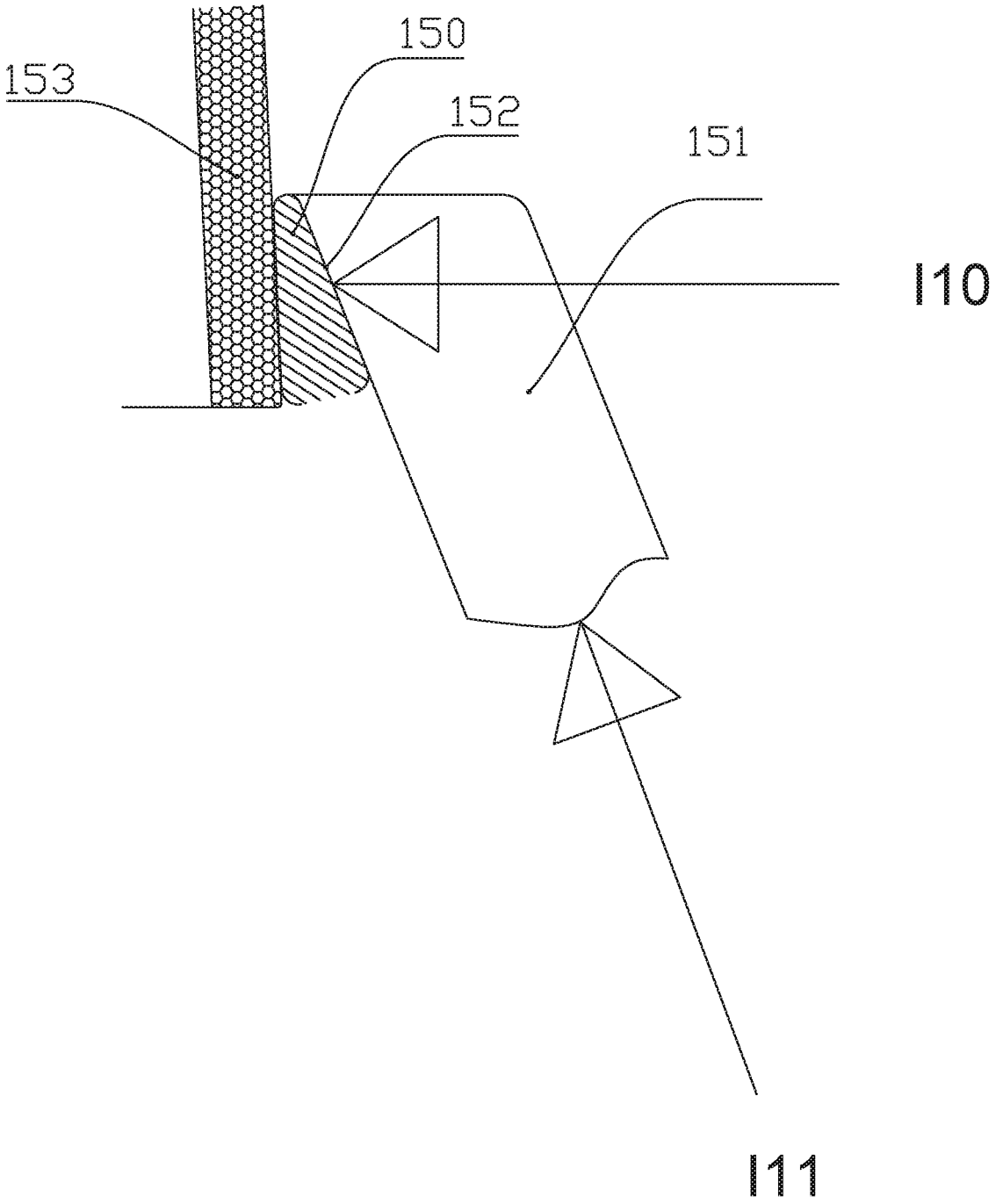
FIG. 6*a* is a cross-sectional view showing characteristics of a contour wire according to the aspects of the disclosed embodiments in relation to impact strength in variable directions.

An example of a strength customized contour wedge wire 150 incorporating aspects of the disclosed embodiments in contact with the surface of a helmet 153 is shown in FIG. 6*a*. A second wire 151 belonging to the grid portion of the face mask is attached to the wire 150 by weld 152. The joint is located on the side of the headgear. The contour wire 150 is subject to direct impacts from objects such as balls or pucks from approximate directions I10. The object deflects after the impact because the impact point is on the side of the headgear, which is why only a part of the total kinetic energy is transferred to the wire Also the helmet 153 backs up the wire. Thus the required strength of the wire in direction of the impact must not be very high. If the object on the other hand hits the middle part of the grid portion where it does not deflect, a very high impact force will be transferred from the grid portion through the wire 151 to the wire 150 from a direction I11. Further the metal in the welding points may be more ductile due to the heat input of the welding and the helmet provides no back up from this direction. Consequently a much higher strength of the wire 150 is required in direction I11 than I10. The strength of the wedge wire 150 shown in the FIG. 6*a* provides approximately 3-4 times more strength in direction I11 compared to direction I10, which has been found to provide a good result in certain applications of the aspects of the disclosed embodiments, such as ice-hockey goalie masks.

Figure 6B:
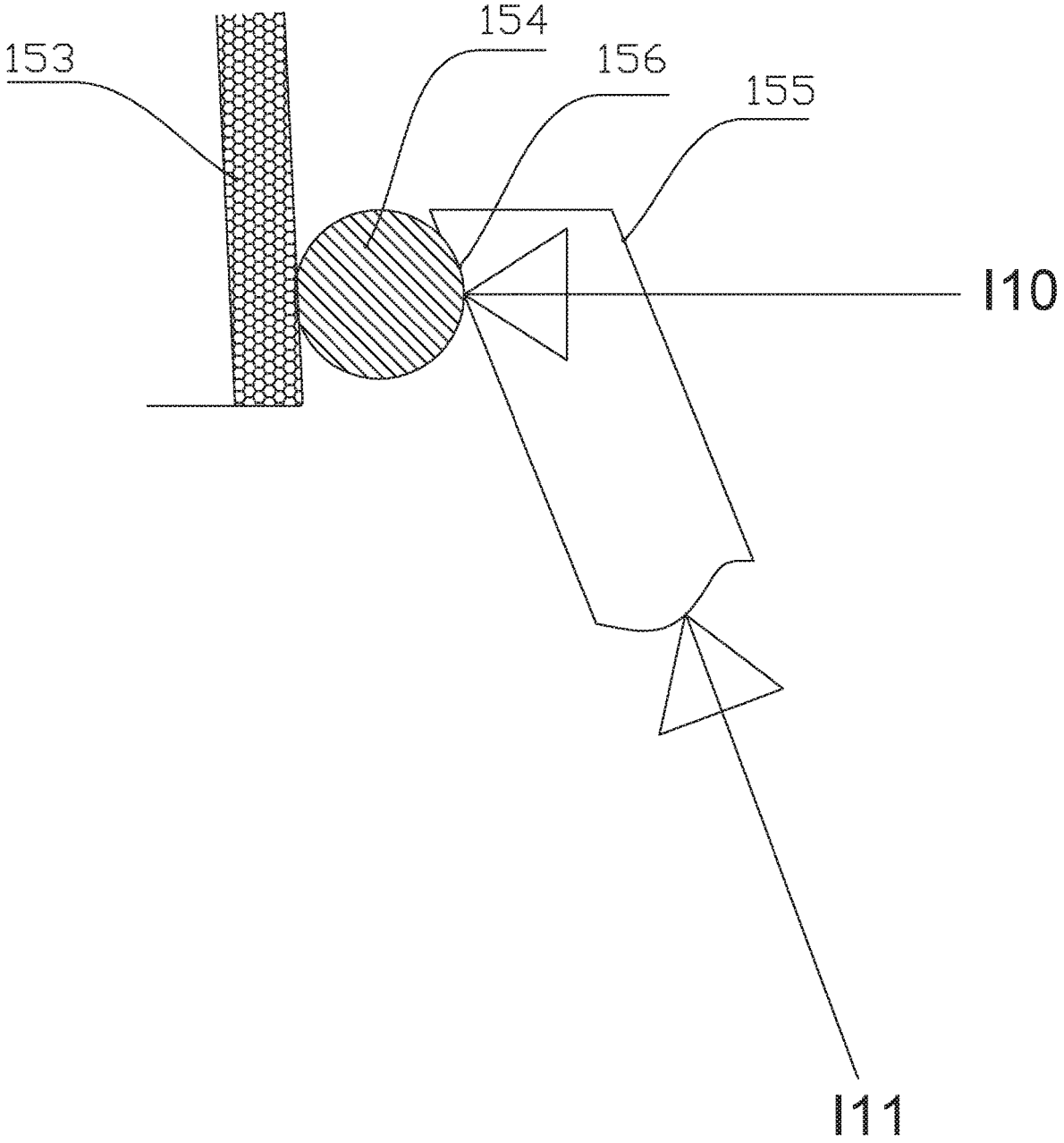
FIG 6b PRIOR ART
FIG. 6*b* is a cross-sectional view showing characteristics of a prior art round contour wire in relation to impact strength in variable directions.

The corresponding detail of a prior art ice-hockey goalie mask is shown in FIG. 6*b*. A round contour wire 154 leans against the helmet 153 and is attached to a round wire 155 comprising part of the grid portion by weld 156. The joint comprises a weak point of the mask and it is common to get dents from direction I11 on the prior art face masks which may not lead to injuries but calls for replacement of the mask. If such dents are to be avoided the round wire should have a larger diameter. To provide the same strength in direction I11 as the wedge wire 150 the round wire should have almost doubled cross-sectional area. This would increase the weight of the mask considerably why it is normal to allow for such dents and replace the whole mask. Hence the weight of the mask can be reduced and the lifetime prolonged by using wedge wires as contour wires.

In FIGS. 7*a*-7*e* the achievable bending directions proximate to the major axis of different wire types are shown. This type of bendings are essential for wires that must provide visibility and strength as disclosed. Bending in direction of the minor axis is easily achieved for flat wires but not subject to examination here.

Figure 7A:
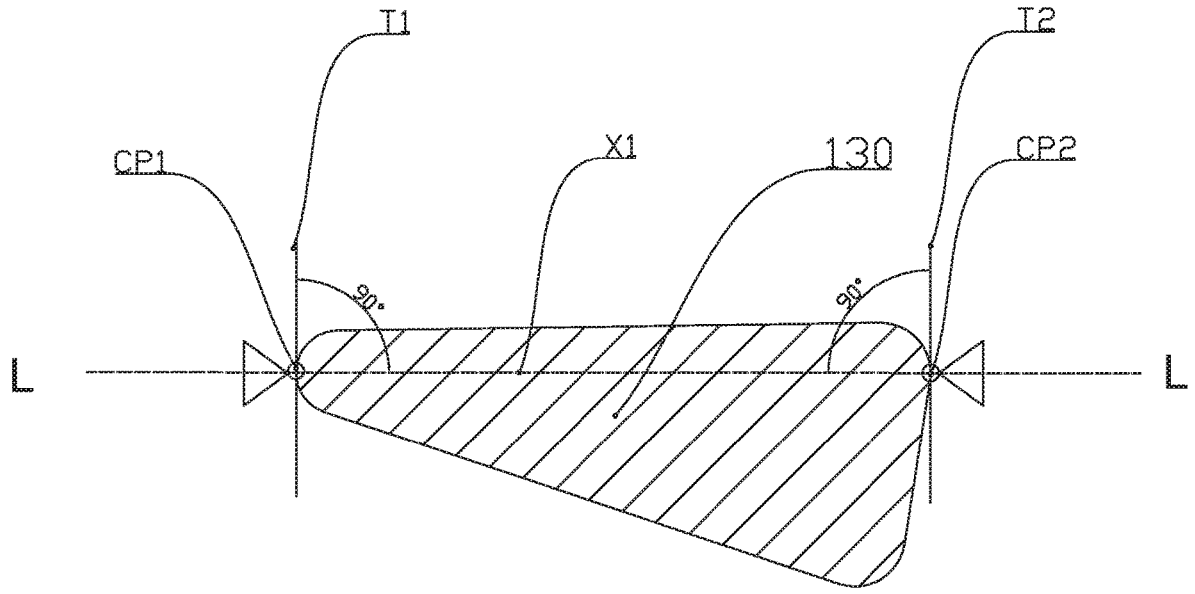
FIGS. 7*a*-7*c* are cross-sectional views of a wedge wire of the disclosed embodiments showing three feasible bending planes.
Figure 7B:
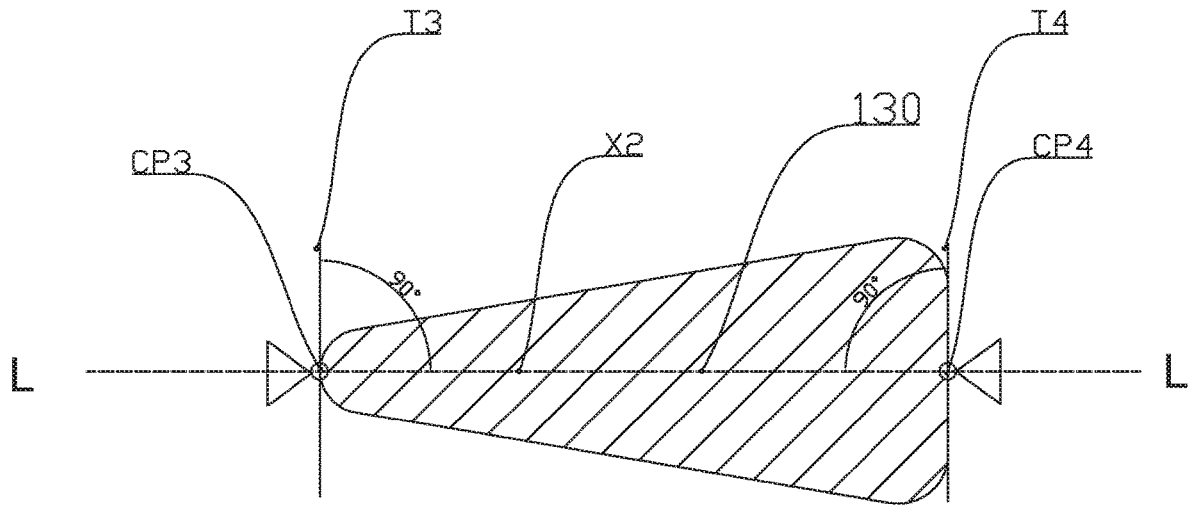
Figure 7C:
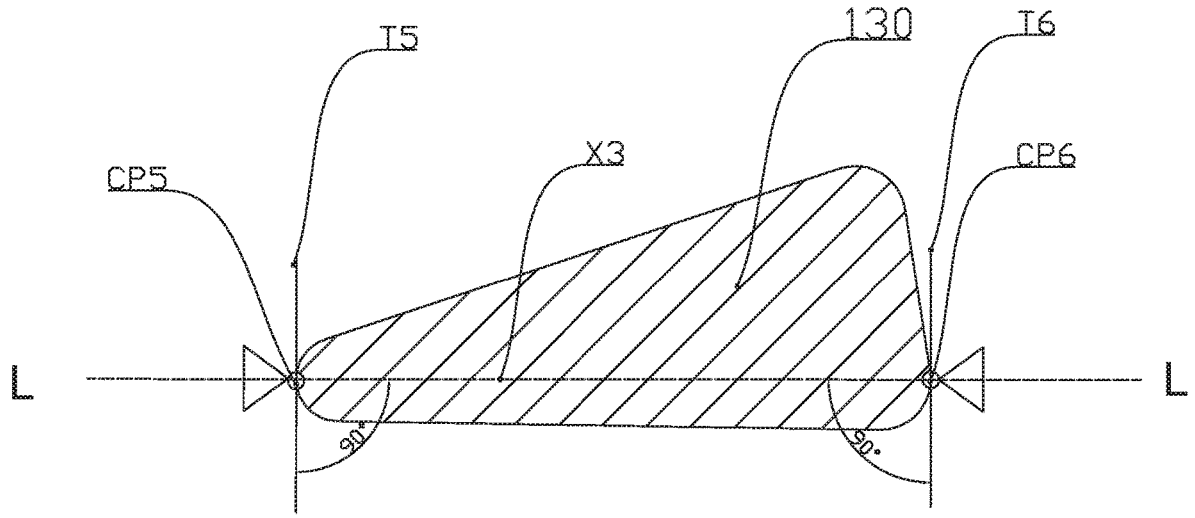

FIGS. 7*a*-7*c* show a cross-section of a wedge wire 130 incorporating aspects of the disclosed embodiments with a tapered shape and a flat base portion. A bending is achievable in three different directions: in the major axis X2 as shown in FIG. 7*b*, and two off-axis directions X1 and X3 as shown in FIGS. 7*a* and 7*c*. The bending is achievable in these directions because each direction has contact points CP1-CP6 between the wire and the bending tool where the tangents T1-T6 are in perpendicular position in relation to the respective bending axes. A perpendicular tangent in the contact point ensures that the wire is confined when a load L is applied in the contact points. If the tangent would have a direction which is not perpendicular to the bending direction the wire would slip relative to the bending tool and spoiling the bending operation. FIGS. 7*a* and 7*c* show two contact points CP1 and CP5 which are located on arcs, and two contact points CP2 and CP6 which are located on the blend points between an arc and straight surface. Thus the wire is confined only in these points and attention must be paid to an accurate positioning of the wire and perfect surfaces of the tools. The situation may be helped by using grooved surfaces on the dies or rolls. Contact point CP4 of FIG. 7*b* on the other hand is located on a straight surface which will make the situation less vulnerable because the straight surface confines the wire.

Figure 7D:
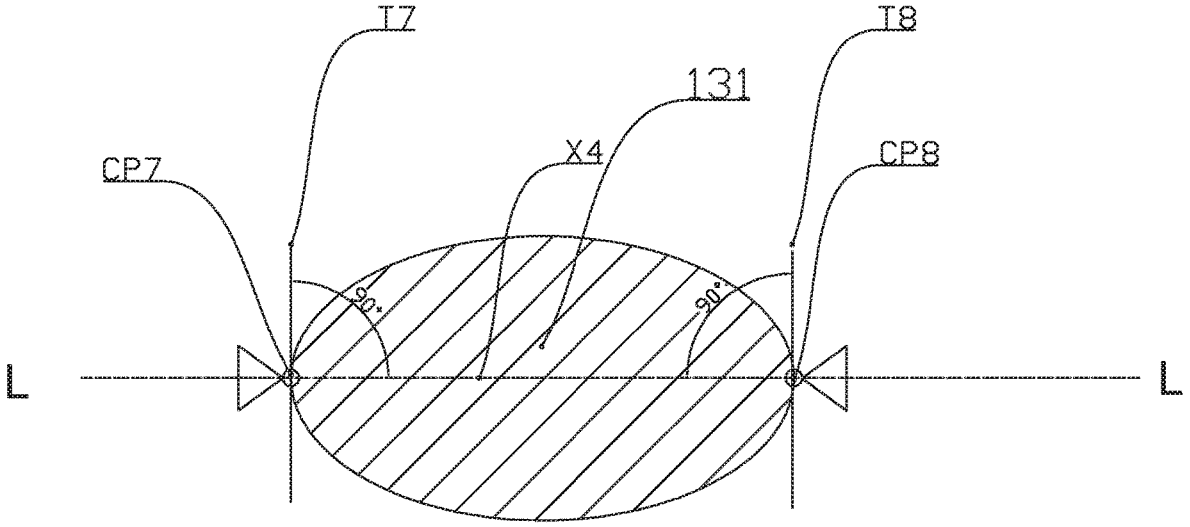
FIG 7d PRIOR ART
FIG. 7*d* is a cross-sectional view of a prior art oval wire showing one feasible bending plane.

FIG. 7*d* shows a section of a prior art oval wire 131. The bending of the wire is achievable only in the direction of the major axis X4. Contact points CP7 and CP8 are the only points on the periphery of the wire where the tangents T7 and T8 are in a perpendicular position relative to the bending axis X4. Contact points CP7 and CP8 are located on arcs which makes the bending vulnerable as mentioned above.

Figure 7E:
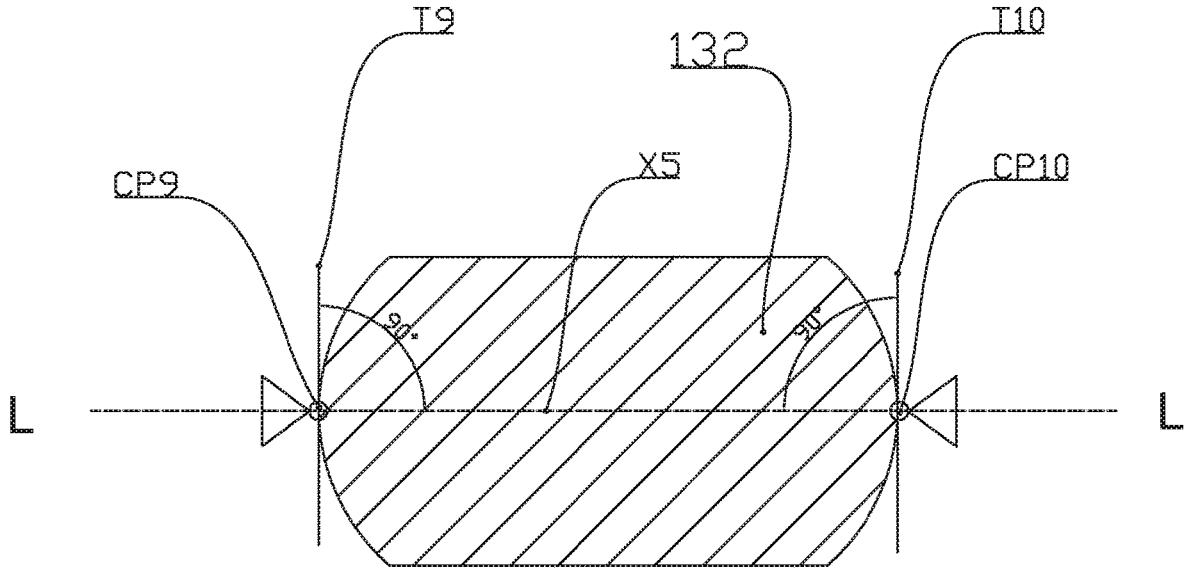
FIG 7e PRIOR ART
FIG. 7*e* is a cross-sectional view of a prior art flattened rectangular wire showing one feasible bending plane.

FIG. 7*e* shows a section of a prior art flattened rectangular wire 132. The bending of the wire is achievable only in the direction of the major axis X5. The flattened wire always provides naturally rounded edges why the contact points CP9 and CP10 are the only points on the periphery of the wire where the tangents T9 and T10 are in a perpendicular position relative to the bending axis X5. Contact points CP9 and CP10 are located on arcs which makes the bending vulnerable.

In addition to vision and strength, the tapered shape of the wedge wire of the disclosed embodiments also has other properties caused by the uneven distribution of material over the cross-sectional area. The distribution is shown in FIGS. 3*f*-3*k* where an axis y2 drawn through the middle point of the major dimension L1 divides the cross-sectional area into two parts A1 and A2 thus having the same width L1/2. For a wedge wire the area A1 is always smaller than A2 which means that a smaller portion of the wire material is contained in A1 and a bigger portion in A2. The cross-sections of most prior art wires are symmetric in relation to y2 why the corresponding part areas are identical and all properties relative to the y2 axis are identical.

Because of the smaller portion of material contained in A1 it is possible to make bends with a smaller radius in direction of the major axis x compared to the prior wires as disclosed. This enables the use of wide flat wedge wires bended with a small radius in direction of the major axis in places where other solutions have been used as shown in FIGS. 8*a*-8*e*. Such small bending radius is desirable for contour wires in the temple region for instance. The minimum bending radius of a wire depends on the width of the wire in direction of the bending, other dimensions of the wire cross-section, the ductility and micro-structure of the metal and the type of bending tools used. During bending the outside edge of the bend is subject to tension, and the inside edge to compression. The middle part of the wire is a neutral zone. The wider the wire and the more material positioned on the edges, the bigger is the bending moment and the required force.

Also the risk for fractures increases and buckling due to insufficient confining is possible. A wedge wire has less material positioned on one of the edges. For instance on an outside bend this reduces the tensile resistance and enables the material to stretch with smaller risk for fractures. Consequently the material on the inside edge is subject to less compression and a flat surface portion confines the wire against the bending tool.

Figure 8A:
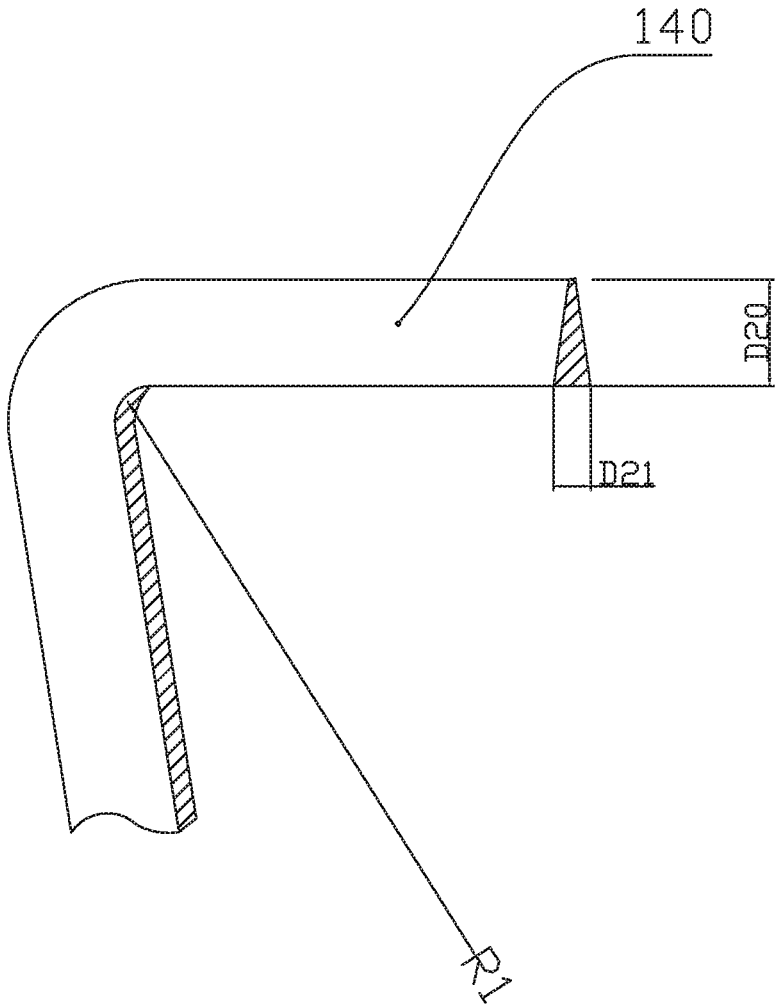
FIG. 8*a* is a side/cross-sectional view showing a detail of a contour wire according to the aspects of the disclosed embodiments bended with a small radius to produce a sharp bend.

FIG. 8*a* shows a side view and the cross-sectional shape of a wide wedge wire 140 incorporating aspects of the disclosed embodiments having a width D20 and thickness D21. The ratio D20/D21 is approximately 2. The base of the wire 140 comprises a flat surface which confines the wire by bending. The wire may be bended or bent with a radius R1 having a value of approximately 0.5×D20 and is easily executed for the metal grades used for face masks. The major material deformation comprises the stretching on the outside bend.

Figure 8B:
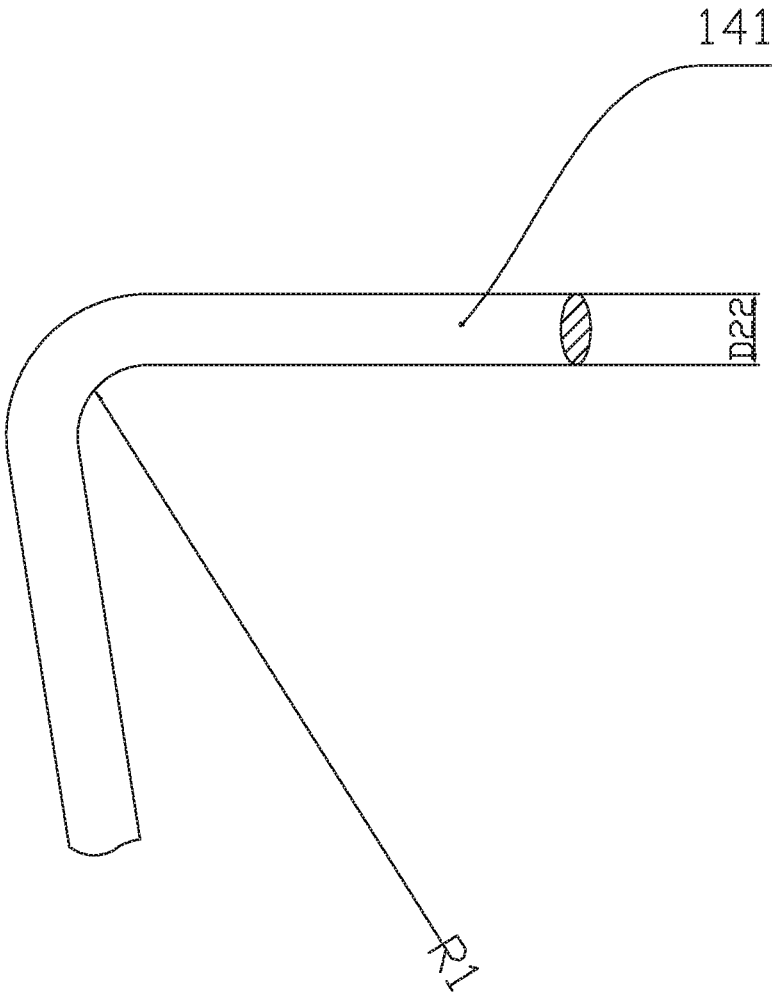
FIG 8b PRIOR ART
FIG. 8*b* is a side/cross-sectional view showing a detail of a prior art round contour wire bended with a small radius to produce a sharp bend.

FIG. 8*b* shows a side view and section of a round wire 141 having a diameter D22 equal to 0.7×D20 of FIG. 8*a*. Because of the smaller width of the wire in the bending direction and more material on the outside edge of the bend the wire can be bended approximately at an equal radius R1 as the wedge wire 140. The deformation comprises stretching on the outside and compression on the inside bend. Though a small bending radius can be achieved the wire 141 provides less strength than the wedge wire and other appearance than wide flat wires in general.

Figure 8C:
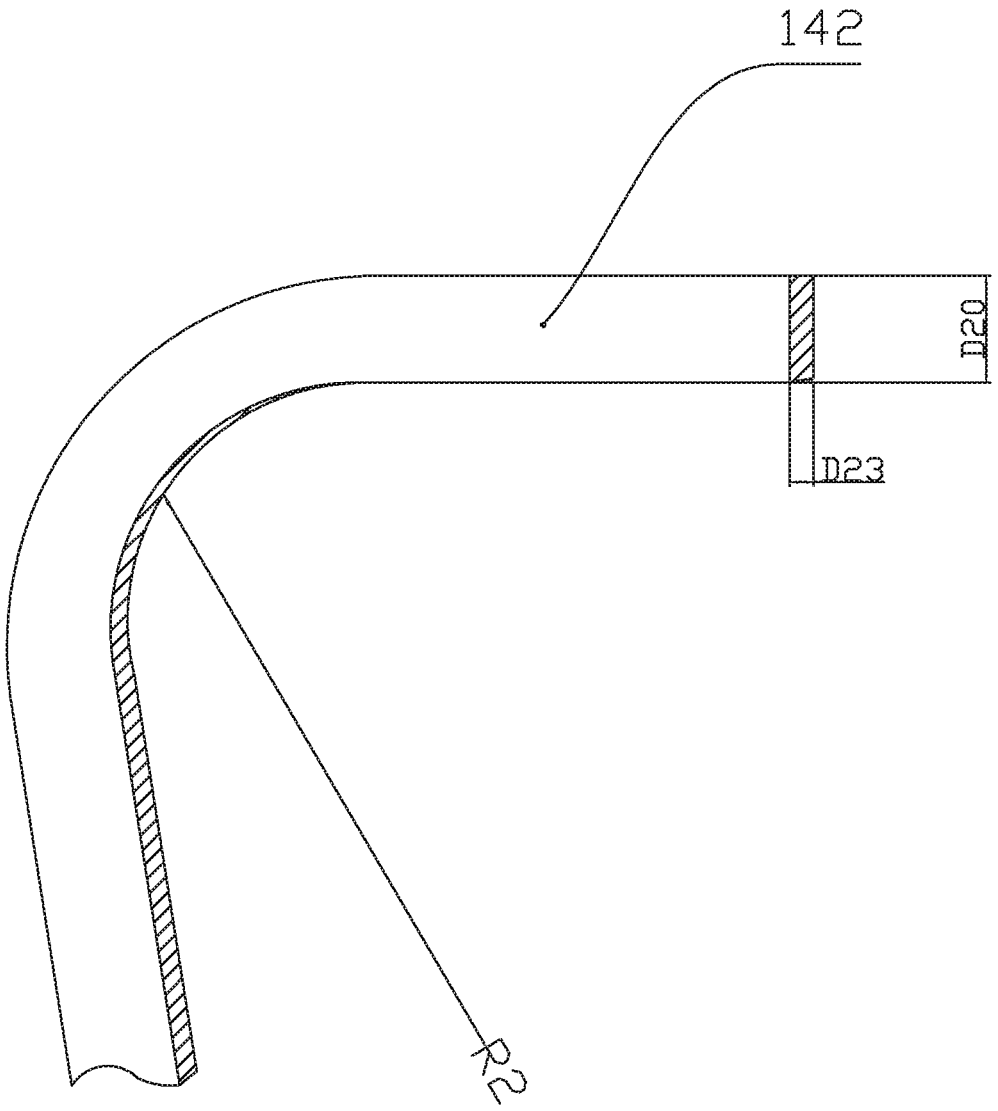
FIG 8c PRIOR ART
FIG. 8*c* is a side/cross-sectional view showing a detail of a flat contour wire bended with a large minimum radius.

FIG. 8*c* shows a side view and section of a rectangular flat wire 142 with a width D20 and a cross-sectional area which are equal to the wedge wire 121 of FIG. 8*a*. The thickness D23 of the wire 142 is thus small, approximately D21/2. The wire can be bended only by a relatively large minimum radius R2 in order to allow for the necessary expansion and contraction of the bend and not to cause fractures or distortion of the thin wire. The bending is demanding and laborious in that the wire must normally be confined in a slot of the bending tool and the expansion of the inside bend may cause the wire to stick into the groove. As a thumb of rule R2 should be at least 3-4 times the width D20 for rigid and less ductile metal grades which are used for face masks. This gives a large minimum bending radius of R2 having a value of 6–8×R1 which is not acceptable in many cases. Because of the low thickness of the flat wire the strength is poor in direction of the minor axis.

Figure 8D:
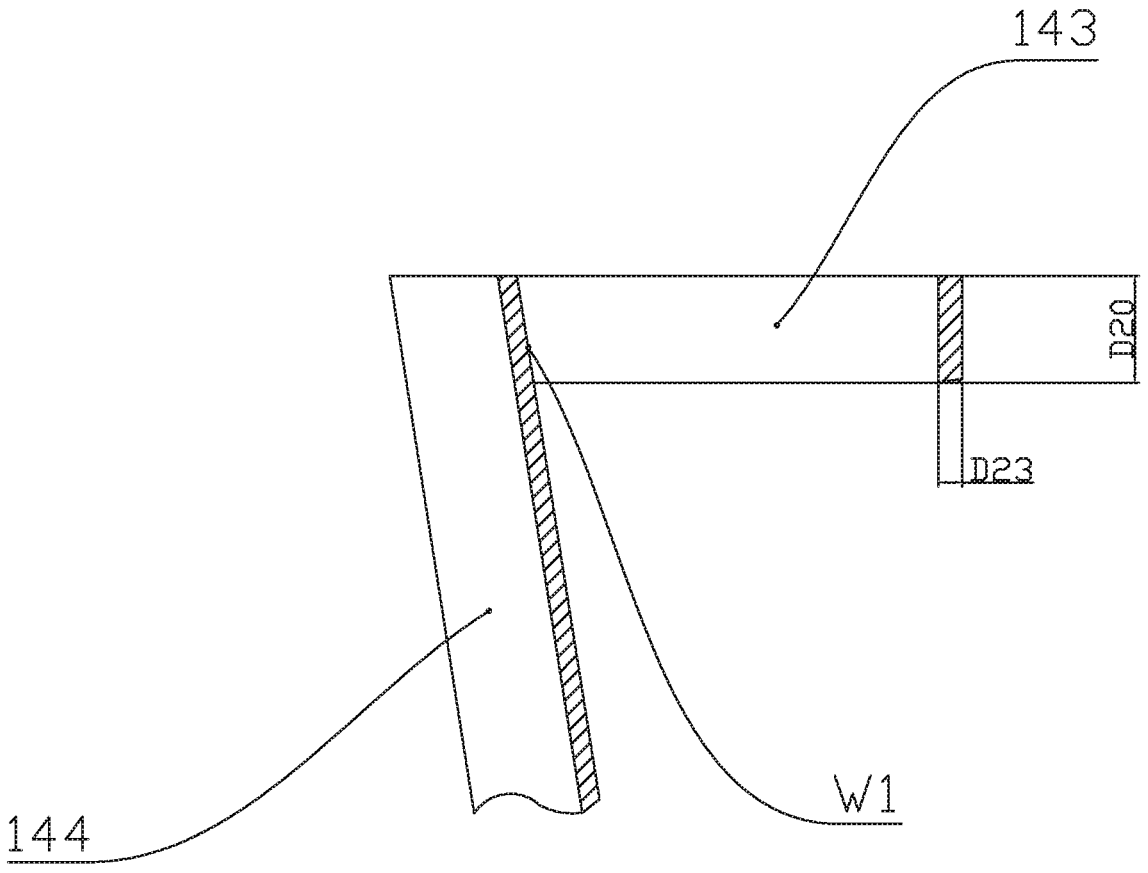
FIG 8d PRIOR ART
FIG. 8*d* is a side/cross-sectional view showing a detail of 2 flat contour wires welded together to produce a sharp bend.

FIG. 8*d* shows an optional solution to create an edge by using prior art flat wires and having a similar shape as a bend with a small radius. The flat wires 143 and 144 have a width D20 and a thickness D23 and are joined by welding W1 to form the desired bend. However the welding requires more work than bending and the appearance of the bend is less attractive.

Figure 8E:
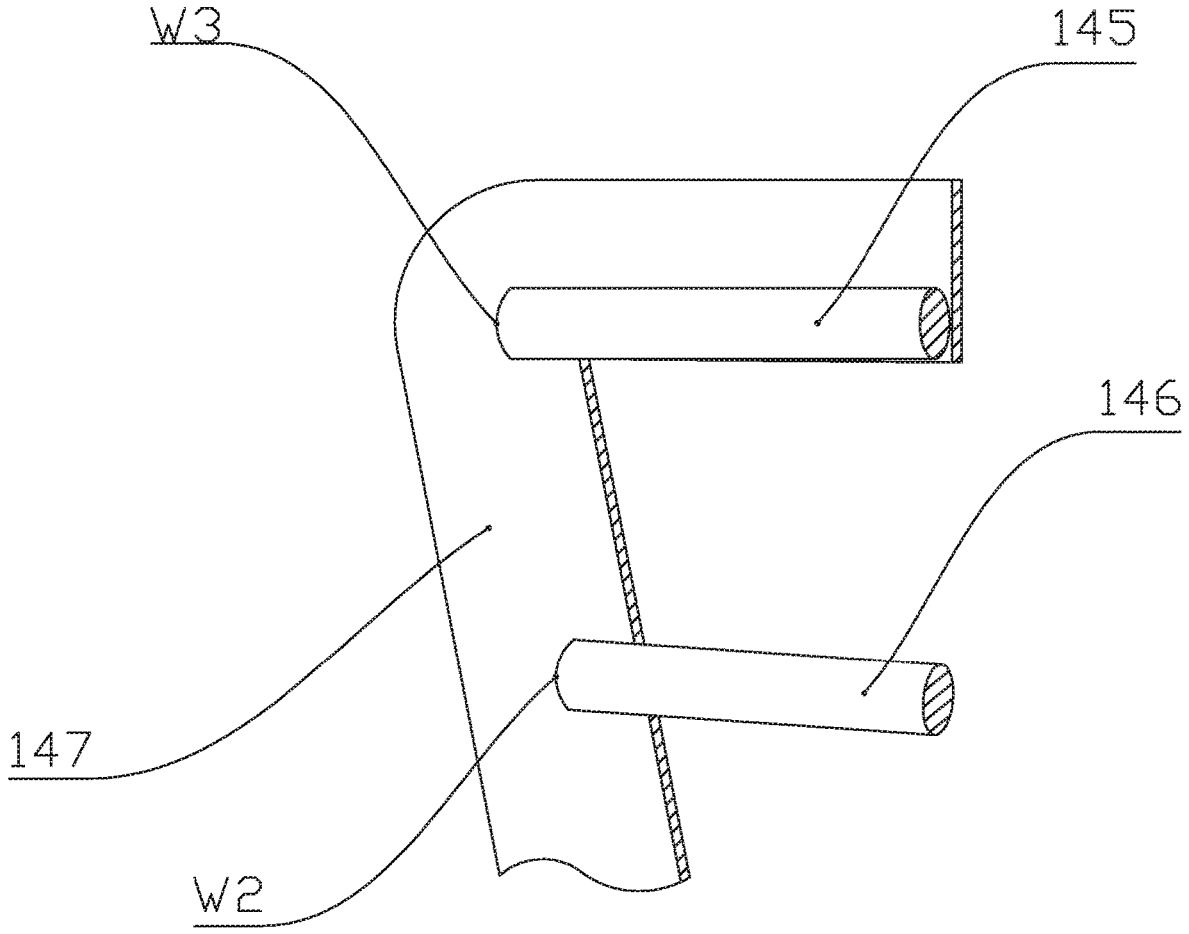
FIG 8e PRIOR ART
FIG. 8*e* is a side/cross-sectional view showing a detail of round wires welded to a cut plate to produce sharp bends.

FIG. 8*e* shows another prior art solution for making a bend by using a cut plate of sheet metal 147 where two round wires 145 and 146 are fastened by weldings W2 and W3. This option requires additional work in that the sheet metal must be cut and formed, and the welding job is extensive. The appearance is bulky compared to FIG. 8*a*.

Figure 9A:
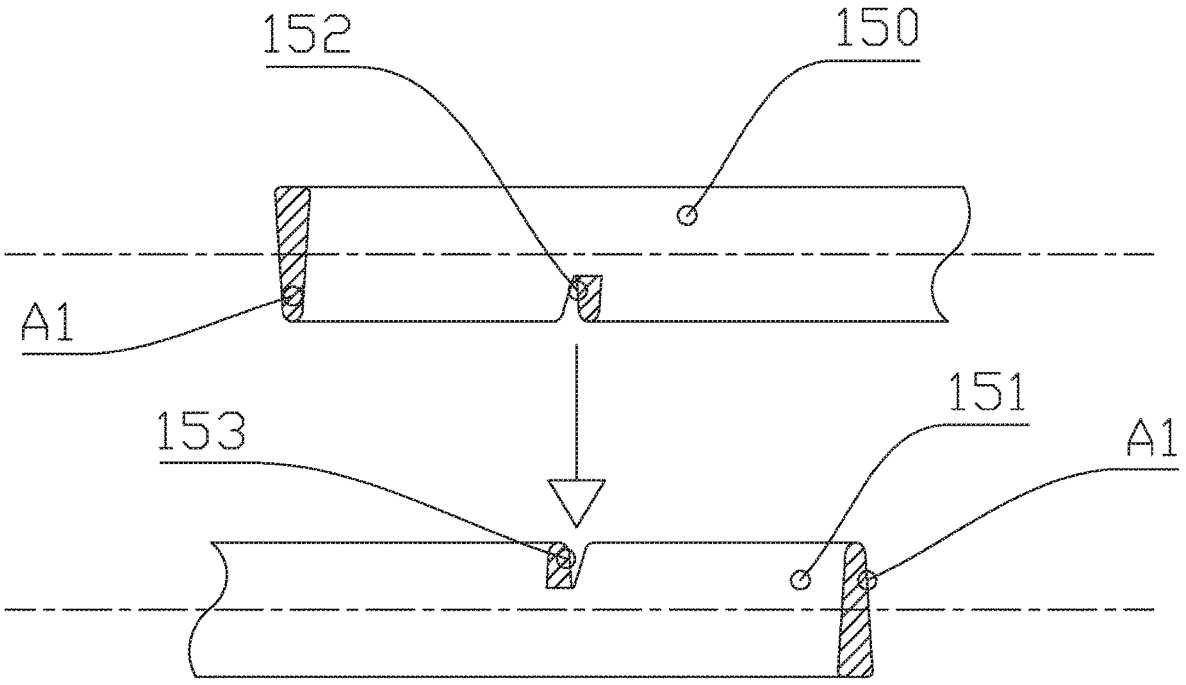
FIG. 9*a* is a side view of two slotted wedge wires to be joined cross-wise.
Figure 9B:
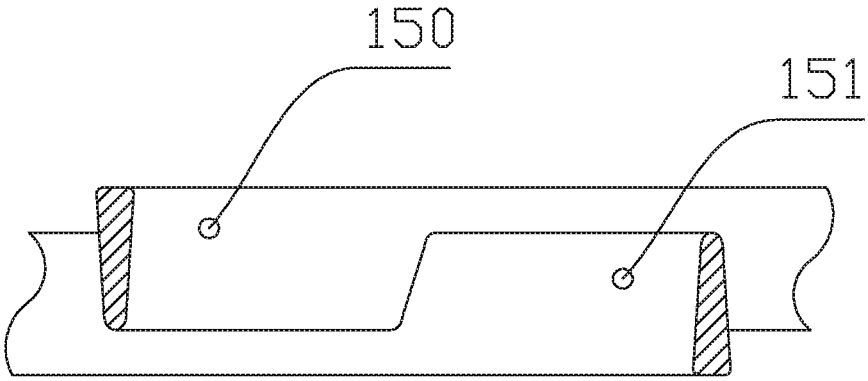
FIG. 9*b* is a side view of the wires of FIG. 9*a* joined cross-wise.

Because of the smaller portion of material contained in the cross-sectional part area A1 of FIGS. 3*f*-3*k* it is also possible to create strong notched joints for face masks as shown in FIGS. 9*a* and 9*b*. In FIG. 9*a* two wedge wires 150 and 151 incorporating aspects of the disclosed embodiments have notches 152 and 153 in the part area A1 of the wire section. The notches are shaped to give a tight fit when joined cross-wise. FIG. 9*b* shows the ready crossing joint where the wires are joined by welding. Such joints are very strong, aesthetically appealing and require less extensive welding (less heat input) than directly welded joints. Also other bonding methods such as chemical bonding or brazing can be used because of the large contact areas of the joint. Because the notches 152 and 153 are in the smaller sectional part area A1 only a small portion of material is removed because of the notch, thus having minor influence on the strength of the notched wires. For a symmetric prior art wire a notch of the same depth will remove a considerably bigger share of the wire cross-sectional area thus creating a weak point in combination with the heat input of the weld.

The most common and cost efficient way to attach wires to each other cross wise is by resistance welding. The joint is formed when the wires melt into each other under pressure to form a welding nugget. The tip of a wedge wire according to the present aspects of the disclosed embodiments can be perfectly shaped to provide a very strong resistance welded joint between two such tips. Because of the narrow tip ends the nugget is formed deeper and stronger with less heat input compared to resistance welded round wires.

Flat Surface Portions:

An essential feature of the wedge wire of the disclosed embodiments is the presence of one or more substantially flat surface portions on the periphery of the cross-section as shown in FIGS. 3*l*-3*p*. A flat surface portion in the base provides the benefits of backing and confining the wire by demanding bending operations in the direction of the major axis. For oval and flattened prior art wires this is not the case because the bending force is applied on rounded surfaces. These wires can be bended with some ease in one position of the major axis only, and even then special attention must be paid to the confining of the wire in order to avoid torsion resulting in twisted or buckled wires.

Furthermore a flat surface provides tight and aesthetically appealing attachment areas between wires or between wires and other elements of the mask, such as sheet metal parts as disclosed. The prior art wires have at most 2 flat surface portions, both on the longer sides of the wire. This highly limits the utilization of flat surfaces in respect to such attachment and such attachments are therefore not found in the prior art face masks.

Further flat surface portions situated in the wedge portion of the wedge wire provide larger contact surfaces for paddings, helmets or brims. This improves both the impact distribution and the friction between both surfaces. The friction improves the steadiness of the face mask attachment.

The width of such flat surface portions may have any dimension. However to ensure the disclosed benefits described herein a substantially flat surface portion should be at least 1 mm wide. If the portion is narrower the benefits may be faded out due to material roughness or defects. When applicable larger widths such as 2 mm, 3 mm or 4 mm may be used for the base to provide the mentioned benefits. The sides of the wedge may comprise flat surfaces with longer widths limited only by the cross-sectional dimensions of the wedge wire. The whole base or side of the wedge portion may comprise a flat portion.

As shown in FIGS. 3*l*-3*o* different numbers of flat wire portions F1-F4 are provided by different sectional shapes of the wedge wire. The total number of flat portions is normally below 4 while a bigger number may not bring any additional advantages and increases the manufacturing costs. All shapes provide at least one flat surface portion F1 in the base which is essential for the improved bending operations, for the production of many double bars and other joints between wires such as T-joints. For the wire of FIG. 3*p* F1 is the only flat portion. The presence of two substantially flat surface portions F2 and F3 in the wedge portion shown in FIGS. 3*l*-3*o* is normally provided by rolling the wire with two flat rolls on opposite sides of the wire. FIG. 3*n* shows a wire with a flat portion F4 in the tip. The presence of one flat surface portion in the base and two flat portions in the wedge is sufficient for most embodiments.

A substantially flat surface portion may in some cases be replaced by a concave surface which arches against the center of the wire cross-section. The straightened width of such concave surface corresponds to the widths given for the substantially flat surfaces above. A concave base portion may provide the same benefit as a flat surface in respect to bending in that the concave portion provides two contact points with a bending tool with a flat surface. This confines the wire in contrast to the rounded wires which only provide one contact point. However concave surfaces are not superior to flat surfaces in this respect, and the use of such surfaces may arise from other reasons than bending, such as optional manufacturing methods of the wedge wire or further attempts to optimize the weight/strength ratio of the face mask. For instance a larger wedge wire may be manufactured from plate or tube using press brakes or die presses. By such procedures concave surfaces may be formed naturally. The interior of such wires is hollow which would decrease the weight of the wire.

Wedge wires of the disclosed embodiments with flat surface portions may be joined together longitudinally in several ways to provide double bars. The flat surfaces provide easier welding procedures because of the large contact area between the wires and easily accessible welding areas. Very strong bonds can be made with minimum heat input and without the use of filler material by TIG welding. Alternative bonding methods such as brazing, laser welding or chemical bonding may also be used. The rounded surfaces of the prior art wires on the other hand have narrow contact areas why TIG weldings with more heat input and use of filler material is required whereby the appearance of the weld suffers and the hardened metal becomes more ductile.

The individual wires forming the double wire may be attached to each other over the whole length of the wire or only partly, whereby the individual wires may be branched at the ends of the double bar portion comprising single wires of the face mask grill. This and the good bending properties of the wedge wire enables the use of new wire lay-outs and the optimizing of vision, weight and strength properties in different parts of the mask.

Figure 10A:
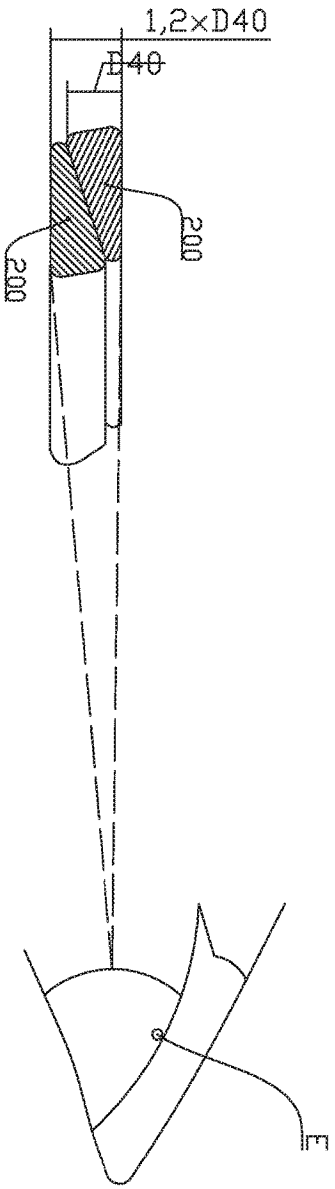
FIG. 10*a* is a cross-sectional view of two identical wedge wires joined to form a strong double wire with a small obstruction of vision of the user.

As shown in FIGS. 10*a*-10*d* a double bar portion in the field of view may provide a much smaller obstruction of vision compared to any prior art double bar. FIG. 10*a* shows two identical wedge wires 200 of the disclosed embodiments having a dimension D40 in direction of the minor axis and welded longitudinally together with opposite orientations. The double bar is positioned and oriented to protect the eyes E of the wearer of the mask against possible impacts from a substantially horizontal direction. The total obstruction of vision for the double bar comprises approximately 1.2×D40.

Figure 10B:
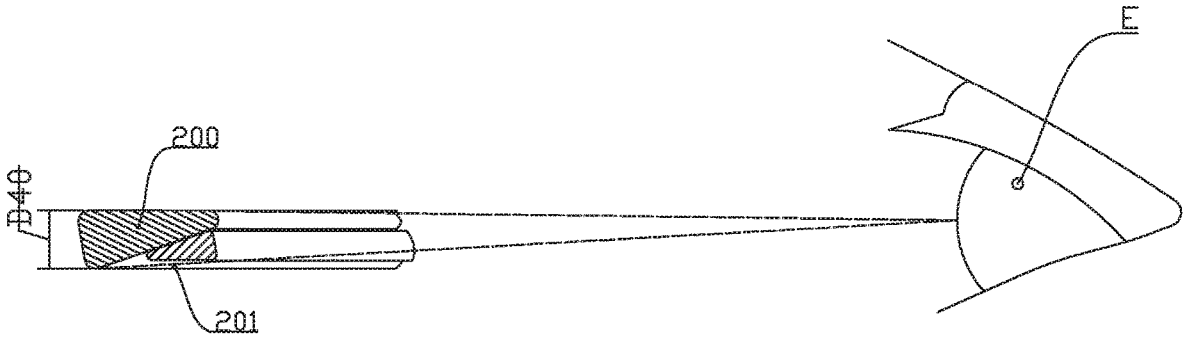
FIG. 10*b* is a cross-sectional view of two different wedge wires joined to form a strong double wire with a smallest obstruction of view for the user.

FIG. 10*b* shows a first wedge wire 200 and a smaller, but substantially identical wedge wire 201, incorporating aspects of the disclosed embodiment, which have been joined in the same way as described with respect to FIG. 10*a* to form a strong but somewhat weaker double bar. When the double bar has the same orientation and position in relation to the eyes E and impacts as the embodiment of FIG. 10*a*, the obstruction of vision is equal to D40, which is equal to a single wedge wire 200 incorporating aspects of the disclosed embodiments.

Figure 10C:
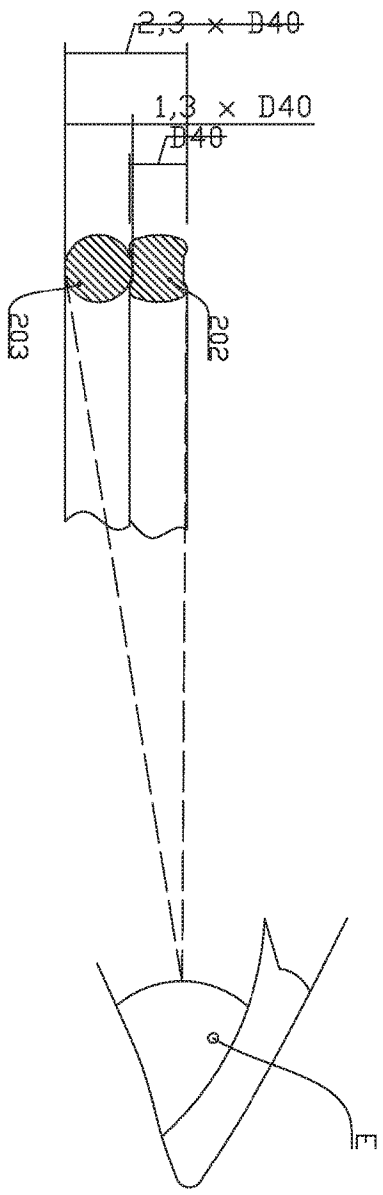
FIG 10c PRIOR ART
FIG. 10*c* is a cross-sectional view of prior art round and I-shaped wires joined to form a strong double wire with a big obstruction of view for the user.

FIG. 10*c* shows a prior art flattened rectangular wire 202 (see FIG. 1*d*) and a round wire 203 welded together longitudinally to form a double bar in an identical position in relation to the eyes as FIG. 10*a*. The wire 202 has the same dimension D40 in the direction of the minor axis and the same cross-sectional area as the wedge wire 200. The round wire 203 has the same cross-sectional area as the wedge wire 200, and a diameter of approximately 1.3×D40. The overall obstruction of vision is thus 2.3×D40, which is considerably more than the obstruction of the double bar of FIG. 10*a*. The strength of the double bar in direction of a horizontal impact is lower compared to the double bars of both FIGS. 10*a* and 10*b*.

Figure 10D:
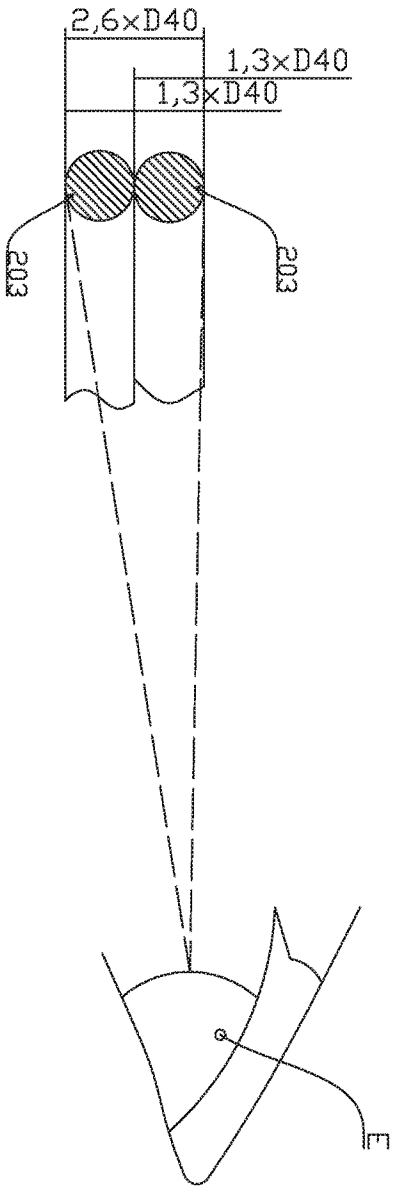
FIG 10d PRIOR ART
FIG. 10*d* is a cross-sectional view of two prior art round wires joined to form a strong double wire with a big obstruction of view for the user.

FIG. 10*d* shows two prior art round wires 203 welded together longitudinally to form a double bar in an identical position in relation to the eyes as FIG. 10*a*. The wires 203 have the same cross-sectional area as the wedge wire 200, and a diameter of approximately 1.3×D10. The overall obstruction of vision is thus 2.6×D10, which is more than the double compared to the wedge wires 200 of FIG. 10*a*. The strength of the double bar in direction of a horizontal impact is lower compared to the double bars of both FIGS. 10*a* and 10*b*.

A way to join two wires incorporating aspects of the disclosed embodiments to form a double bar in the field of view of the user is shown in FIGS. 10*a*-10*c* where a very strong bar is required vertically in the center of an ice-hockey goalie mask. The bar is visible for both eyes of the wearer at opposite viewing angles, which is why the obstruction of vision should be as small as possible. The joints between the center bar and the contour wire especially in the top end of the bar is subject to very high impact loads why special attention must be paid to ensure the strength of the joint and the contour wire in this area.

Figure 11A:
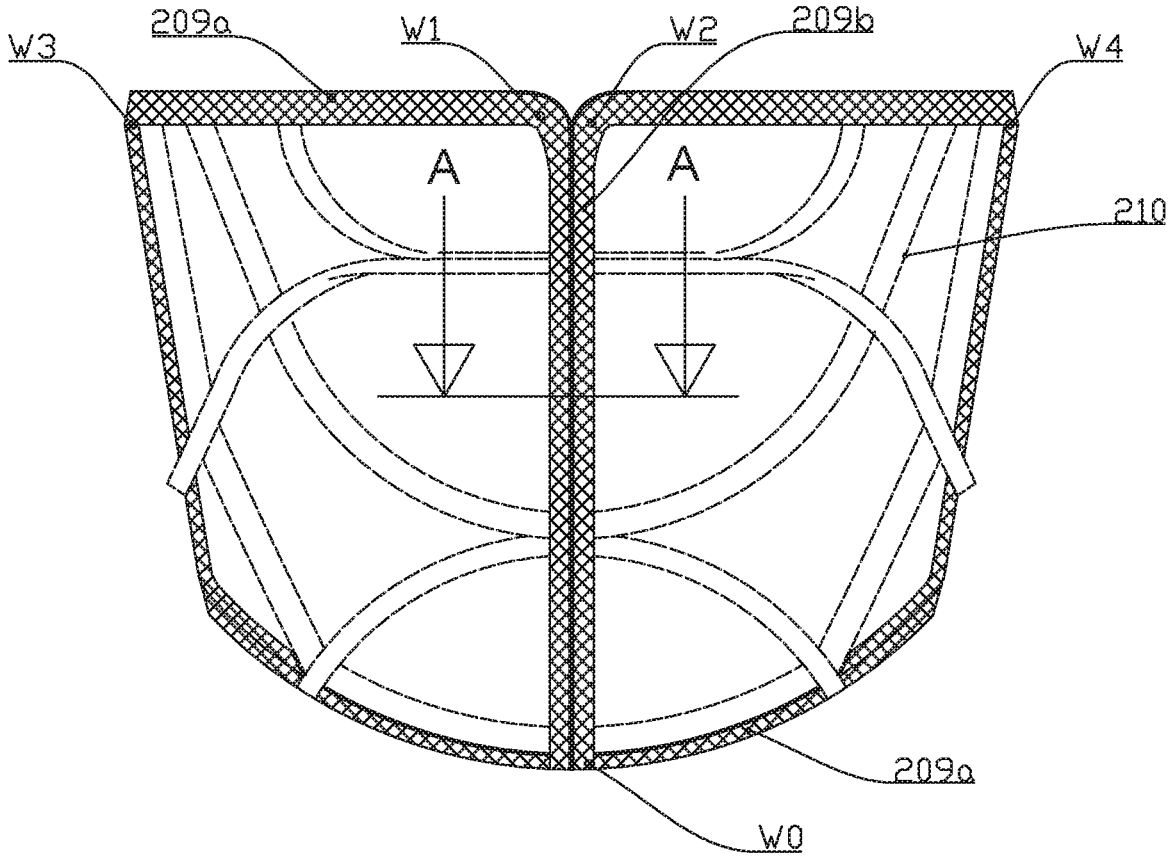
FIG. 11*a* is a front view of a hockey goalie face mask with a central vertical bar formed by two wedge wires which are branched and extended to form a contour wire.

FIG. 11*a* shows a face mask 210 incorporating aspects of the disclosed embodiments. The mask 210 includes a single long wedge wire of the disclosed embodiments comprising two parts. The middle part of the wire forms a contour wire 209*a* and both end parts are joined longitudinally to form a vertical double bar 209*b*. The only required welding joint is W0 where the contour wire 209*a* and the lower end of the double bar 209*b* are joined. The wire comprises bends with a small radius at the points W1-W4. This is a typical example how the structural features of a wedge wire of the disclosed embodiments can be utilized to create details with different functions and furthermore manufactured quickly with proper tooling and with a minimum of welding work. The contour wire of the disclosed embodiments provides many benefits as disclosed herein and the double bar provides a shape with excellent vision/weight/strength properties.

Figure 11B:
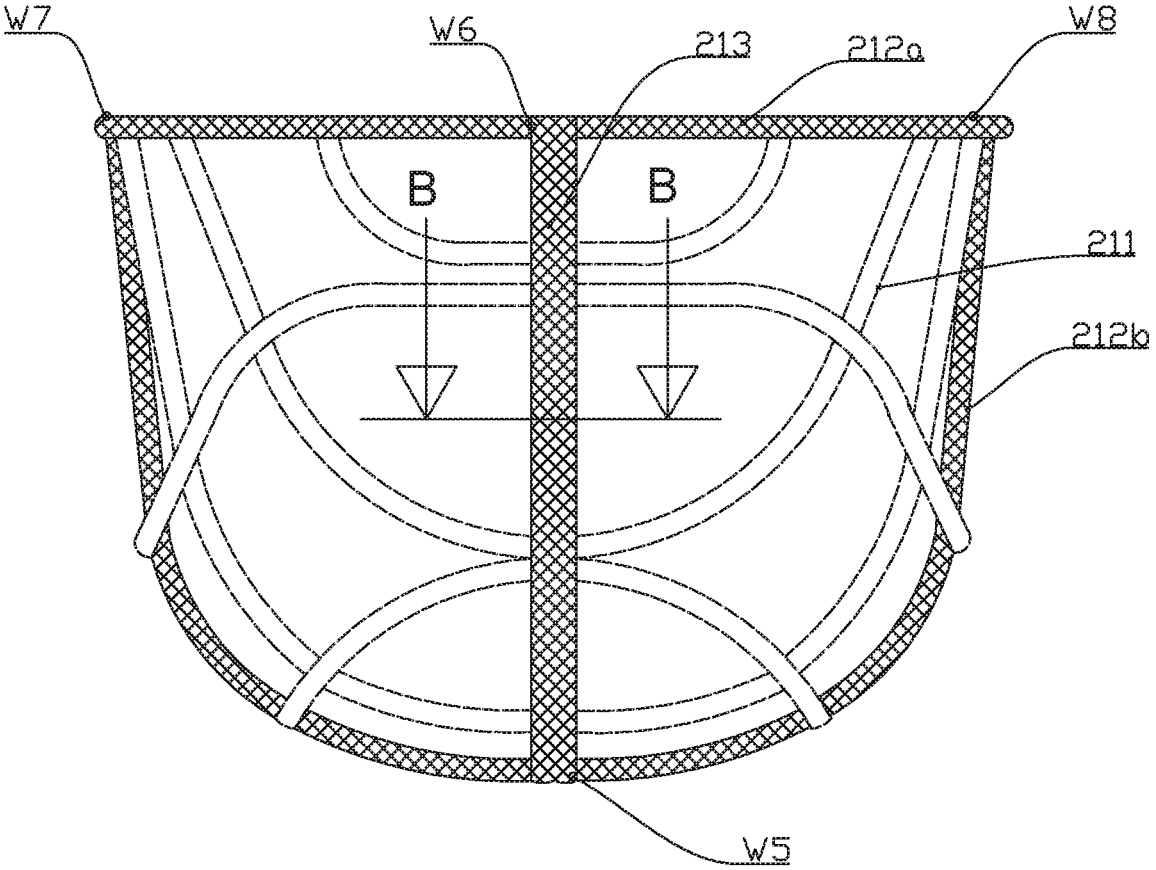
FIG 11b PRIOR ART
FIG. 11*b* is a front view of a prior art ice-hockey goalie face mask with a central vertical bar welded to a separate contour wire.

FIG. 11*b* shows a corresponding construction for a prior art face mask 211. The contour wire is made of two parts 212*a* and 212*b* joined by welds W7 and W8. A thick vertical center bar 213 is welded at two points W5 and W6 to the contour wire. The welding work is comprehensive and jigs or fixtures are required. The thick center bar increases the weight of the mask.

Figure 11C:
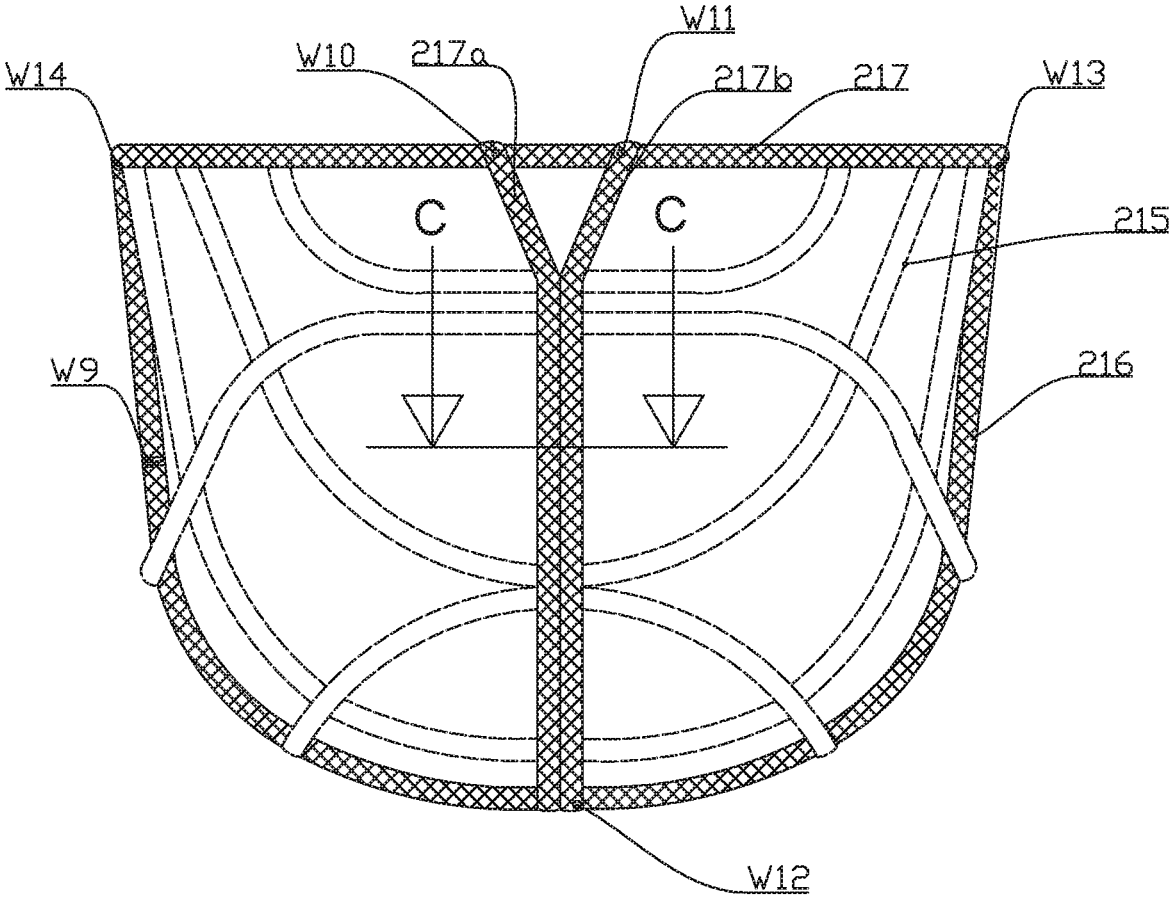
FIG 11c PRIOR ART
FIG. 11*c* is a front view of a prior art hockey goalie face mask with a central vertical wire formed by two round wires which are welded to a separate contour wire.

FIG. 11*c* shows another corresponding construction for a prior art face mask 215. The contour wire 216 comprise a single round wire butt welded at point W9. A vertical center bar comprises two round wires 217*a* and 217*b* which are joined longitudinally and branched at the top. The center bar is welded to the contour wire at points W10, W11 and W12. The contour wire comprises bends with a small radius at the points W13 and W14. The branches of the center bar distributes its impact load on the two points W10 and W11 of the contour wire. Because of the round shape of bars 217*a* and 217*b* the vertical double bar will be wide which is not optimal for vision. The bar is also weaker in the direction of the impact and heavier compared with the mask of FIG. 11*a*.

Figure 12A:
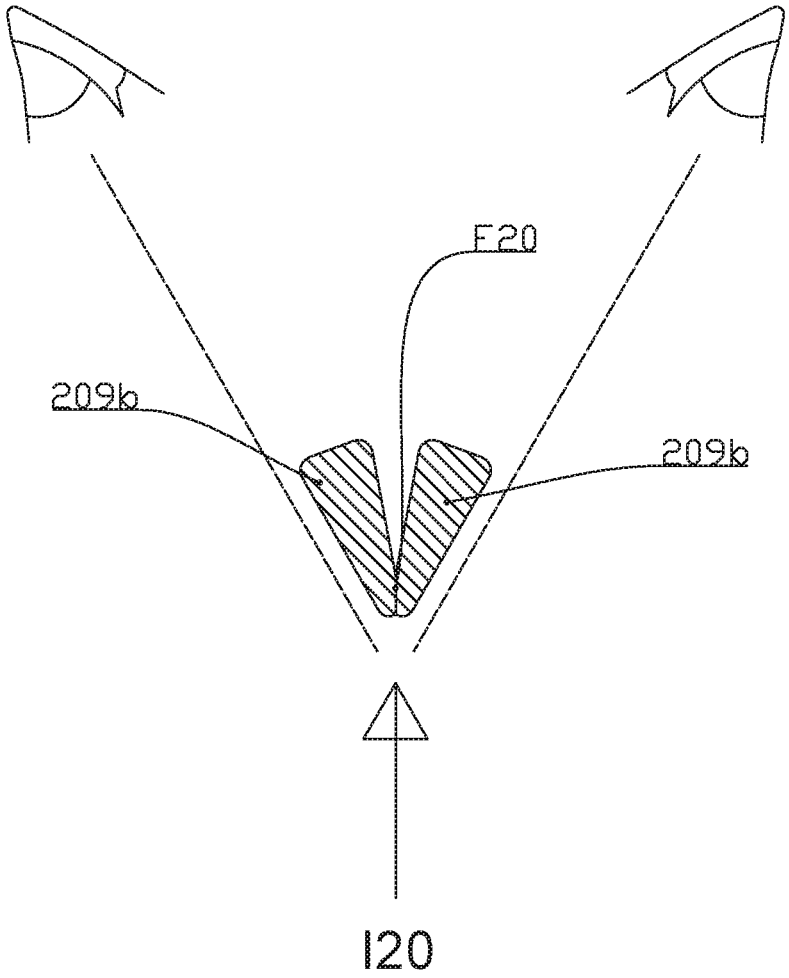
FIGS. 12*a*-12*c* are cross-sectional views of three optional central vertical bars of the face mask according to FIG. 11*a*.
Figure 12B:
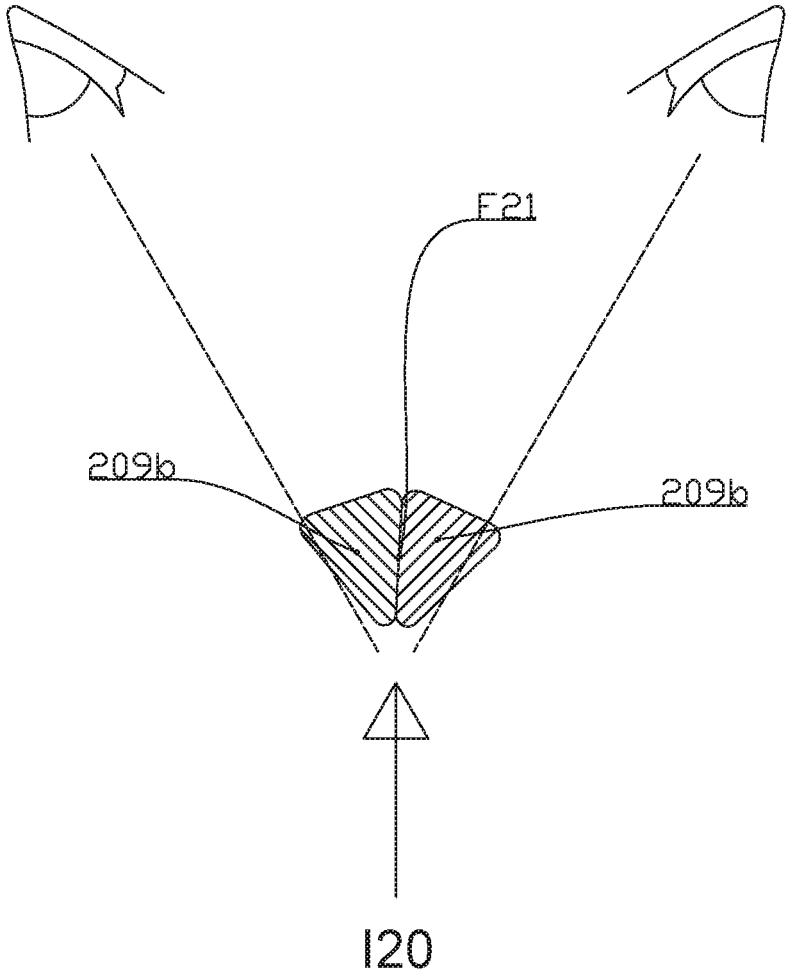
Figure 12C:
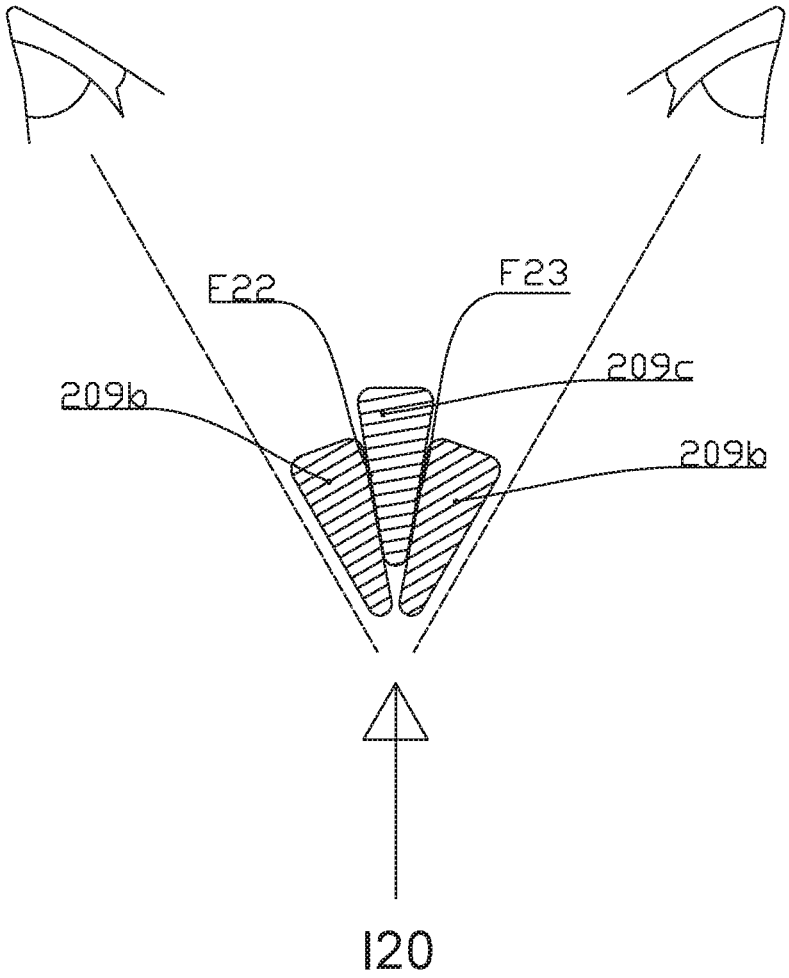

FIG. 12*a*-12*c* shows horizontal cross-sections A-A of three different examples of the vertical double bar of FIG. 11*a* comprising the parts 209*b* of a wedge wire. In FIG. 12*a* the joined parts of the wire comprise a flat surface which enables a large interface area F20 along the longitudinal joint of the formed double bar. The V-shaped double bar gives a small obstruction of vision in the viewing directions of both eyes, and high strength in the direction of the maximum impact I20 and also in the side direction.

In FIG. 12*b* the joined parts of wire 209*b* comprise a flat surface which enables an even larger interface area F21 of the formed double bar. The V shaped double bar gives similar vision and strength properties as the bar of FIG. 12*a*.

In FIG. 12*c* a separate additional wire 209*c* has been joined by welding to the parts of wire 209*b* in order to increase the strength of the formed triple bar. The additional wire 209*c* may have any length to provide for instance additional strength in the most vulnerable parts of the center bar. The flat surfaces of the wires enable large interface areas F22 and F23 of the triple bar. The V shaped triple bar provides more strength than the double wires of FIGS. 12*a* and 12*b* without increasing the obstruction of vision.

Figure 12D:
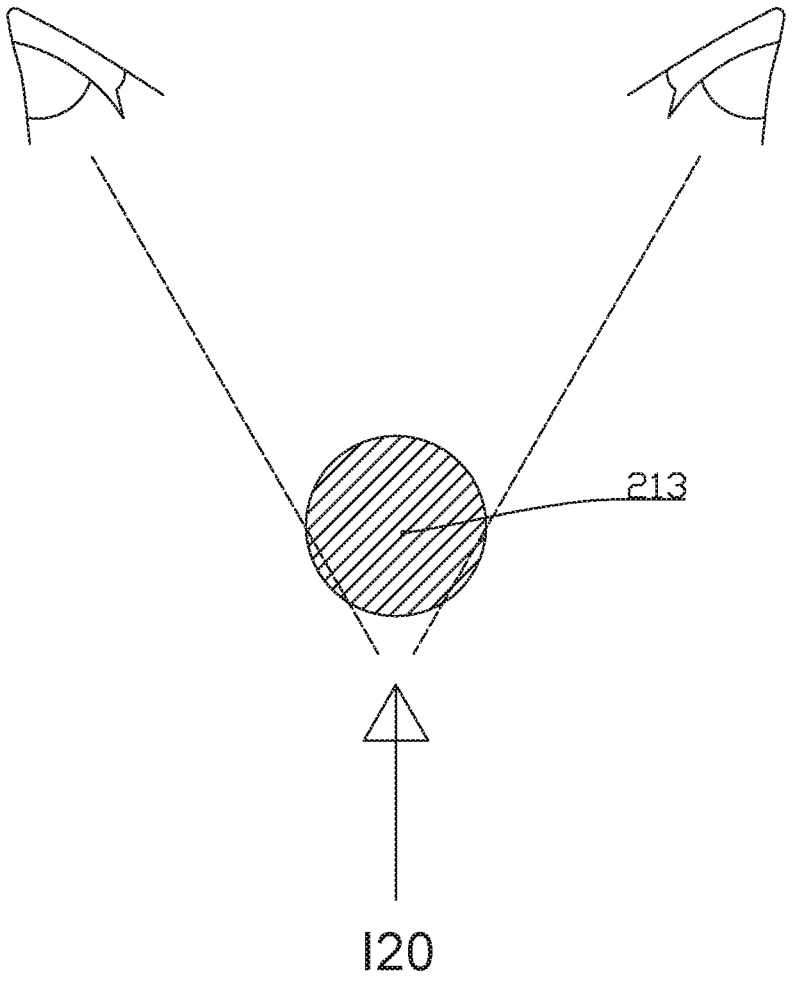
FIG 12d PRIOR ART
FIGS. 12*d*-12*e* are cross-sectional views of two optional central vertical bars of the face mask according to FIG. 11*b*.
Figure 12E:
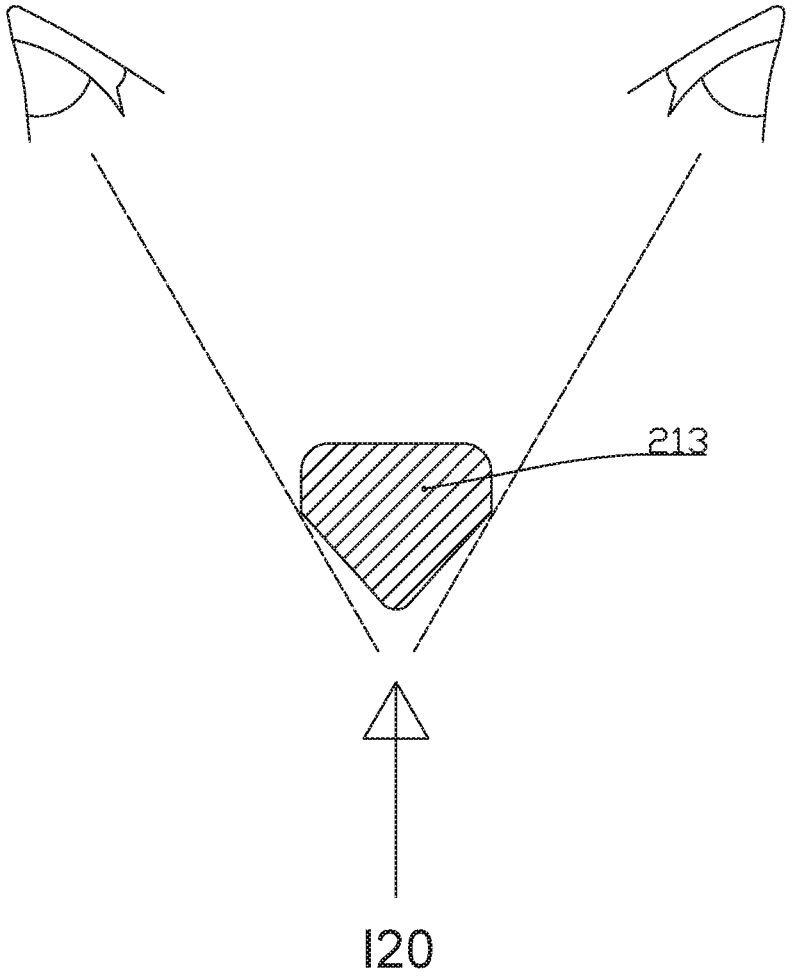
FIG 12e PRIOR ART

Two optional horizontal cross-sections B-B of the prior art vertical bar 213 of FIG. 11*b* are shown in FIGS. 12*d* and 12*e*. The bar 213 of FIG. 12*d* is a round bar. To provide the same strength as the double bar of FIG. 12*a* the bar 213 must have a thickness which generates approximately 20% more mass to the bar and a larger obstruction of vision.

The bar 213 of FIG. 12*e* is shaped to give higher strength in direction of the highest impact I20 compared to a round bar. The downsides of such a bar is the high manufacturing cost as described for FIG. 1*e* and the high weight compared with the bars of FIGS. 12*a*, 12*b* and 12*c*.

Figure 12F:
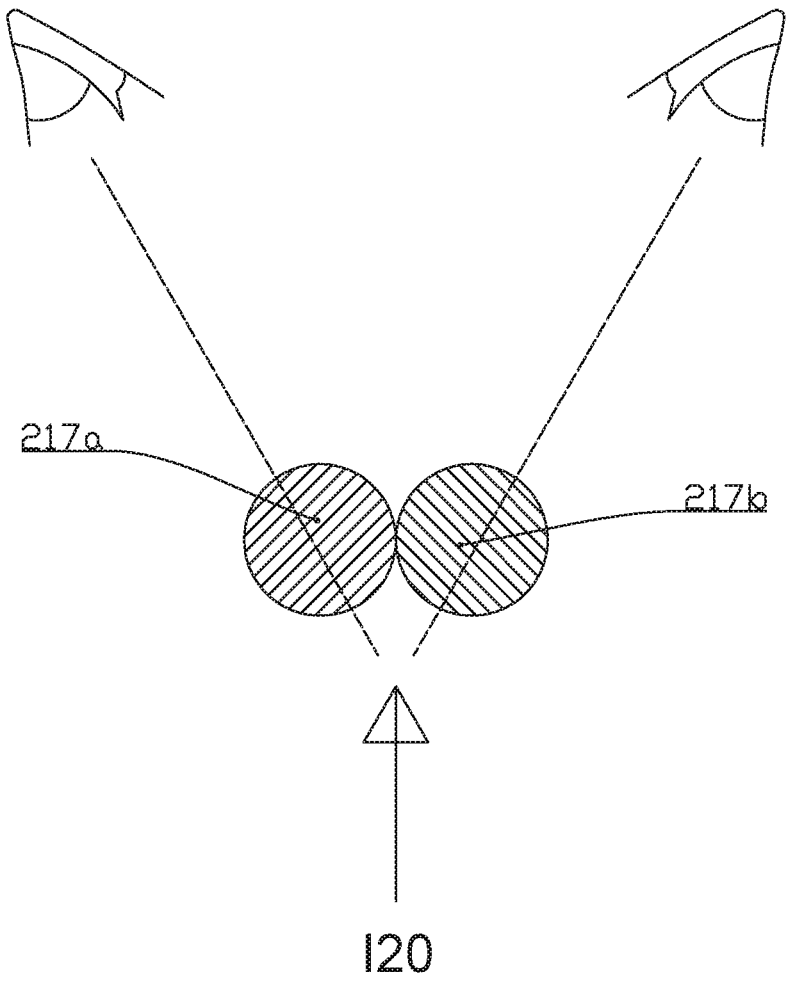
FIG 12f PRIOR ART
FIGS. 12*f*-12*g* are cross-sectional views of two optional central vertical bars of the face mask according to FIG. 11*c*.
Figure 12G:
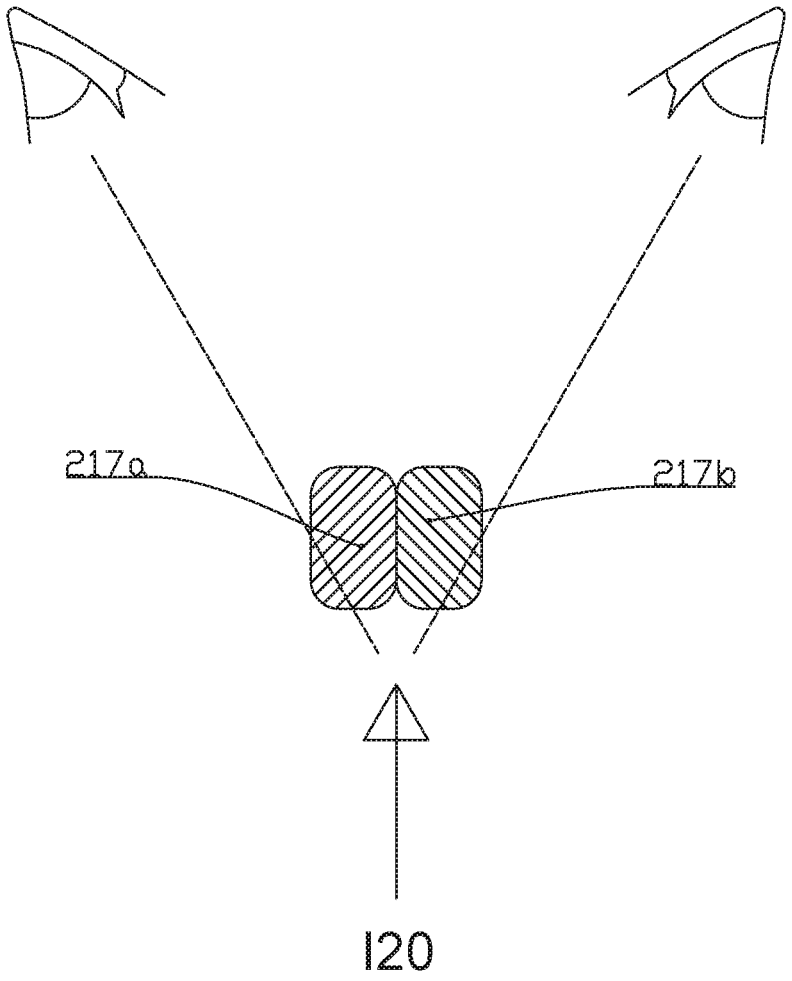
FIG 12g PRIOR ART

FIG. 12*f*-12*g* shows horizontal cross-sections C-C of two prior art examples of the vertical double bar of FIG. 11*c*, comprising the wires 217*a* and 217*b*. The wires 217*a* and 217*b* and are joined longitudinally to provide the strong double bar. FIG. 12*f* shows round wires. To provide the same strength as the double bar of FIG. 12*a* the wires 217*a* and 217*b* must have a thickness which generates approximately 70% more mass and a considerably larger obstruction of vision FIG. 12*g* shows flattened rectangular wires 217*a* and 217*b* which form a double bar with better vision/strength ratio compared to round wires. However the obstruction of vision and the weight is bigger compared to the double bar of FIG. 12*a* if the same strength of the bar is to be provided.

A solid cross-section of the prior art wires have poor rigidity in relation to the cross-sectional area which means that more material and weight is required to provide the same rigidity as provided by several cross-sectional shapes used for structural steels. Such shapes are for instance hollow sections, angles (L-shapes), channels (U- or C-shapes), I-beams (I- or H-shapes) and tees (T-shapes). Each shape has its own characteristics, benefits and downsides, and they are used to create structures with very high strength in relation to the mass. The prior art wire of FIG. 1*d* has an I-shape and the wedge wire may in many cases comprise a form of T-shape.

The calculation of the strength of a certain wire of a face mask is complex, taking in account among other things the sectional shape (area, bending moment and moment of resistance), supporting points of the wire and the material characteristics. To compare the strength of different sectional shapes of face mask wires it is therefore sufficient to know the main characteristics provided by each shape.

The utilization of sections used for structural beams for face mask wires has been very limited because of several reasons. The cross-sectional area of the wires used in face masks are very small compared to structural beams why ideal sectional shapes are difficult and expensive to manufacture. The shape itself may cause some disadvantages. A hollow shape for instance may comprise a bigger outer size (obstruction of vision) compared to a solid shape, and may have a small wall thickness subject to buckling by impact. It may also be a disadvantage that such specific section is provided for the whole length of a wire though needed only for a portion of the wire as disclosed.

L-, U- and T-shaped cross-sections provide very high and variable rigidity in different directions. They also provide corner surfaces and a low structural depth in many cases. These features may be utilized for certain face mask wires where high strength is required and for backing up other elements of a headgear such as helmets, brims, paddings or other wires. A big obstacle for the use of substantially L- and U-shaped wires is the bending process. Well predictable and easily achieved bending is not possible, especially because the bending normally takes place in other directions than the axis of symmetry. This is because of the internal stresses and strains set up in the material by the manufacturing of the shaped wire and the uneven distribution of material in the cross-section of the wire. Therefore there is a big risks for twisting and distortion of the wire by bending and the minimum bending radius must be large to prevent fractures. Even if the bending may be accomplished it will require high expertise, sophisticated tools, corrective bendings, more time and costs compared to the bending of conventional wires when bent in direction of the axes of symmetry.

However such bending problems can be avoided by a novel manufacturing process as disclosed: L-, U- or T-shaped wires of a face mask may be manufactured from two or three individual wires which are first bended and after that joined to form a double or triple bar with the wanted cross-sectional shape. The pre-bended wires may comprise wedge wires, which are perfectly suited and provide a lot of variation. Also prior art wires such as flat wires, cut sheet metal or round wires may be used in some special cases. The individual wires are bended in achievable directions such as the major or minor axes or cut from plate. The shape of the bars is not limited to exact L-, U- or T-shapes but also close by shapes such as C- or V-shapes or configurations between all these shapes may provide similar benefits. The individual pre-bended wires or cut plates may be joined together in different ways to provide the wanted shape as disclosed. The flat surfaces of the wedge wires play an important role for the production of continuous and firm longitudinal joints providing strong and aesthetically good shaped bars. A few examples of this are shown in FIGS. 13*a*-13*i*.

Figure 13A:
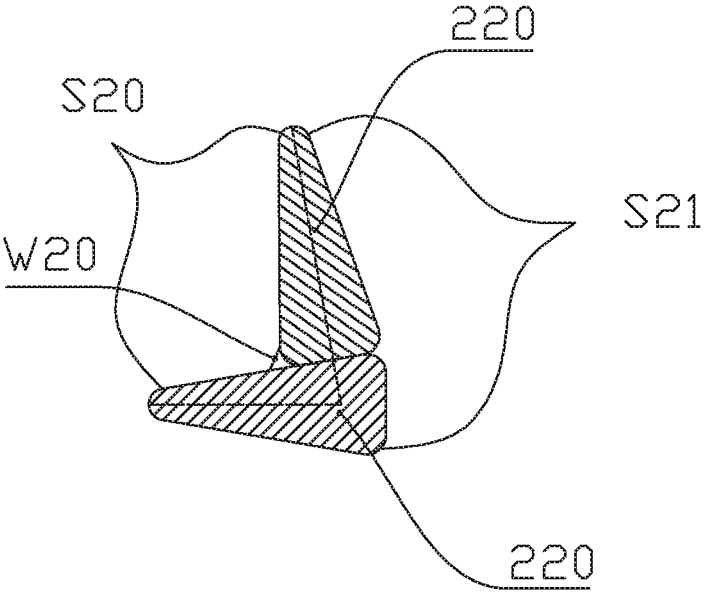
FIGS. 13*a*-13*c* are cross-sectional views of three examples of L-shaped bars made of two wedge wires incorporating aspects of the disclosed embodiments.

FIG. 13*a* shows two identical wedge wires 220 welded (W20) spot wise or continuously longitudinally to provide a very strong L-shaped bar with a corner surface S20 and a normally visible aesthetically fine surface S21. The corner surface S20 may for instance lean against an edge of a helmet or a brim for improved back up of the face mask and protection of the headgear.

Figure 13B:
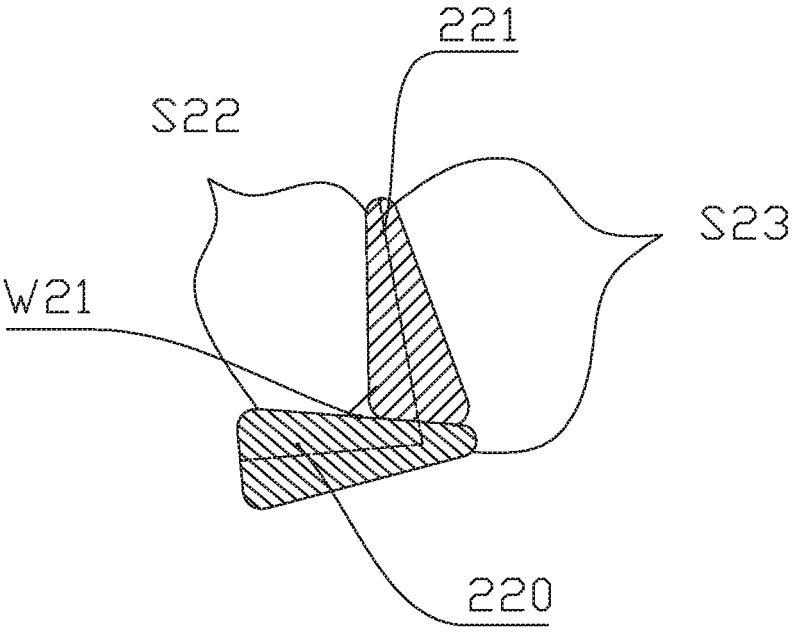

FIG. 13*b* shows the wedge wire 220 of the disclosed embodiments welded (W21) to another wedge wire 221 to provide an L-shaped bar with a corner surface S22 and a visible surface S21. The angle of the corner surface is somewhat smaller and the surface S21 is narrower compared to FIG. 13*a* showing options.

Figure 13C:
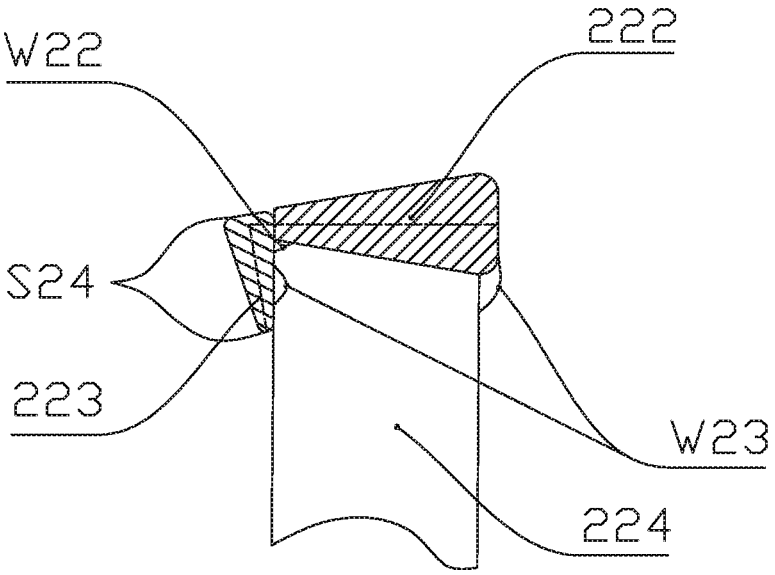

FIG. 13*c* shows a wedge wire 222 of the disclosed embodiments with a flat tip welded (W22) to a smaller wedge wire 223 to increase the strength especially vertically. The wire may be located in the field of view providing more vertical strength without increasing the obstruction of vision. Hereby the side S24 of the wedge wire 223 is visible on the outside of the mask. Furthermore there is a vertical wedge wire 224 welded (W23) perpendicularly to the wires 222 and 223. The edge of this wire is shaped to fit to corner surface provided by the two other wires. All welds are hidden on the inside of the mask and not visible on the outside. The construction provides very high strength in all directions, good aesthetics and a small obstruction of vision.

Figure 13D:
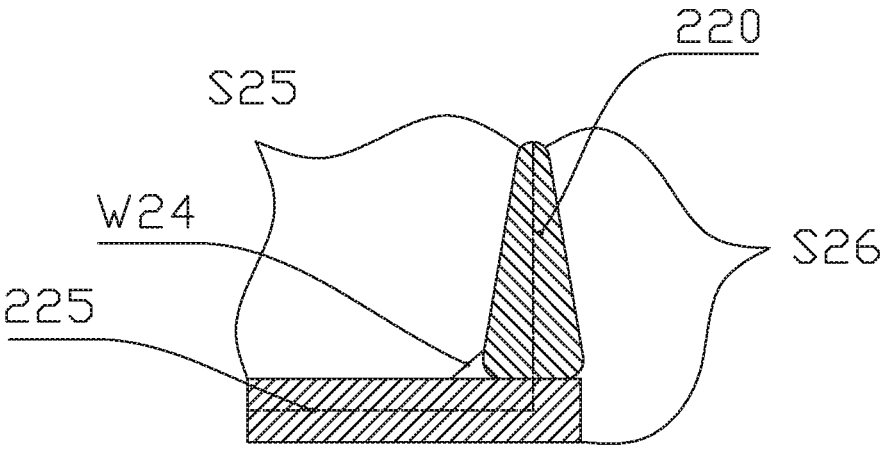
FIG. 13*d* is a cross-sectional view of an L-shaped bar made of one wedge wire and one flat wire.

In FIG. 13*d* one wedge wire has been replaced by a flat wire 225 and welded (W24) to the wedge wire 220 to provide an L-shaped bar. The flat wire may be cut to its exact shape from sheet metal whereby bending operations in direction of the major axis are not necessary. A corner surface S25 and a visible surface S26 are provided.

Figure 13E:
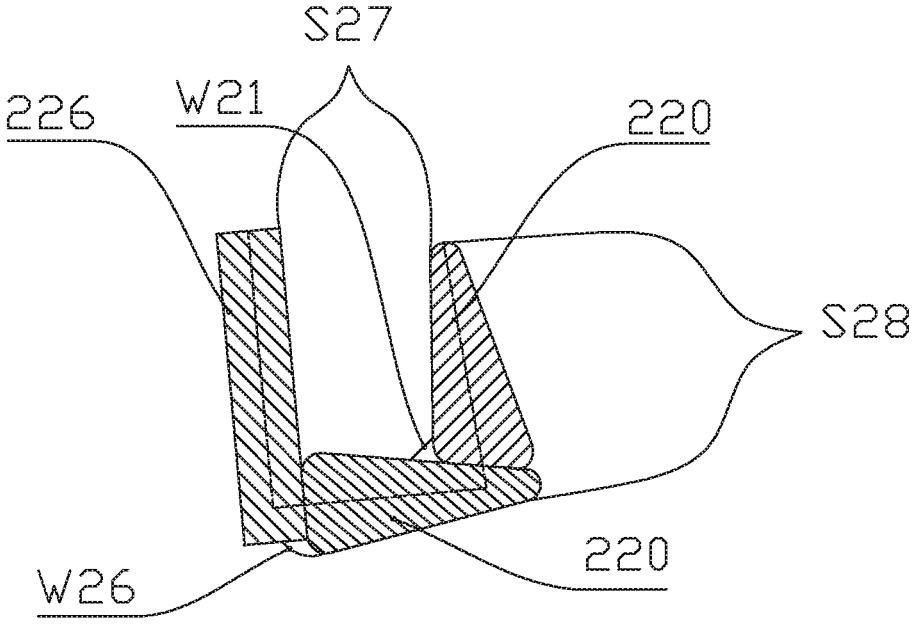
FIG. 13*e* is a cross-sectional view of a U-shaped bar made of two wedge wires and one flat wire.

FIG. 13*e* shows the construction of FIG. 13*b* with an additional flat wire 226 which is welded (W26) in a position to form an U-shaped groove S27 which may provide a steady attachment of the face mask to the edge of a helmet. The length and location of the groove(s) may be adapted to provide one or multiple attachment points in suitable places of the mask, replacing clips or other attachment hardware. S28 comprises the visible surface in this case.

Figure 13F:
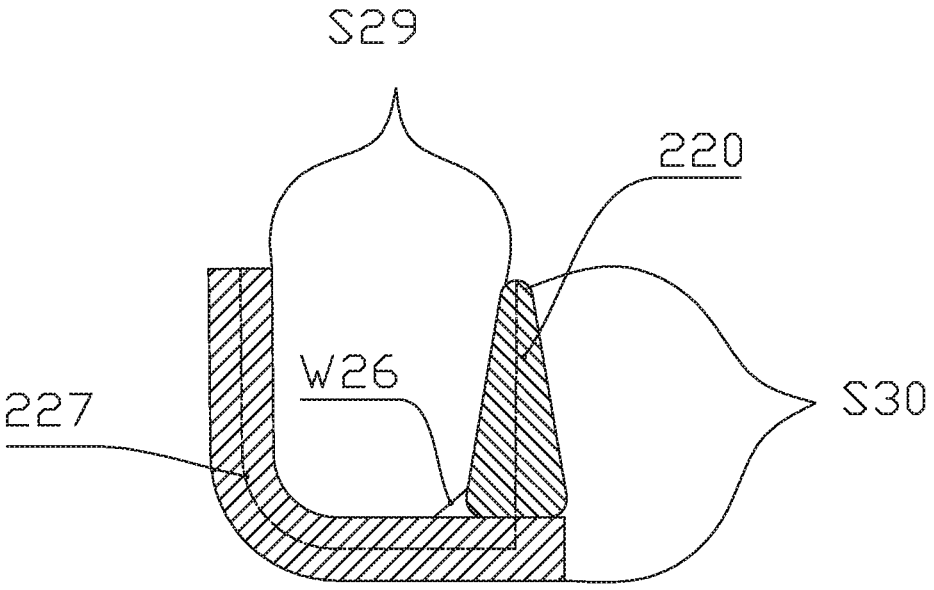
FIG. 13*f* is a cross-sectional view of a U-shaped bar made of one wedge wire and one L-shaped flat wire.

FIG. 13*f* shows a U-shaped bar where an L-shaped wire or bended plate 227 has been welded (W26) to a wedge wire 220. The groove S29 may be utilized in the same way as in FIG. 13*e*. S30 comprises the visible surface.

Figure 13G:
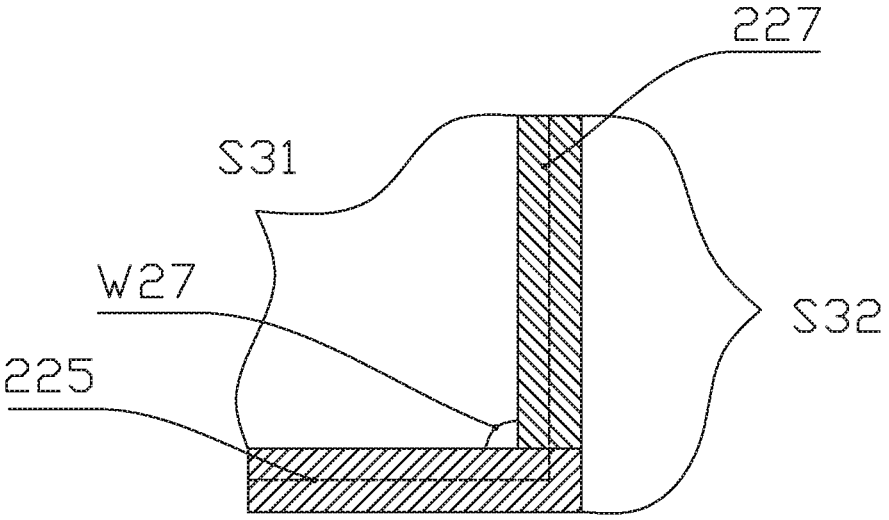
FIG. 13*g* is a cross-sectional view of an L-shaped bar made of two flat wires.

FIG. 13*g* shows an L-shaped bar manufactured from a cut plate 225 and a flat wire or cut plate 227 welded (W27) to form an L-shaped bar and thus comprise structures with no wedge wires. A corner surface S31 and a visible surface S32 are provided. The manufacturing method of the plate 225 is cutting from plate whereby a difficult bending in direction of the major axis is avoided. The wire or plate 227 is bended in direction of the minor axis which is easily accomplished. Weldings are not visible and a wide visible surface S32 is provided. The novel manufacturing method provides a possibility to use actual bended L-bars in convenient places of face masks, though some limitations concerning strength and bending options exist compared to wedge wires as disclosed.

Figure 13H:
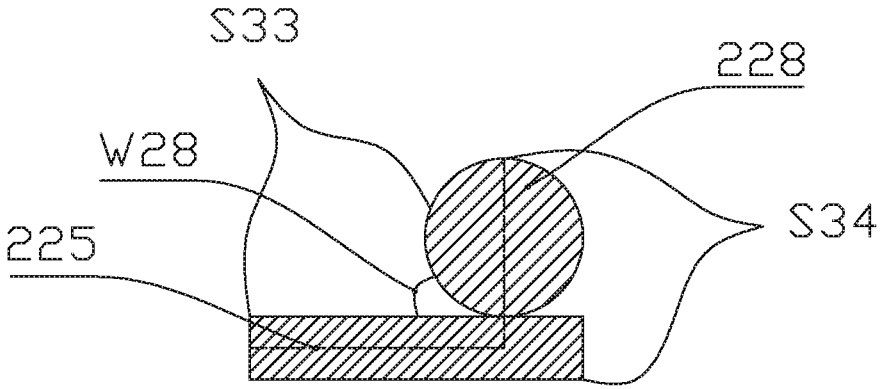
FIG. 13*h* is a cross-sectional view of an L-shaped bar made of a round wire and a flat wire.

FIG. 13*h* shows an L-shaped bar manufactured from a flat wire or cut plate 225 welded (W28) to a prior art round wire 228 and thus also comprise structures with no wedge wires. A corner surface S33 and a visible surface S34 are provided. This type of construction enables the use of prior art wires, such as ovals and flattened rectangular wires to produce L-shaped bars. However the welding W29 joint is larger, the corner surface S33 provides less back-up and the weight of the bar is bigger compared to the wedge wire bars of FIGS. 13*a* and 13*b*. The novel manufacturing method disclosed herein of bending the individual wires individually and joining them afterwards comprises in this case an easy way to strengthen and improve the backing of prior art face masks to a helmet.

Figure 13I:
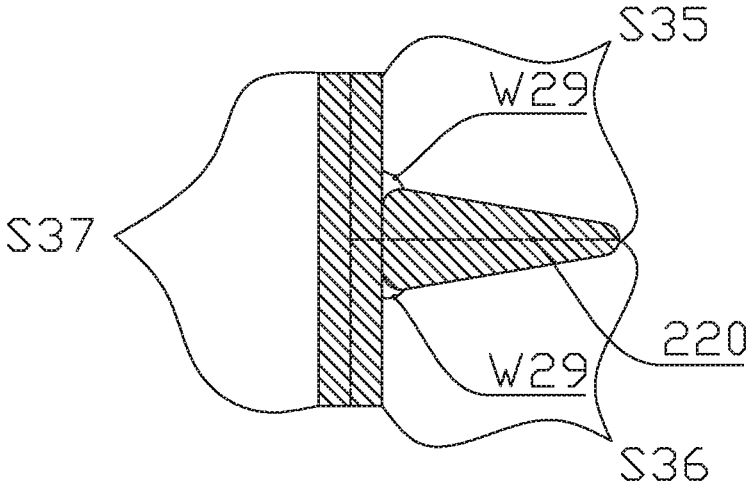
FIG. 13*i* is a cross-sectional view of a wire configuration incorporating aspects of the disclosed embodiments.

FIG. 13*i* shows a wedge wire 220 of the disclosed embodiments welded (W29) to a flat wire 229 to form a strong T-shaped bar. This type of bar provides two corner surfaces S35 and S36 and a flat visible surface S37 showing no joints. This type of bars may be used in cases when a helmet or brim is equipped with a groove shaped according to the wedge wire 220. The T-shaped bar is positioned in the groove whereby the face mask will be confined and attached extremely well to the headgear and the visible part S37 of the flat bar 229 shows fully new aesthetics.

Figure 14A:
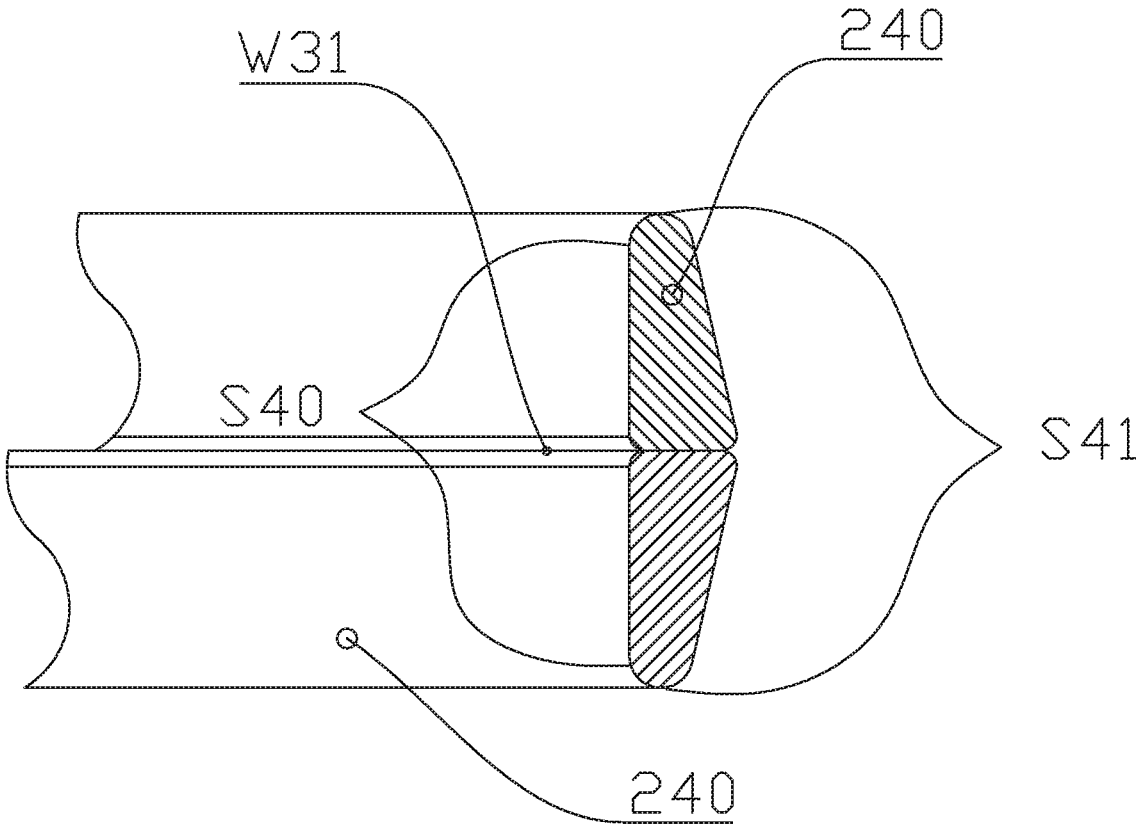
FIG. 14*a* is a cross-sectional view of a wide double bar made of two wedge wires incorporating aspects of the disclosed embodiments.
Figure 14B:
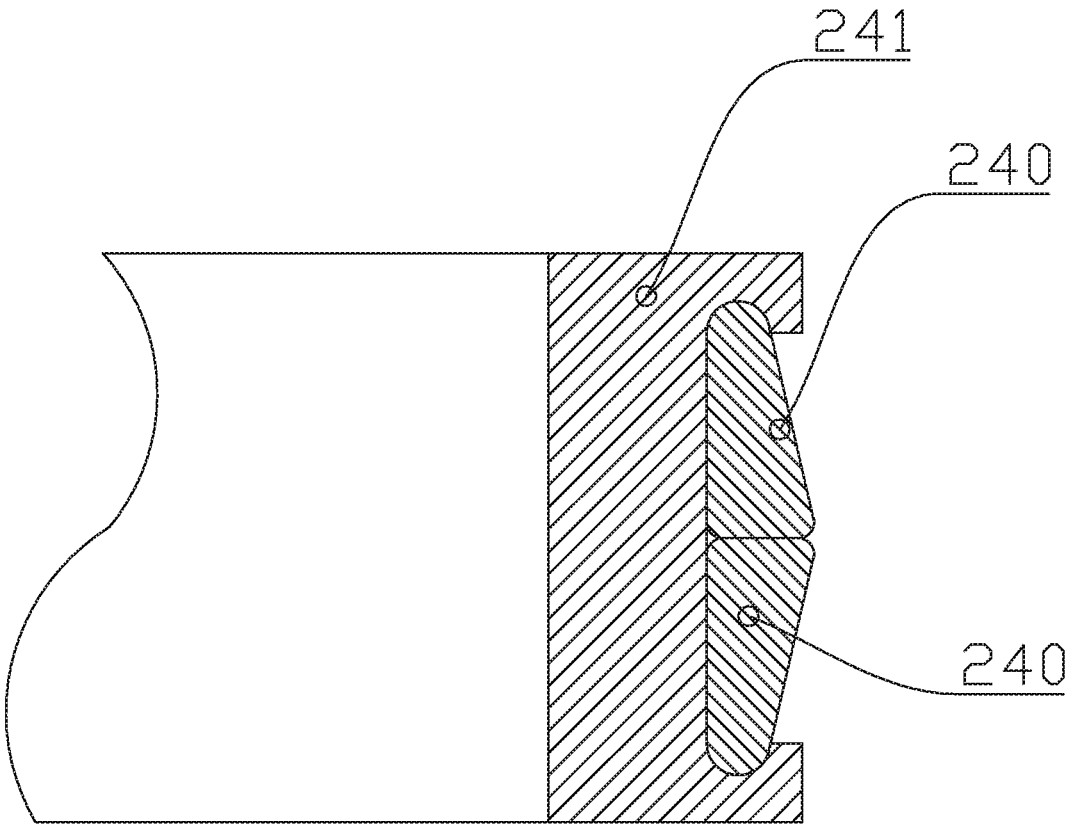
FIG. 14*b* is a cross-sectional view of the bar of FIG. 14*a* with a profiled detachable padding.
Figure 14C:
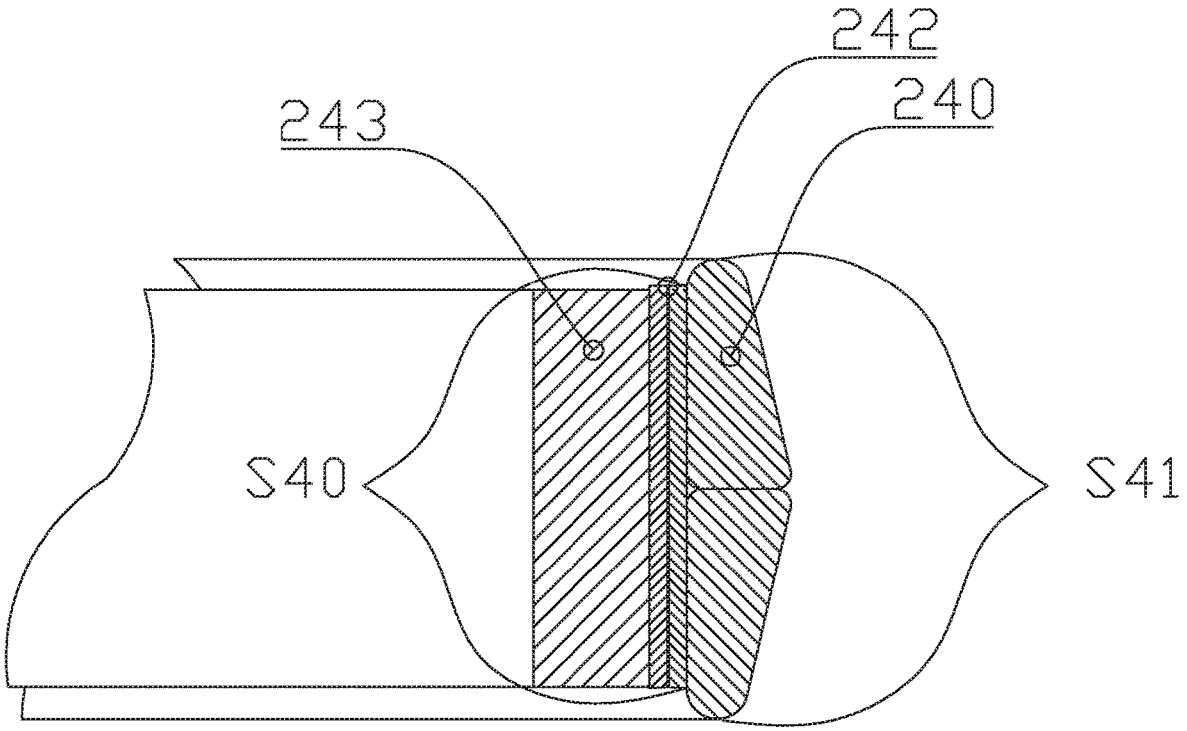
FIG. 14*c* is a cross-sectional view of the bar of FIG. 14*a* with a detachable padding attached by hook and loop tape.

Another way to join two wedge wires of the disclosed embodiments to form a double bar is to join the flat portions of the bases together as shown in FIGS. 14*a*-14*c*. A wide and rigid double bar is formed and can be used for instance as a part of a contour wire to provide a big flat area. The benefits in relation to impact absorption as disclosed is multiplied in that a bigger area is provided compared to a single wire. Corresponding prior art solutions have many downsides as disclosed.

FIG. 14*a* shows sections of two identical wedge wires 240 of the disclosed embodiments joined longitudinally base against base by welding (W30) to form a double bar. The welds may be TIG spot welds where filler material may not be necessary because of good contact between the wires and accessible welding areas. The inside of the double bar provides a large area S40 for improved impact absorption. The visible outside S41 of the double bar shows no weldings and provides good new aesthetics.

FIG. 14*b* shows the double bar of FIG. 14*a* attached to a disposable profiled padding 241. The padding may for instance lean on the forehead of the face mask user. No glue is needed between the double bar and the padding because the bar is well confined within the profiled padding.

FIG. 14*c* shows an alternative solution to FIG. 14*b*. The double bar of FIG. 14*a* is attached to a padding 243 by means of hook and loop fasteners 242. The surface S40 provides enough contact area to ensure reliable and steady fastening of all components. The side S41 of the double bar is entirely visible on the outside of the face mask providing new aesthetics.

FIGS. 15-18 show various applications of the aspects of the disclosed embodiments. Some sectional details are magnified to show the structural features according to the aspects of the disclosed embodiments in detail.

Figure 15A:
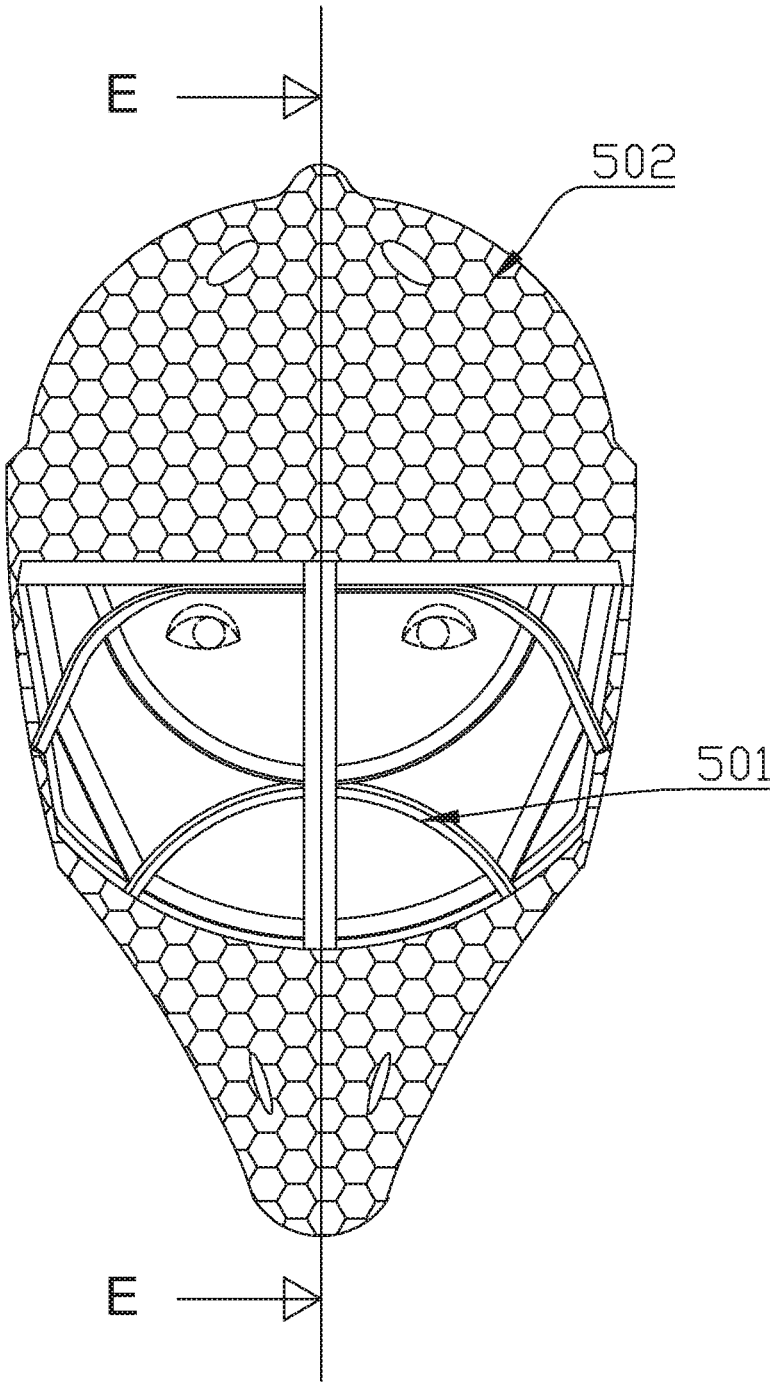
FIG. 15*a*-15*c* are views of headgear comprising a helmet and wedge wire cage used by ice-hockey goalies.
Figure 15B:
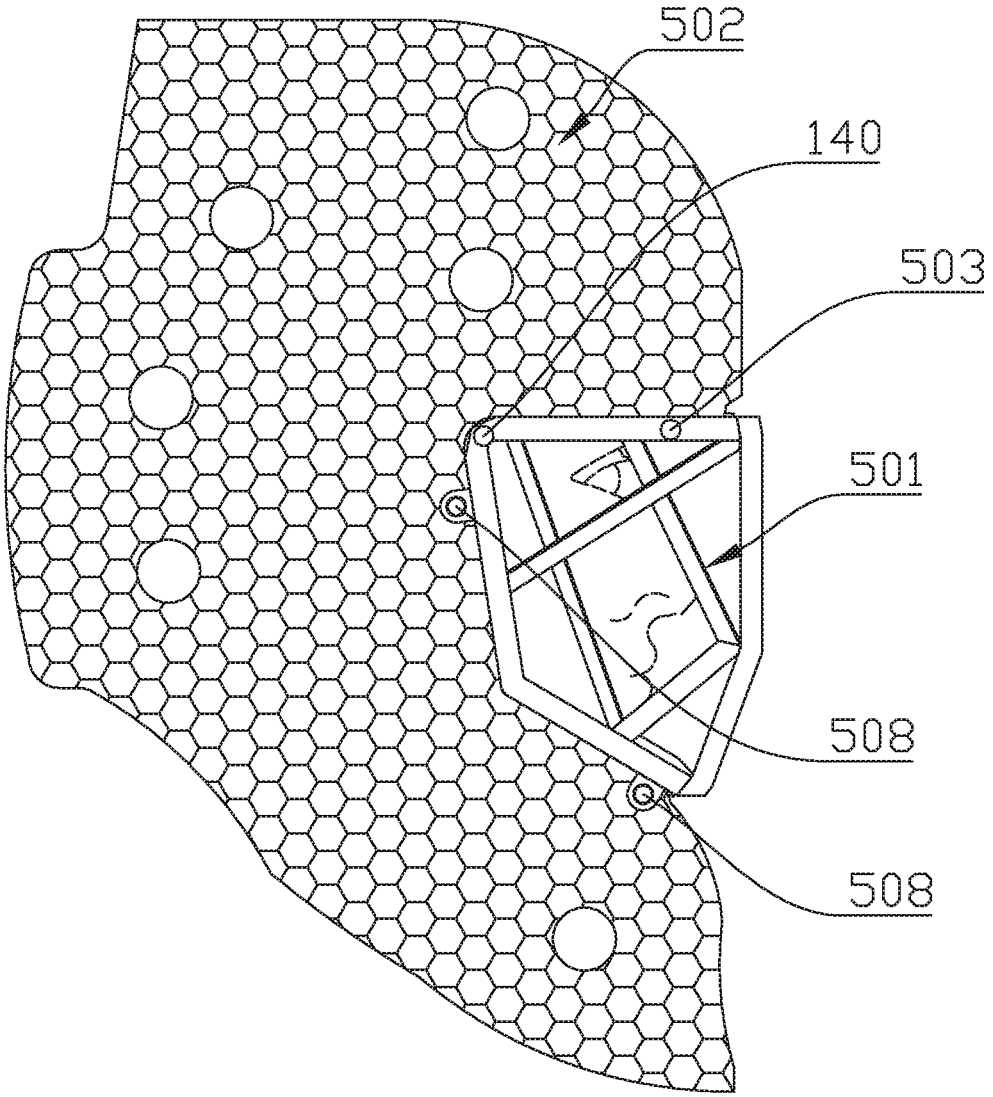
Figure 15C:
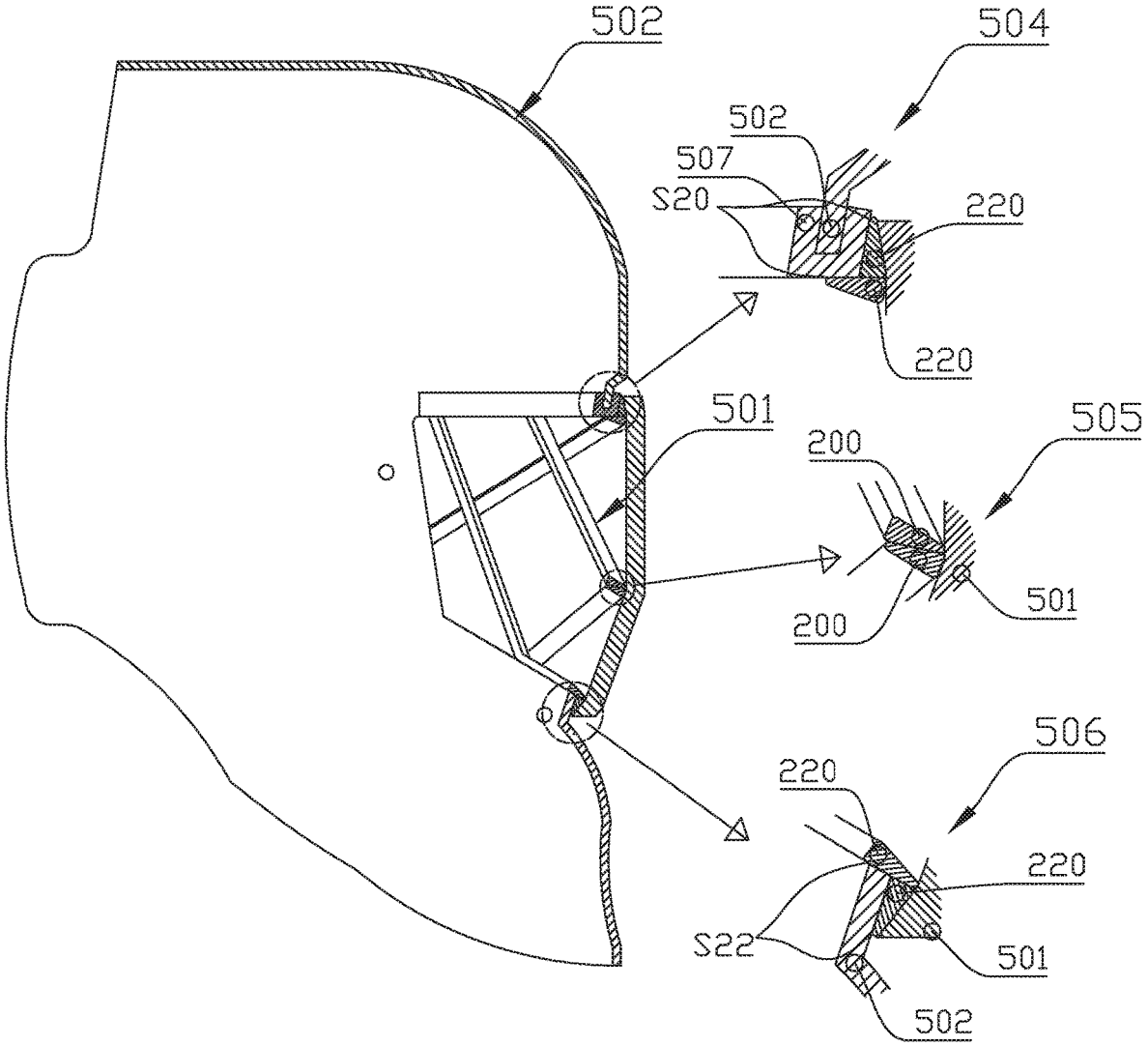

FIGS. 15*a*-15*c* show a headgear for an ice-hockey goalie comprising a face guard 501 incorporating aspects of the disclosed embodiments configured for use in connection with a helmet 502. The face guard 501, also referred to as a face mask or mask, is designed and configured to protect the face area of the wearer against impacts primarily from sports articles such as pucks, while at the same time provide improved visibility. Similar headgear and wire lay-outs are also used in connection with goalie helmets of field-hockey, street hockey and floor ball. All wires of the face mask 501 are wedge wires according to the aspects of the disclosed embodiments. However it must be understood that some, or portions of the wires can be replaced by prior art wires in addition to or in combination with the wedge wire of the disclosed embodiments.

FIG. 15*a* is a front view of the headgear with a helmet 502 and the wire face mask 501 in a usage position. All the wedge wires in the field of view are bended off-axis to provide improved vision and provide high strength.

FIG. 15*b* is a side view of the headgear of FIG. 15*a* in usage position. Clips 508 on both sides of the helmet provide mounting holes for receiving corresponding screws fixed to the helmet. The contour wedge wire 503 of the face mask comprises a bend 140 in a direction of the major axis showing a small radius equal to approximately half of the width of the contour wedge wire 503, in accordance with the wire bend 140 shown in detail in FIG. 7*a*.

FIG. 15*c* is a cross-section E-E of the headgear of FIG. 15*a*. Three details 504, 505 and 506 are shown magnified and illustrate different embodiments of the aspects of the disclosed embodiments. Detail 504 shows an L-shaped bar consisting of two wedge wires 220 incorporating aspects of the disclosed embodiments, in accordance with the FIG. 13*a* and providing a corner surface S20 where a shaped elastomer profile 507 is fit tightly. The elastomer profile has a slot to provide a disposable attachment of the profile to the edge of the helmet 502. When a sports article or object such as a puck impacts the face mask, the impact is transferred from the mask to the elastomer profile throughout the corner surface. A big portion of the impact energy is absorbed by the elastomer and the reduced impact energy is transferred to the helmet and finally to the head of the wearer. In this manner, less impact energy is transferred to the head of the wearer because the elastomer profile absorbs a bigger portion of the impact energy compared to prior art masks with no elastomer.

Detail 505 shows a section of the longitudinal attachment of two wedge wires 200 incorporating aspects of the disclosed embodiments to provide a double bar in accordance with the example shown in FIG. 10*a*. Although the double bar is located or disposed in the field of view of the wearer, the double bar comprising the two wedge wires 200 provides a significantly smaller obstruction of vision compared with prior art wires.

Detail 506 shows an L-shaped bar consisting of two wedge wires 220 incorporating aspects of the disclosed embodiments, in accordance with example of FIG. 13*b* and providing a corner surface S22 where the edge of the helmet 502 is confined to improve the immobility and backing of the face mask against the helmet. The improved immobility and backing according to the aspects of the disclosed embodiments provides a more equal distribution of impact energy from the face guard to the helmet which makes the helmet less vulnerable to cracking in places of high strain, such as the mounting holes for the attachment of the face guard. It also reduces wear of the helmet coating. The L-shaped bar provides also much higher strength than conventional round contour wires.

Figure 16A:
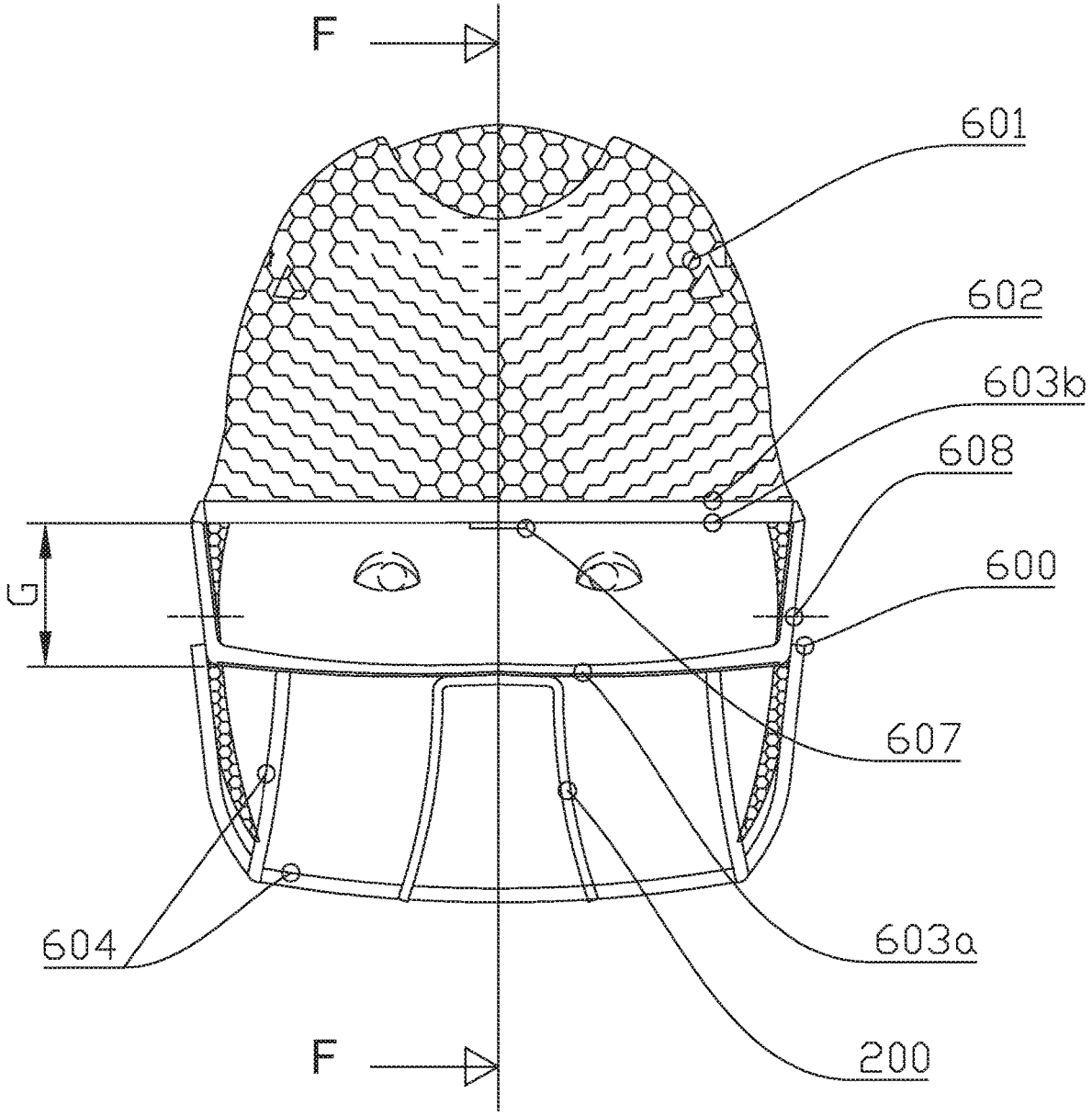
FIG. 16*a*-16*c* are views of headgear comprising a helmet and wedge wire face guard used by baseball batters.
Figure 16B:
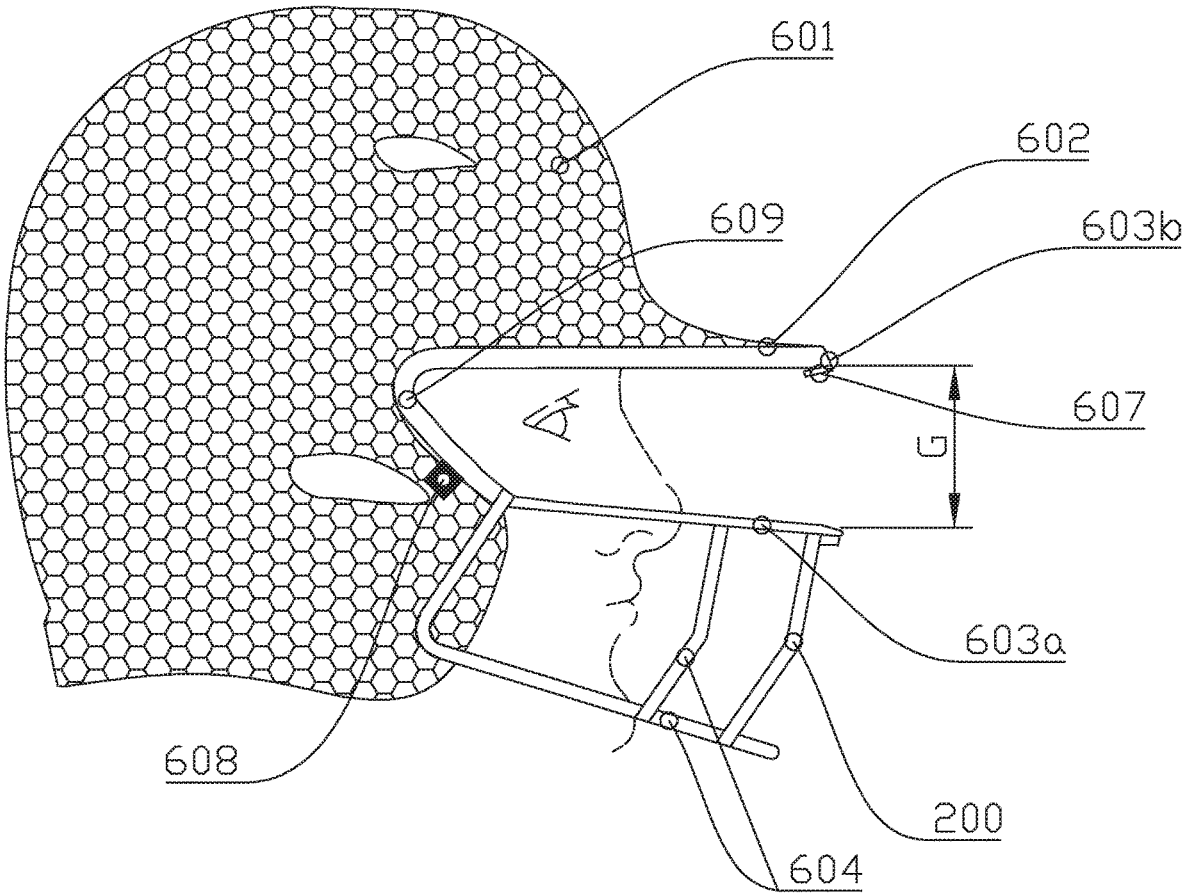
Figure 16C:
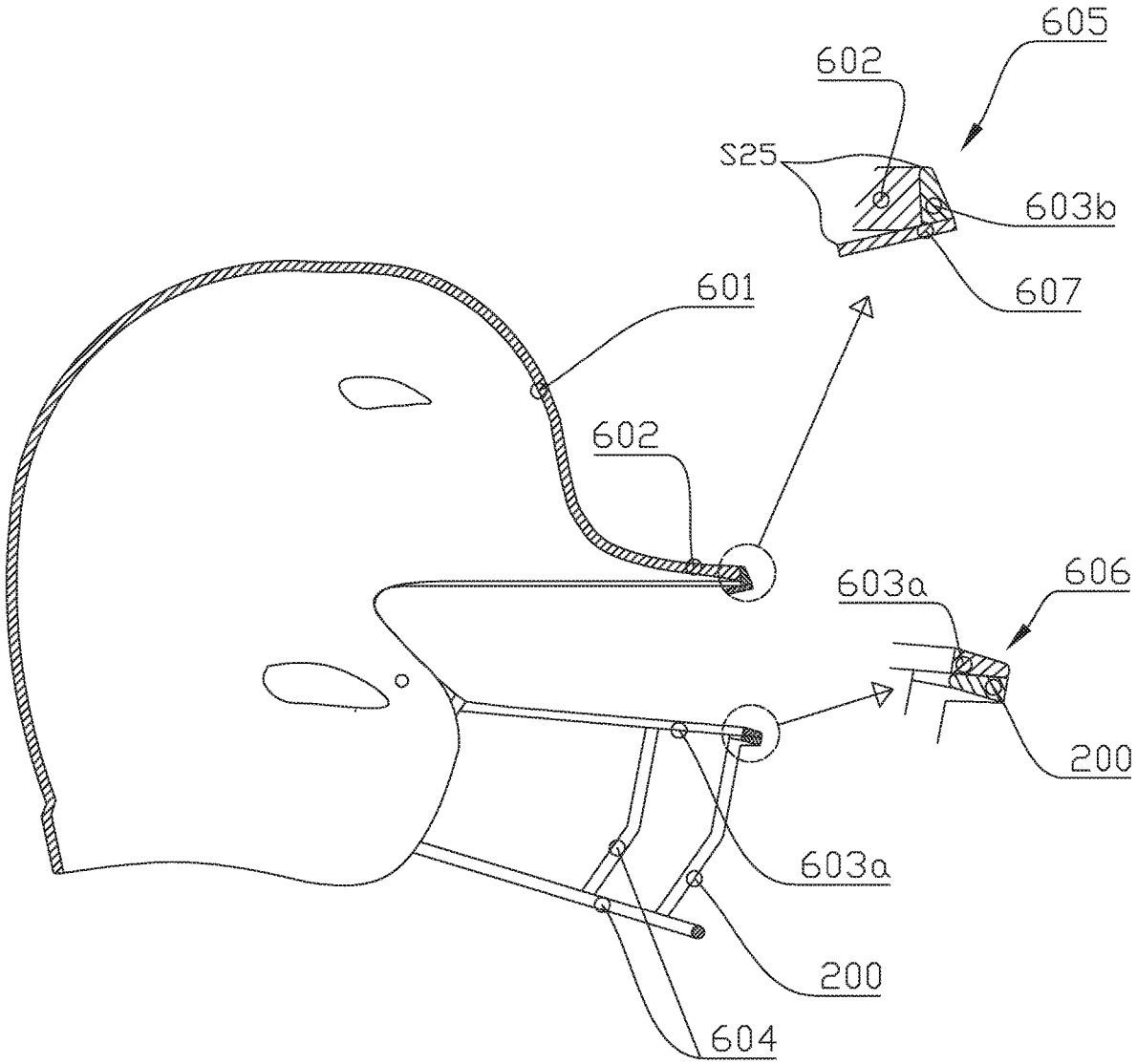

FIGS. 16*a*-16*c* show a headgear for a baseball batter consisting of a face guard 600 configured for use in connection with a helmet 601 in accordance the aspects of the disclosed embodiments. The face guard 600 is designed to protect at least the jaw of the wearer against impacts from high speed pitched balls, to provide improved vision and to provide a firmer and larger viewing gap G proximate to the eyes of the user defined by the brim 602 and a horizontal wire 603*a* of the face mask. By high impact of a baseball the gap maintains its constant dimensions without fractures or deflection of materials. The headgear and wire lay-out in the field of view is similar to headgear established for baseball and softball with some variation.

FIG. 16*a* is a front view of the headgear with the helmet 601 and face guard 600 providing a gap G between the horizontal wire 603*a* incorporating aspects of the disclosed embodiments and the brim 602 which is reinforced by the wedge wire 603*b* incorporating aspects of the disclosed embodiments. The wires 603*a* and 603*b* comprise one single wire resulting in less welding work. The edge of the brim is shaped to provide a tight contact area against the wedge wire 603*b*. To connect the face mask to the helmet one clip 607 is welded to the wire 603*b*, and two clips 608 are welded on both sides of the face mask to provide mounting holes for receiving corresponding screws fixed to the helmet. The wire 603*a* is bended off-axis to provide improved vision.

Other wires of the face guard comprise a bended wedge wire 200, as is shown in FIGS. 10*a*, 10*b*, 15, 16 and 17. In all these figures the wire 200 comprises a portion which forms the double bar of FIG. 10A in combination with a second wedge wire (603*a* in FIG. 16). Wires 604 are round in this case to demonstrate the possibility to use both wedge wires and round wires in the same face guard.

FIG. 16*b* is a side view of the head gear of FIG. 16*a* showing the same elements. The wedge wire 603 comprises a bend 609 in direction of the major axis showing a small radius.

FIG. 16*c* is a cross-section F-F of the head gear of FIG. 16*a*. Two details 605 and 606 are shown magnified and comprise different embodiments of the aspects of the disclosed embodiments. Detail 605 shows an L-shaped bar consisting of the wedge wire 603*b* and the clip 607 in accordance with the FIG. 13*d* and providing a corner surface S25 which confines the edge of the brim 602. The double bar and the wire 603*b* incorporating aspects of the disclosed embodiments provide a strong and aesthetic reinforcement of the brim.

Detail 606 shows a section of the longitudinal attachment of the wedge wires 200 and 603*a* to provide a strong double bar in accordance with the example of FIG. 10*a*. While the double bar in this example is located in the field of view of the wearer, the double bar incorporating aspects of the disclosed embodiments provides a significantly smaller obstruction of vision compared with prior art double bars.

The reinforced rigid brim and the strong double bar comprising wires 200 and 603*a* can efficiently prevent a baseball from penetrating the gap G and cause injuries for the user. Deflection of material by impact is very small, which is why the gap can be dimensioned to be only slightly smaller than the diameter of the sports object or baseball in this example, providing more optimum vision for the wearer.

Figure 17A:
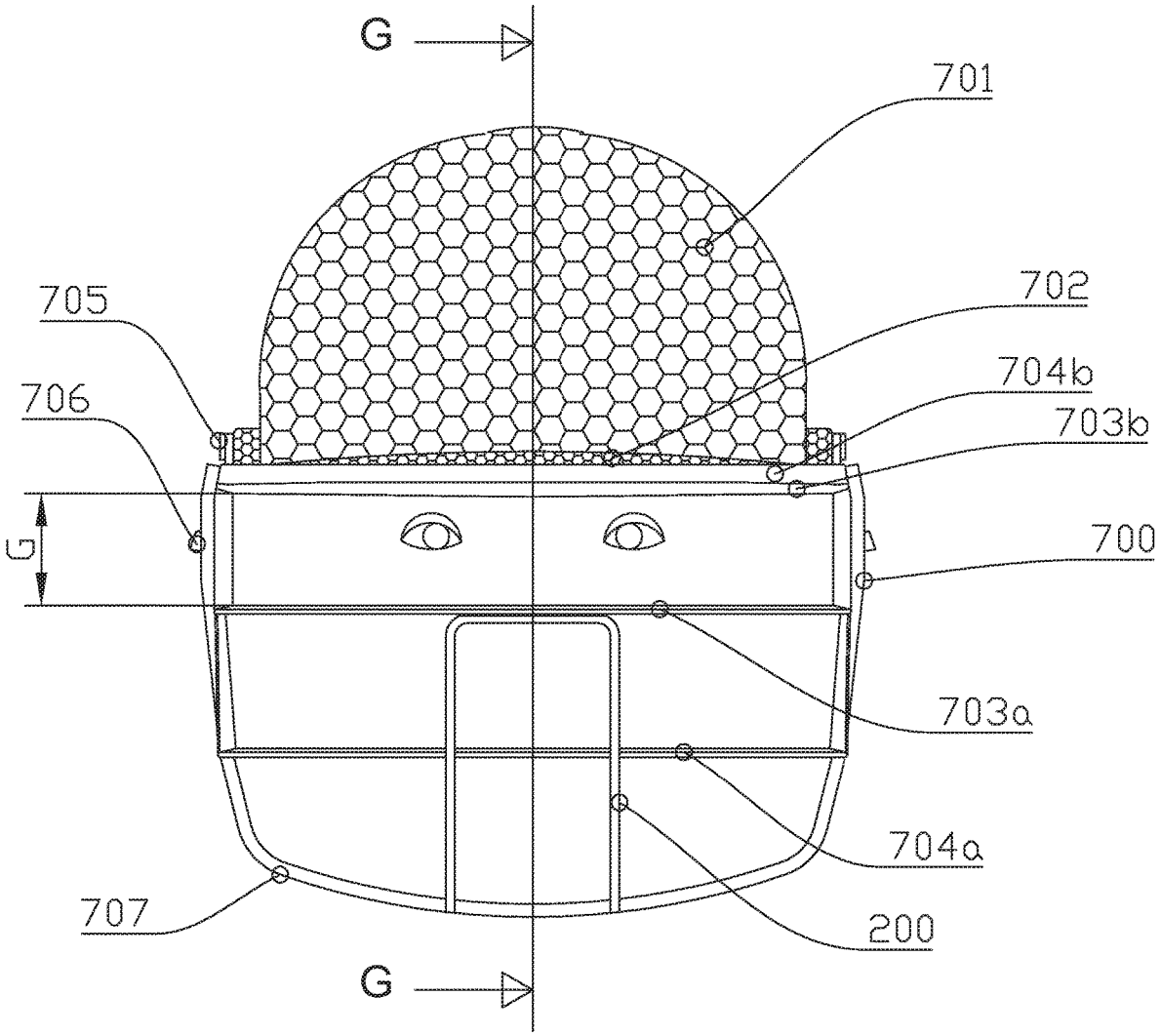
FIG. 17*a*-17*c* are views of headgear comprising a helmet and wedge wire face guard used by cricket batsmen.
Figure 17B:
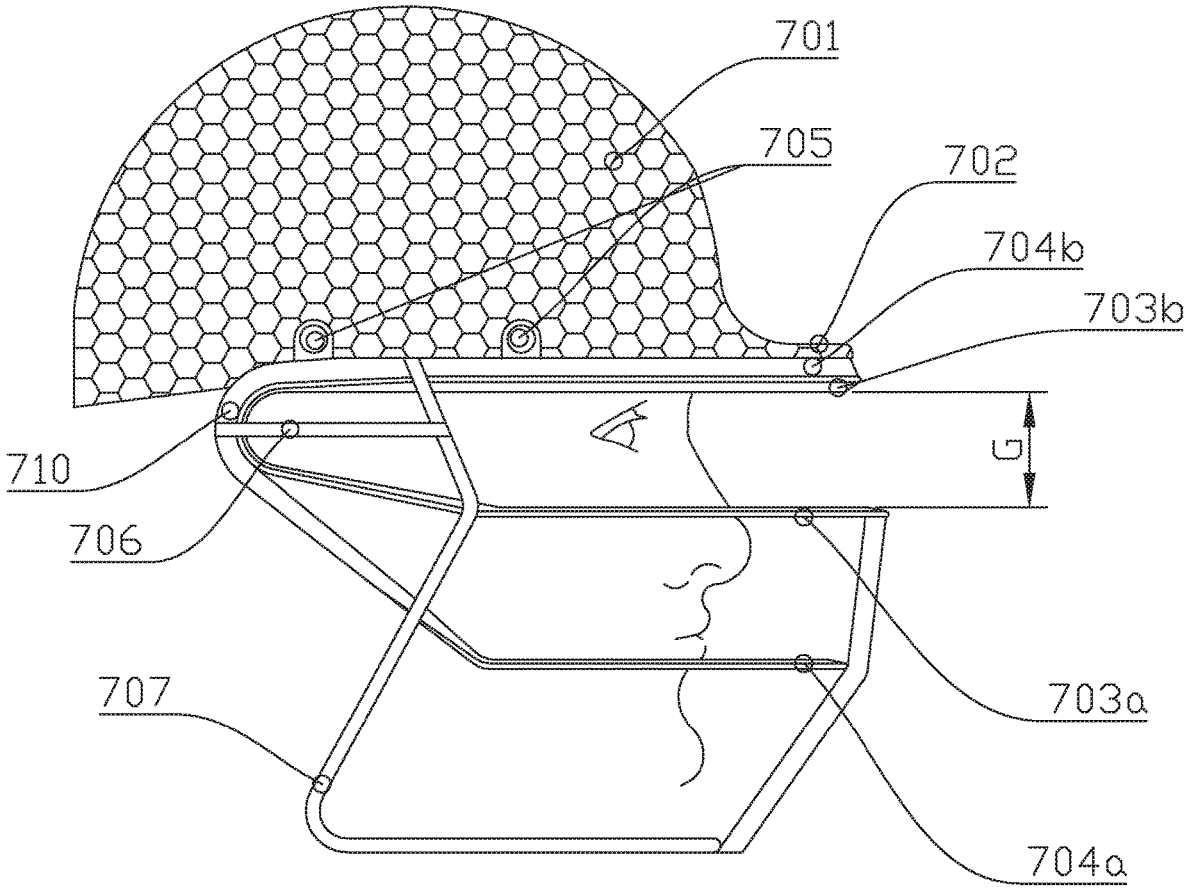
Figure 17C:
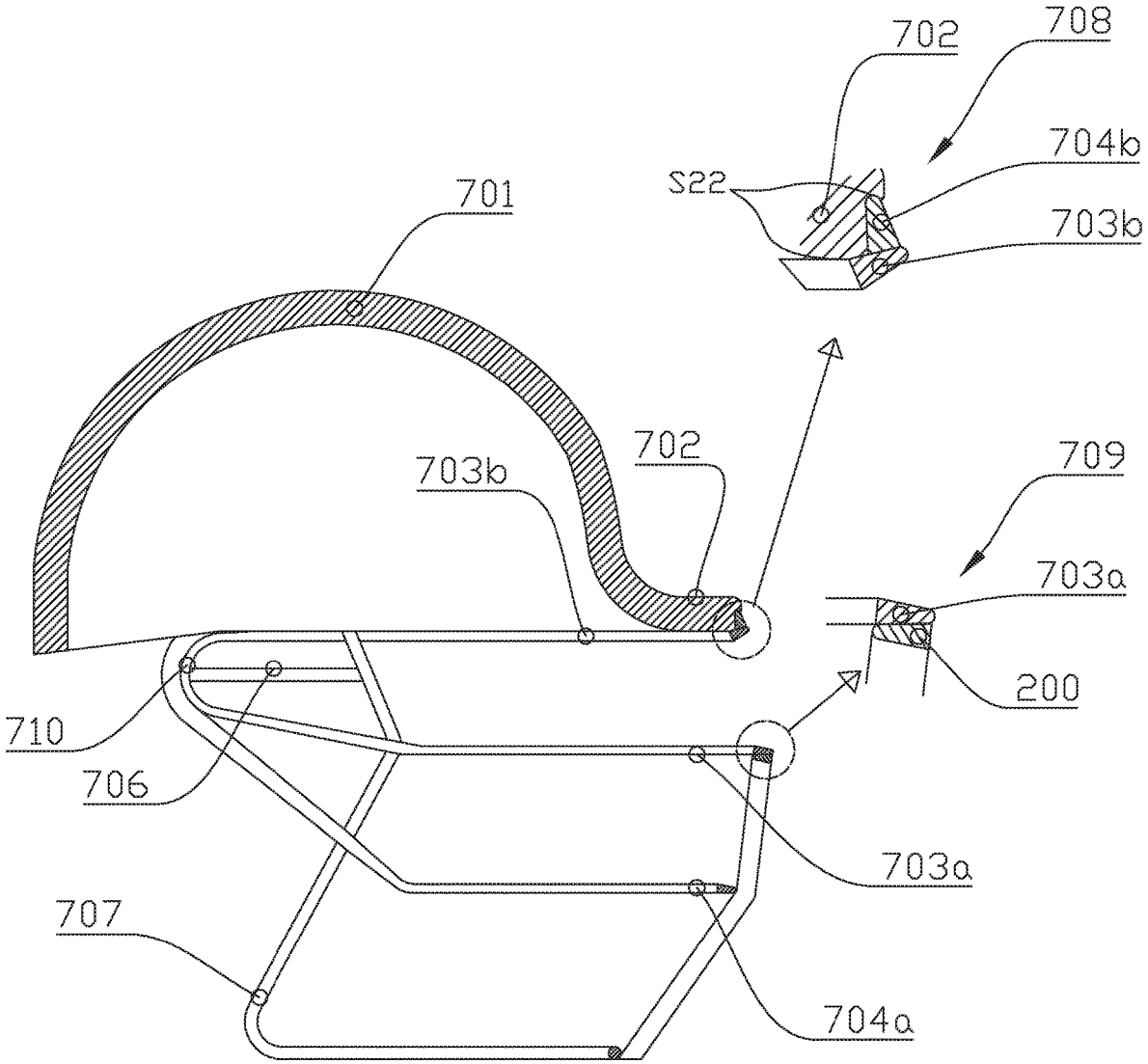

FIGS. 17*a*-17*c* show an exemplary headgear for a cricket batsman comprising a face guard 700 configured for use in connection with a helmet 701 in accordance with the aspects of the disclosed embodiments. The face mask 700 is designed to protect at least the jaw of the wearer against impacts from sports objects such as high speed pitched balls, while providing improved vision as well as a firmer and larger viewing gap G proximate to the eyes of the user defined by the brim 702 and a horizontal wire 703*a* incorporating aspects of the disclosed embodiments of the face mask.

In cricket the pitched ball is heavier and may travel with even higher speed compared to a baseball, which is why the strength requirements of the gap G are higher. The headgear and wire lay-out in the field of view is similar to headgear established for cricket with some variation.

FIG. 17*a* is a front view of the headgear with the helmet 701 and face guard 700 providing a gap G between the horizontal wire 703*a* and the peak 702 which is reinforced by the wedge wires 703*b* and 704*b* incorporating aspects of the disclosed embodiments. The wires or wire portions 703*a* and 703*b* comprise one single wire as do wire portions 704*a* and 704*b*. The wedge wires 703*a* and 704*a* are bended off-axis to provide improved vision. The edge of the peak is shaped to provide a tight contact area against the L-shaped double bar formed by wedge wires 703*b* and 704*b*. The L-bar provides reinforcement of the peak 702 over its whole edge and a stationary connection between the face mask 700 and the peak 702. The face mask 700 is connected to the helmet by means of four brackets 705 which are welded on both sides of the face guard 700 comprising mounting holes for receiving corresponding bolts fixed to the helmet 701. Other wires of the face guard 700 comprise a bended wedge wire 200 [same as earlier 200?], an ear protecting wedge wire 706 and a round contour wire 707, all incorporating aspects of the disclosed embodiments.

FIG. 17*b* is a side view of the head gear of FIG. 17*a* showing the same elements. The wedge wires 703 and 704 comprise a bend 710 showing a small radius. Wire 704 is bended in direction of the major axis.

FIG. 17*c* is a cross-section G-G of the headgear of FIG. 17*a*. Two details 708 and 709 are shown magnified and comprise different aspects of the disclosed embodiments. Detail 708 shows an L-shaped bar consisting of the wedge wires 703*b* and 704*b* in accordance with the example of FIG. 13*b* and provides a corner surface S22 which confines and reinforces the edge of the peak 702 in an extremely strong and aesthetic manner. Detail 709 shows a section of the longitudinal attachment of the wedge wires 200 and 703*a* to provide a strong double bar in accordance with the FIG. 10*a*. The double bar is located in the field of view of the wearer and provides a significantly smaller obstruction of vision compared with prior art double bars. The reinforced rigid peak and the strong double bar in the field of view can efficiently prevent a cricket ball from penetrating the gap G and cause injuries for the user. Deflection of material is very small even by highest impact, which is why the gap can be dimensioned to be only slightly smaller than the diameter of the cricket ball, thus providing optimum vision for the wearer.

Figure 18A:
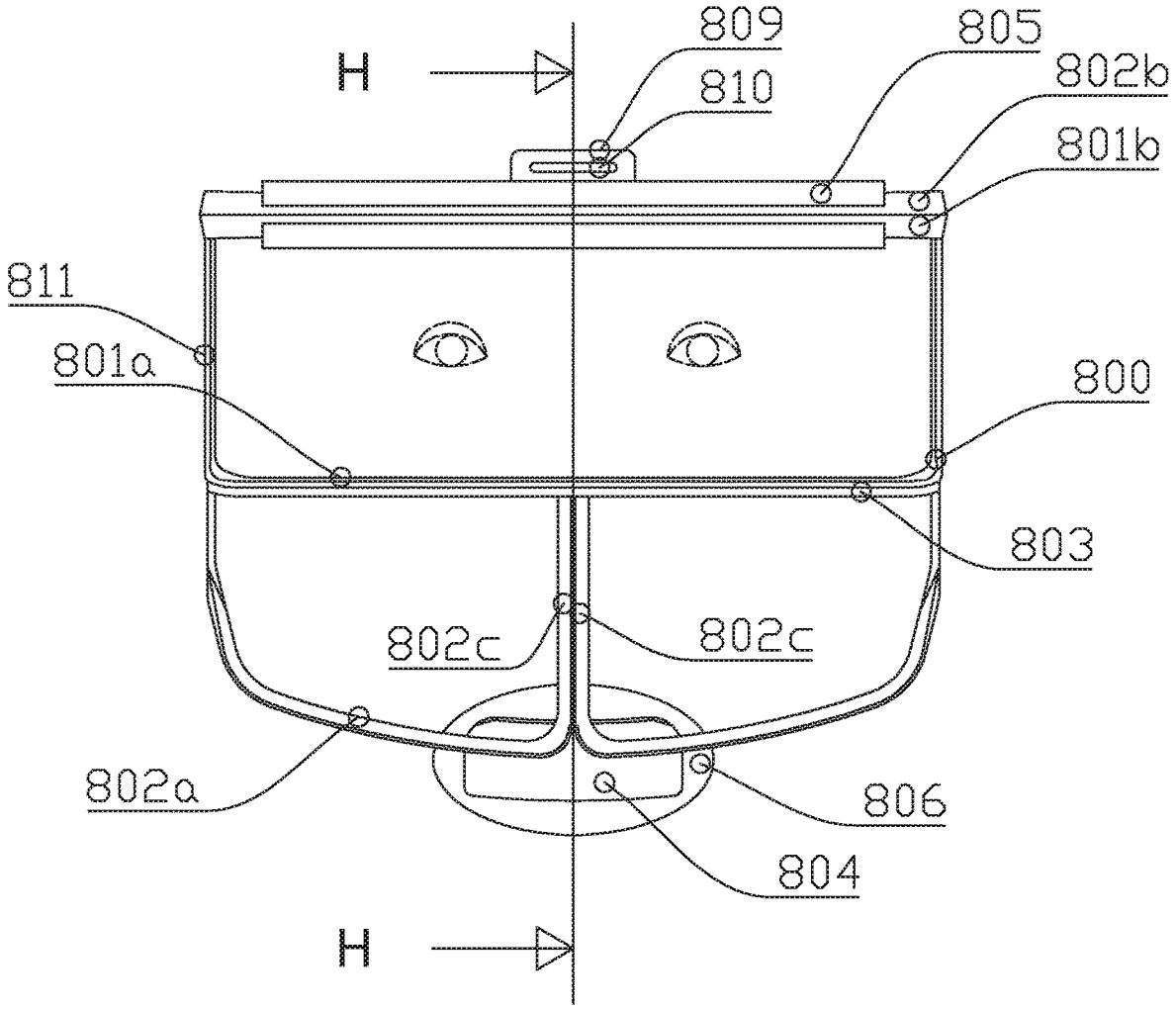
FIG. 18*a*-18*c* are views of headgear comprising a wedge wire face guard attached to the head of the user and used by softball players.
Figure 18B:
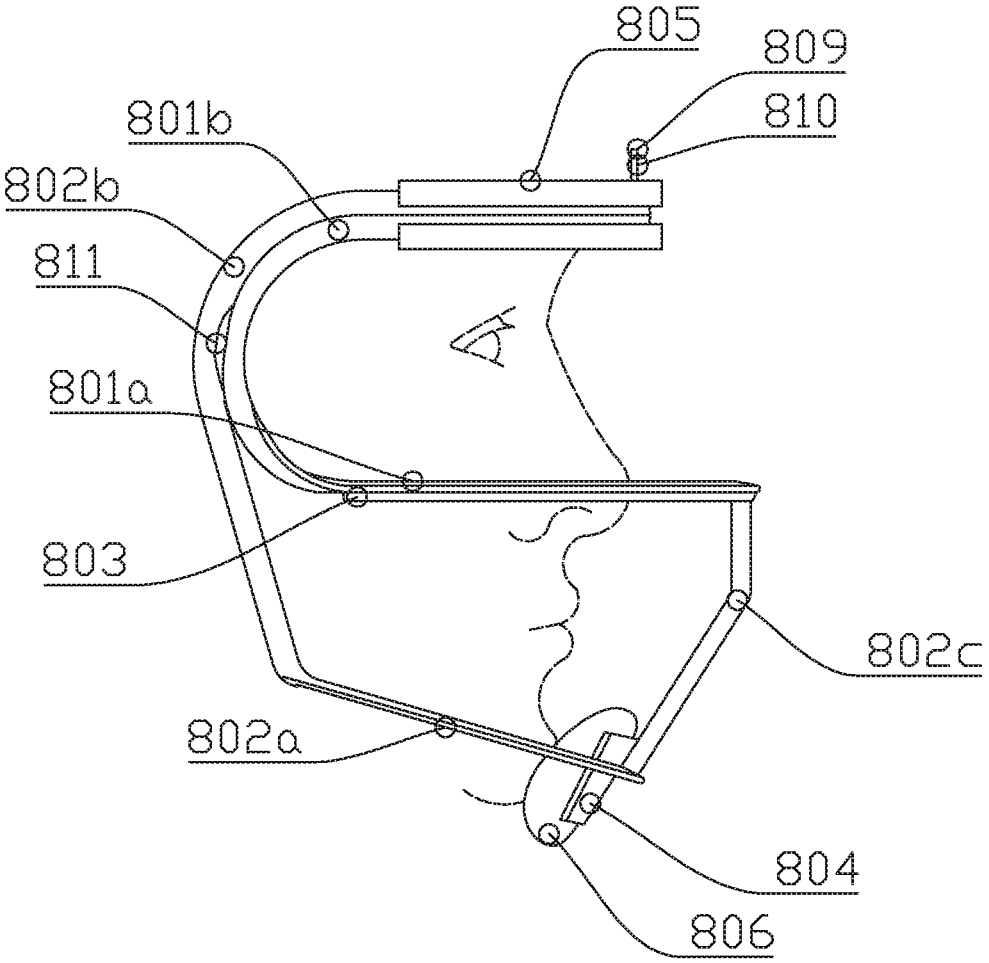
Figure 18C:
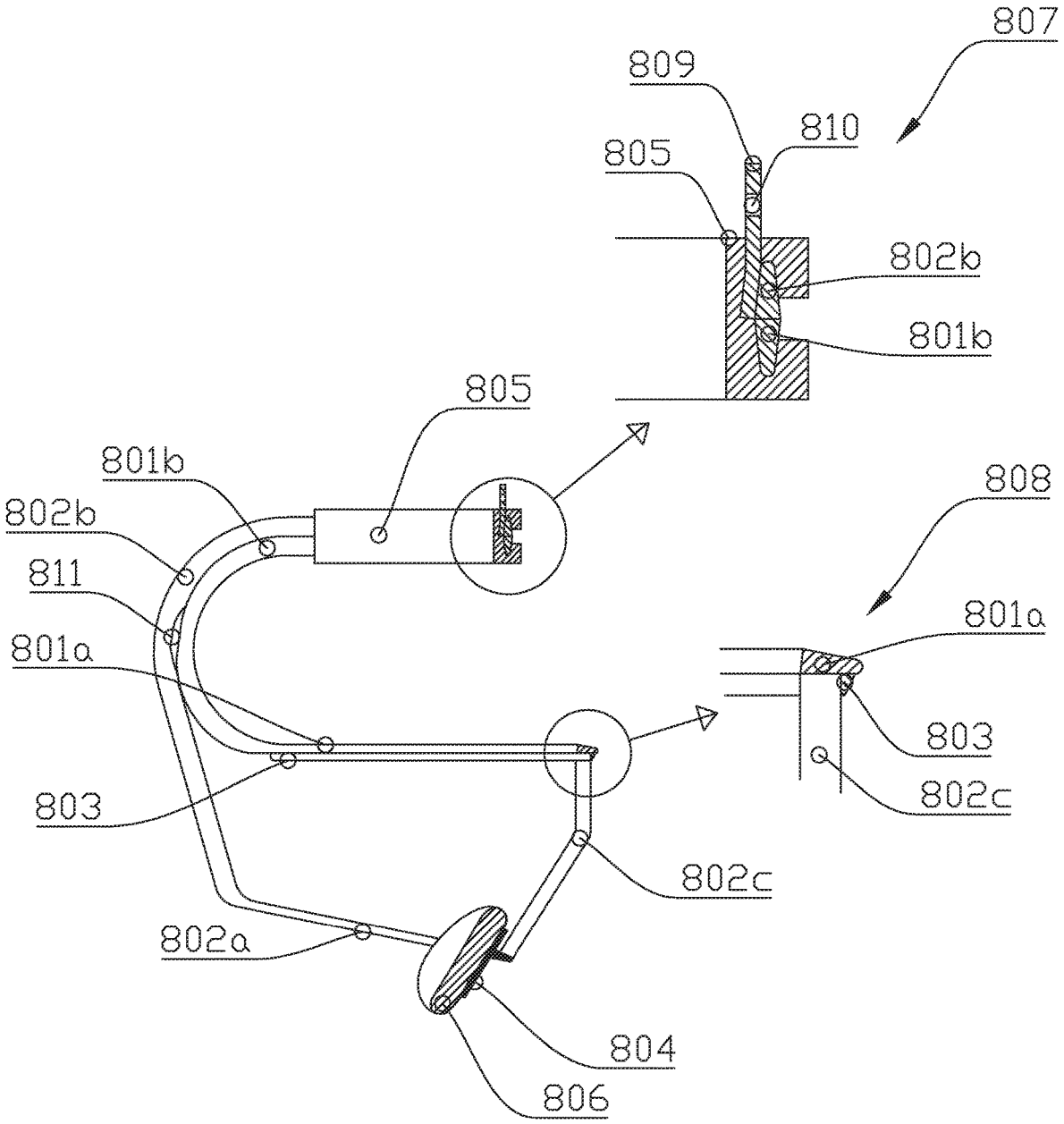

FIGS. 18*a*-18*c* show a headgear 800 configured for use in softball in accordance with an aspect of the disclosed embodiments. The headgear 800 is attached directly to the head of the wearer by straps. It is designed to protect the face of the wearer against impacts from balls and to provide an unobstructed viewing gap proximate to the eyes of the user between a padded forehead portion and a horizontal wire below eye level of the face mask. Further it provides improved vision, higher strength and new aesthetics. The headgear 800 and the wire lay-out can be manufactured from very few parts in comparison with the prior art metal wire headgear for softball.

FIG. 18*a* is a front view of the headgear 800. The padded forehead portion comprises two wedge wires 801*b* and 802*b* incorporating aspects of the disclosed embodiments which are attached longitudinally to form a wide double bar in accordance with example of FIG. 14*a*. A detachable padding 805 is attached to the double bar. A bracket 809 providing a slot opening 810 for a mounting strap is welded to the double bar. Slot openings 811 between the wires 801*b* and 802*b* are provided for the attachment of two more straps on the sides of the face guard. The wires 801*a* and 801*b* comprise one single wire and so do wires 802*a*, 802*b* and 802*c*. A smaller wedge wire 803 is welded longitudinally to the wire 801*a* to form an L-shaped double bar in accordance with the example of FIG. 13*c*. This double bar is located in the field of view and the aspects of the disclosed embodiments advantageously provide a small obstruction of vision and very high strength in all directions.

Wedge wire 802*a* incorporating aspects of the disclosed embodiments provides protection and structural strength for the face guard 800 in the jaw area. The vertical parts 802*c* of the same wire are attached to form a V-shaped double bar in accordance with the example of FIG. 12*a*. This double bar is welded perpendicularly to the double bar 801*a*/803 and provides high strength and good lines of vision. A chin protection cup is provided by a shaped plate of cut sheet metal 804 and a detachable padding 806. The metal plate 804 is welded to the wire parts 802*a* and 802*c* which provide flat surfaces for a good contact between the joined parts. The padding 806 is fixed to the plate 804 by hook and loop attachment.

FIG. 18*b* is a side view of the head gear 800 of FIG. 18*a* showing the same elements. The wedge wires 801*b* and 802*b* comprise a bend 812 in direction of the major axis showing a small radius.

FIG. 18*c* is a cross-section H-H of the face guard 800 of FIG. 18*a*. Two details 807 and 808 are shown magnified and comprise different aspects of the disclosed embodiments. Detail 807 shows a wide double bar consisting of the wedge wires 801*b* and 802*b* in accordance with the example of FIG. 14*a*. The bracket 809 is welded to the double bar and provides a slot opening 810 for a strap. A detachable padding 805 is attached to the double bar and includes an opening for the bracket 809. The double bar provides high strength, new aesthetics and large area for impact distribution. Detail 808 shows a section of the longitudinal attachment of the wedge wires 801*a* and 803 to provide a strong L-shaped bar in accordance with the FIG. 10*a*. The vertical V-shaped bar 209*c* is shaped to fit the corner surface of L-shaped bar and is welded to the L-bar unnoticeable on the inside of the face guard.

The metal of the wires can be various grades of steel, stainless steel or titanium. The metal must have: high strength against impact; enough ductility for bending and shaping the wires; properties allowing the production of strong joints, by welding for instance; and long life (limited corrosion and wear).

The wedge wire of the disclosed embodiments provides more strength in relation to its mass. Any wire cross-section can be made stronger simply by increasing the area of the cross-section but the weight (and obstruction) will increase correspondingly. Simplified, a cage made of wedge wires of the disclosed embodiments can give the same strength with less weight or alternatively more strength with the same weight.

The visual obstruction is minimized by the wedge wire alone and also by some of the double bars.

Other benefits include:

New aesthetics; Protection of helmet parts (brim, screw holes); Rigidity in critical places such as the gap G of FIG. 17. If the gap is not rigid enough a ball can travel through the gap without actually breaking the face guard.

The aspects of the disclosed embodiments are directed to the use of a new and inventive wire, referred to herein as a "wedge wire" or "contour wedge wire" for use with sports headgear, helmets and face protection gear such as face marks, face guards and eye goggles. The wedge wire of the disclosed embodiments provides improved strength and shock absorption from impacts, such as when a sports object strikes or otherwise impacts with the mask that includes the wedge wire(s). Sports objects can include, but are not limited to pucks, balls and other such objects.

The use of the wedge wire(s) of the disclosed embodiments also improves visibility when the wedge wire(s) are disposed in the field of view of the user. The unique construction and formation of the wedge wire(s) minimizes the visual obstruction that might otherwise be present when a wire(s) is disposed within the field of view, as may be generally required with such face and eye protection gear. Thus, the wedge wire(s) of the disclosed embodiments, when used in conjunction with a face mask or guard for head or eye gear can improve impact handling capability as well improve vision by reducing the visual obstruction.

What is claimed is:

1. A sports face guard (501) for a sports headgear, the sports face guard (501) comprising:

a plurality of wires, which have been bended and welded to form a grid portion protecting a face of a wearer of the sports headgear, wherein a wire (20) of the plurality of metal wires is a contour wire that comprise an outer rim of the face guard or a part of the outer rim of the face guard, the wire (20) configured to be in contact with a surface part of the sports headgear to which the face guard (501) is attached, the wire (20) having a cross-section comprising:

a first longest dimension (L1), the first longest dimension (L1) of the cross-section of the wire (20) being in a direction of a major axis (X) of the wire (20);

a second longest dimension (L2), the second longest dimension (L2) of the cross-section of the wire (20) being in a direction that is perpendicular to the major axis (X) of the wire (20), the second longest dimension (L2) being less than the first longest dimension (L1);

wherein the first longest dimension (L1) is between 3 mm and 15 mm, and a ratio between the first longest dimension (L1) and the second longest dimension (L2) is greater than 1.2;

wherein the surface of the wire (20), when divided into two part surfaces (S1 and S2) by a straight line (y1) crossing the end points (a, b) of the second longest dimension (L2), comprises:

a first tapered surface (S1) and a second base surface (S2), the first tapered surface having a larger area than the second surface (S2) and comprising a tip end with an end point (c) of the first longest dimension (L1); wherein a distance from the end point (c) to the straight line (y1) is longer than a distance from the second surface (S2) to the straight line (y1);

wherein the first tapered surface (S1) of the wire (20) comprises a substantially flat or concave surface portion, and wherein the second base surface (S2) of the wire (20) comprises a substantially flat or concave surface portion.

2. The sports face guard according to claim 1, wherein the wire and an end portion of another wire of the plurality of interconnected wires form a joint, and wherein the joint is formed between the first tapered surface of the wire and a substantially flat lateral surface of the end portion of the another wire.

3. The sports face guard according to claim 1, wherein the wire is bended longitudinally in a plane that offsets a central plane passing through the first longest dimension (L1) of the cross-section of the wire to form a bend.

4. The sports face guard according to claim 1, wherein the substantially flat or concave surface portion of the first tapered surface of the wire is in parallel contact with the surface part of the sports headgear to which the face guard is attached.

5. A sports face guard (501) for a sports headgear, the sports face guard (501) comprising:

an interconnected double bar wire assembly (505) comprising;

a first tapered wire (20) having a base end and a tip end; and a second wire element extending along the first tapered wire and directly connected to the first tapered wire along a common plane;

wherein a cross section of the first tapered wire comprises:

a first longest dimension (L1), the first longest dimension (L1) of the cross-section of the wire (20) being in a direction of a major axis (X) of the wire (20);

a second longest dimension (L2), the second longest dimension (L2) of the cross-section of the wire (20) being in a direction that is perpendicular to the major axis (X) of the wire (20), the second longest dimension (L2) being less than the first longest dimension (L1);

wherein the first longest dimension (L1) is between 3 mm and 15 mm, and a ratio between the first longest dimension (L1) and the second longest dimension (L2) is greater than 1.2;

wherein the surface of the wire (20), when divided into two part surfaces (S1 and S2) by a straight line (y1) crossing the end points (a, b) of the second longest dimension (L2), comprises:

a first tapered surface (S1) and a second base surface (S2), the first tapered surface having a larger area than the second surface (S2) and comprising a tip end with an end point (c) of the first longest dimension (L1); wherein a distance from the end point (c) to the straight line (y1) is longer than a distance from the second surface (S2) to the straight line (y1).

6. The sport face guard according to claim 5, wherein the second wire element of the interconnected double bar assembly comprises a second tapered wire having a base end and a tip end, wherein a cross-section of the second tapered wire comprises:

a first longest dimension (L1), the first longest dimension (L1) of the cross-section of the wire (20) being in a direction of a major axis (X) of the wire (20);

a second longest dimension (L2), the second longest dimension (L2) of the cross-section of the wire (20) being in a direction that is perpendicular to the major axis (X) of the wire (20), the second longest dimension (L2) being less than the first longest dimension (L1);

wherein the first longest dimension (L1) is between 3 mm and 15 mm, and a ratio between the first longest dimension (L1) and the second longest dimension (L2) is greater than 1.2;

wherein the surface of the wire (20), when divided into two part surfaces (S1 and S2) by a straight line (y1) crossing the end points (a, b) of the second longest dimension (L2), comprises:

a first tapered surface (S1) and a second base surface (S2), the first tapered surface having a larger area than the second surface (S2) and comprising a tip end with an end point (c) of the first longest dimension (L1); wherein a distance from the end point (c) to the straight line (y1) is longer than a distance from the second surface (S2) to the straight line (y1);

wherein the base end of the first tapered wire is disposed adjacent to the tip end of the second tapered wire and the tip end of the first tapered wire is disposed adjacent to the base end of the second tapered wire.

7. The sport face guard according to claim 5, wherein the second wire element of the interconnected double bar assembly comprises a second tapered wire being identical with the first tapered wire, and a portion of the first tapered surface proximate to the tip end of the first tapered wire is disposed in connection with a portion of the first tapered surface proximate to the tip end of the second tapered wire.

8. The sport face guard according to claim 5, wherein the second wire element of the interconnected double bar assembly comprises a second tapered wire being identical with the first tapered wire; and the tip end of the first tapered wire is directly connected to the tip end of the second tapered wire and the base end of the first tapered wire is spaced apart from the base end of the second tapered wire to form a gap between the first tapered wire and the second tapered wire.

9. The sport face mask according to claim 5, wherein the wire portions forming the interconnected double bar wire assembly are made of a single bended wire.

10. The sport face guard according to claim 5, wherein:

the second base surface of the first tapered wire of the interconnected double bar assembly comprises a substantially flat or concave surface portion; and the second wire element of the interconnected double bar assembly comprises a second tapered wire having a base end and a tip end, wherein a cross-section of the second tapered wire comprises:

a first longest dimension (L1), the first longest dimension (L1) of the cross-section of the wire (20) being in a direction of a major axis (X) of the wire (20);

a second longest dimension (L2), the second longest dimension (L2) of the cross-section of the wire (20) being in a direction that is perpendicular to the major axis (X) of the wire (20), the second longest dimension (L2) being less than the first longest dimension (L1);

wherein the first longest dimension (L1) is between 3 mm and 15 mm, and a ratio between the first longest dimension (L1) and the second longest dimension (L2) is greater than 1.2;

wherein the surface of the wire (20), when divided into two part surfaces (S1 and S2) by a straight line (y1) crossing the end points (a, b) of the second longest dimension (L2), comprises:

a first tapered surface (S1) and a second base surface (S2), the first tapered surface having a larger area than the second surface (S2) and comprising a tip end with an end point (c) of the first longest dimension (L1); wherein a distance from the end point (c) to the straight line (y1) is longer than a distance from the second surface (S2) to the straight line (y1);

wherein a substantially flat or concave surface portion of the base surface (S2) of the first tapered wire is connected to a first tapered surface portion of the second tapered wire so that a cross-section of the double bar wire assembly (505) forms one of an L or T-shape, having at least one corner surface (S20).

11. The sport face guard according to claim 5, wherein:

the second base surface of the first tapered wire of the interconnected double bar assembly comprises a substantially flat or concave surface portion; and the second wire element of the interconnected double bar assembly comprises an element made of cut metal plate; and wherein the substantially flat or concave surface portion of the base surface of the first tapered wire is connected to a surface portion of the second wire element so that a cross-section of the double bar wire assembly (505) forms one of an L, U or T-shape, having at least one corner surface (S25).

12. The sport face guard according to claim 10, further comprising a third element made of cut metal plate, which extends along and is directly connected to the double bar wire assembly (505) to form a triple element assembly, wherein the substantially flat or concave surface portion of the base surface of the first tapered wire is connected to a surface portion of the third element so that a cross-section of the triple element assembly forms a U-shape, having at least one corner surface (S27).

13. The sport face guard according to claim 5, wherein:

the second base surface of the first tapered wire of the interconnected double bar assembly comprises a substantially flat or concave surface portion; and the second wire element of the interconnected double bar assembly comprises a second tapered wire having a base end and a tip end, a cross-section of the second wire element comprising:

a first longest dimension (L1), the first longest dimension (L1) of the cross-section of the wire (20) being in a direction of a major axis (X) of the wire (20);

a second longest dimension (L2), the second longest dimension (L2) of the cross-section of the wire (20) being in a direction that is perpendicular to the major axis (X) of the wire (20), the second longest dimension (L2) being less than the first longest dimension (L1);

wherein the first longest dimension (L1) is between 3 mm and 15 mm, and a ratio between the first longest dimension (L1) and the second longest dimension (L2) is greater than 1.2; and wherein the surface of the wire (20), when divided into two part surfaces (S1 and S2) by a straight line (y1) crossing the end points (a, b) of the second longest dimension (L2), comprises:

a first tapered surface (S1) and a second base surface (S2), the first tapered surface having a larger area than the second surface (S2) and comprising a tip end with an end point (c) of the first longest dimension (L1); wherein a distance from the end point (c) to the straight line (y1) is longer than a distance from the second surface (S2) to the straight line (y1); and wherein the second base surface comprise a substantially flat or concave surface portion; and wherein the base end of the first tapered wire is connected to the base end of the second tapered wire, and the tip end of the first tapered wire extends in a direction diametrically opposed to the tip end of the second tapered wire.

14. The sport face guard according to claim 13, wherein at least one surface of the interconnected double bar wire assembly is configured to be in contact with one or more of a brim of the sports headgear, an edge of the sports headgear, a flat surface of the sports headgear or the head of a user, and wherein the contact is configured to take place either directly or through a padding system that is disposed on the one side of the first tapered wire and the second tapered wire.

15. The sport face mask according to claim 13, wherein the substantially flat or concave surface portion of the base surface has a width of at least 1 mm.

16. The sport face guard according to claim 5, wherein a surface of the second wire element extends along and is directly connected to the first tapered surface or the second base surface of the first tapered wire along the common plane, the surface of the second wire element being substantially flat.

17. A sports face guard (501) for a sports headgear, the sports face guard (501) comprising:

an interconnected wire assembly (505) comprising;

a first tapered wire (20) having a base end and a tip end; and a second wire element extending along and adjacent to the first tapered wire;

wherein a cross section of the first tapered wire comprises:

a first longest dimension (L1), the first longest dimension (L1) of the cross-section of the wire (20) being in a direction of a major axis (X) of the wire (20);

a second longest dimension (L2), the second longest dimension (L2) of the cross-section of the wire (20) being in a direction that is perpendicular to the major axis (X) of the wire (20), the second longest dimension (L2) being less than the first longest dimension (L1);

wherein the first longest dimension (L1) is between 3 mm and 15 mm, and a ratio between the first longest dimension (L1) and the second longest dimension (L2) is greater than 1.2;

wherein the surface of the wire (20), when divided into two part surfaces (S1 and S2) by a straight line (y1) crossing the end points (a, b) of the second longest dimension (L2), comprises:

a first tapered surface (S1) and a second base surface (S2), the first tapered surface having a larger area than the second surface (S2) and comprising a tip end with an end point (c) of the first longest dimension (L1); wherein a distance from the end point (c) to the straight line (y1) is longer than a distance from the second surface (S2) to the straight line (y1), wherein the second wire element of the interconnected wire assembly comprises a second tapered wire being identical with the first tapered wire; and the tip end of the first tapered wire is disposed adjacent to a tip end of the second tapered wire, and wherein the interconnected wire assembly further comprises a third tapered wire, which is connected to and sandwiched by the first tapered wire and the second wire element.

* * * * *